United States Patent [19]

Heuschkel

[11] 3,954,421

[45] May 4, 1976

[54] ALLOYS FOR HIGH CREEP APPLICATIONS

[75] Inventor: Julius Heuschkel, Irwin, Pa.

[73] Assignee: Westinghouse Electric Corporation, Pittsburgh, Pa.

[22] Filed: Dec. 17, 1974

[21] Appl. No.: 533,586

Related U.S. Application Data

[63] Continuation of Ser. No. 242,303, April 10, 1972, abandoned.

[52] U.S. Cl. ..... 29/183; 29/196.1; 75/125; 75/128 V; 75/128 W; 138/178

[51] Int. Cl.[2] ..... F16L 9/02; C22C 38/42

[58] Field of Search ..... 75/125, 128 V, 128 W; 29/183, 196.1; 138/178

[56] References Cited

UNITED STATES PATENTS

| | | | |
|---|---|---|---|
| 2,862,102 | 11/1958 | Heuschkel | 219/137 |
| 2,968,549 | 1/1961 | Brady et al. | 75/125 |
| 3,362,811 | 1/1968 | Heuschkel | 75/125 |

*Primary Examiner*—L. Dewayne Rutledge
*Assistant Examiner*—Arthur J. Steiner
*Attorney, Agent, or Firm*—R. T. Randig

[57] ABSTRACT

There is disclosed a ferritic alloy having a high creep resistance particularly suitable for use in the castings, the welding material, and welds of the casings and conductors of apparatus operating at high temperatures, typically steam turbines operating at about 1050°F. This alloy has between about 1% and 2% copper and small but effective quantities of carbon, vanadium, and molybdenum and is low in manganese, silicon, and nickel although nickel is sometimes needed for increased tensile strength and toughness. In modifications or variations of this alloy small but effective quantities of cobalt and tungsten improve creep resistance while chromium is minimized.

9 Claims, 56 Drawing Figures a b c d e f g h i j a b

○ = High Purity
◎ = Hi Purity, reference
● = Commercial, alloyed
◇ = Comm., unalloyed c d e f g h i j

ALLOYS FOR HIGH CREEP APPLICATIONS

This is a continuation of application Ser. No. 242,303, fled Apr. 10, 1972, now abandoned.

CROSS REFERENCE TO RELATED DOCUMENTS

The following documents are incorporated herein by reference:

1. *Joint International Conference on Creep*, ASME, ASTM, IME, 1963.
2. Lubahan, J. D. and Felgan, R. P., *Plasticity and Creep of Metals*, J. Wiley & Sons, 1961.
3. Stout, R. D. and Doty, W. D., *Weldability of Steels*, Welding Research Council, 1953 (p. 131).
4. *Temper Embrittlement in Steel*, ASTM Special Technical Publication No. 407, 1968.
5. Heuschkel, J., "Composition Controlled, High-Strength, Ductile, Tough, Steel Weld Metals," Welding Journal, 43 (8), Reseach Suppl., 361-s to 384-s (1964).
6. Heuschkel, J., "Ultra-Tough Steel Weld Metals," Welding Journal, 46 (2), Research Suppl., 74-s to 93-s (1967).
7. U.S. Pat. No. 3,362,811, Welding Filler Metals, Jan. 9, 1968, J. Heuschkel.
8. Wessel, E. T. and Hays, L. E., "Development of a High-Strength, Tough Weldable, Structural Steel," Welding Journal, 43 (5), Reseach Suppl., 215-s to 231-s (1964).
9. Heuschkel, J., "Weld Metal Composition Control, " Welding Journal, 48 (8), Research Suppl., 328-s to 347-s (1969).

BACKGROUND OF THE INVENTION

This invention relates to the alloy art and has particular relationship to ferrous alloys of the ferritic type.

Plain carbon and low alloy ferritic steels and austenitic steels have poor creep resistance (Documents 1 and 2 above). Creep is defined as the progressive straining or deformation of material under a static load; creep is particularly significant at high temperatures typically about 1000°F. When such materials are subjected to relatively low static tensile stress at elevated temperatures, they tend to elongate above amounts permissible in engineering designs. Rotating machines, for example steam turbine, component housings, and conductors operating at high temperatures (for example, 1050°F), are typical of cases where creep must be limited. For such applications, 2.25%Cr-1%Mo steels have been used in accordance with the teachings of the prior art and the poor creep resistance of such steels has presented a serious problem because it was necessary to design components or parts such as housings and conductors so that the stresses imposed on them is low.

It is an object of this invention to provide alloy steel which shall permit design of such parts for higher stresses in high temperature service without exceeding, and indeed improving on, the presently obtained creep values resulting from the use of the Cr-Mo steel.

It is also an object of this invention to provide such an alloy which shall be no more costly than the presently used Cr-Mo steel and which shall be readily weldable without requiring high peheat temperatures, and shall be producible in both the cast and the wrought forms.

SUMMARY OF THE INVENTION

This invention arises from the discovery that the welded joint heat-affected zone in wrought steel is a critical region of weakness under stress-rupture and creep conditions at 1050°F. As early as 1966, the problem of temper embrittlement was recognized as a contributing factor. It was known than that even short-time exposure to 1050°F can produce embrittlement in some weld metals and in the heat-affected zones of some welded joints (Documents 3 and 4 above). It is realized that any satisfactory solution to the higher-stress-level creep-resistance problem must also circumvent the temper embrittlement problem. This invention also arises in part from the discovery that the elimination or near elimination of manganese and silicon is a ferrous alloy contributes to the minimization of temper embrittlement and, in welding operations, results in tough multipass welds (Documents 5, 6, 7). This discovery leads to the concept that creep resistance can be improved by the presence of selected metal elements and by the absence or minimization of other elements. Specifically improved creep properties are achieved by selecting a proper balance of Fe-C-Cu-MO-V-W-Co, while maintaining Mn-P-S-Si-Ni-N-O at the lowest practical levels. Chromium may be present up to 1.51% although satisfactory creep properties are obtained with higher Cr content. Also, where toughness is required at ambient and low temperatures, nickel may be present up to 3.67%, but better results are obtained when the nickel content is low.

In accordance with this invention a ferrous (iron base) alloy for creep resistance castings and weld metals is provided which includes the elements:

Carbon
Copper
Molybdenum
Vanadium
Chromium
Cobalt.

The chromium is the least important of the first five elements; the present of some cobalt is desirable but not essential.

The undesirable elements—those which should be eliminated from the casting—are manganese, silicon, nickel, tungsten. It is of significance that the alloy content must be set to take into consideration adequate tensile strength and toughness and these demands conflict with the achievement of the ultimate in creep resistance; compromise is necessary (See FIGS. 5 and 9). Si may be present up to less than 0.5%, to achieve improved fluidity. Also, the presence of Ni up to 2.5% may be tolerated to provide added normal and low temperature toughness; from the viewpoint of improved creep properties alone, it is desirable that Ni should be eliminated. Nickel may thus involve a compromise between the demands for normal and low-temperature toughness and the demands of high-temperature creep resistance.

For best creep resistance, each element in the "desirable" category has an optimum level. For example, it is shown that the Cu content should be between 1.0 and 2.0% although it is preferred to maintain the copper between 1.4 and 2%. Higher content than 2.0% and lower content than 1.4% reduce ruputure time and increase the creep rate. Carbon should be maintained as high practicable, but too high levels impose excessive welding preheat requirements. Probable acceptable limits for C are from 0.14 to 0.20%. The molybdenum level should be maintained near 2.0%. This element is shown to be more effective than chromium in resisting creep. The presence of vandaium is beneficial up to 0.8%, but an alloy system can be produced which does not require the presence of vanadium, or requires less than 0.8% V.

BRIEF DESCRIPTION OF THE DRAWINGS

For a better understanding of this invention, both as to its organization and as to its method of operation, together with additional objects and advantages thereof, reference is made to the following description, taken in connection with the accompanying drawings, in which.

Figure 16A:
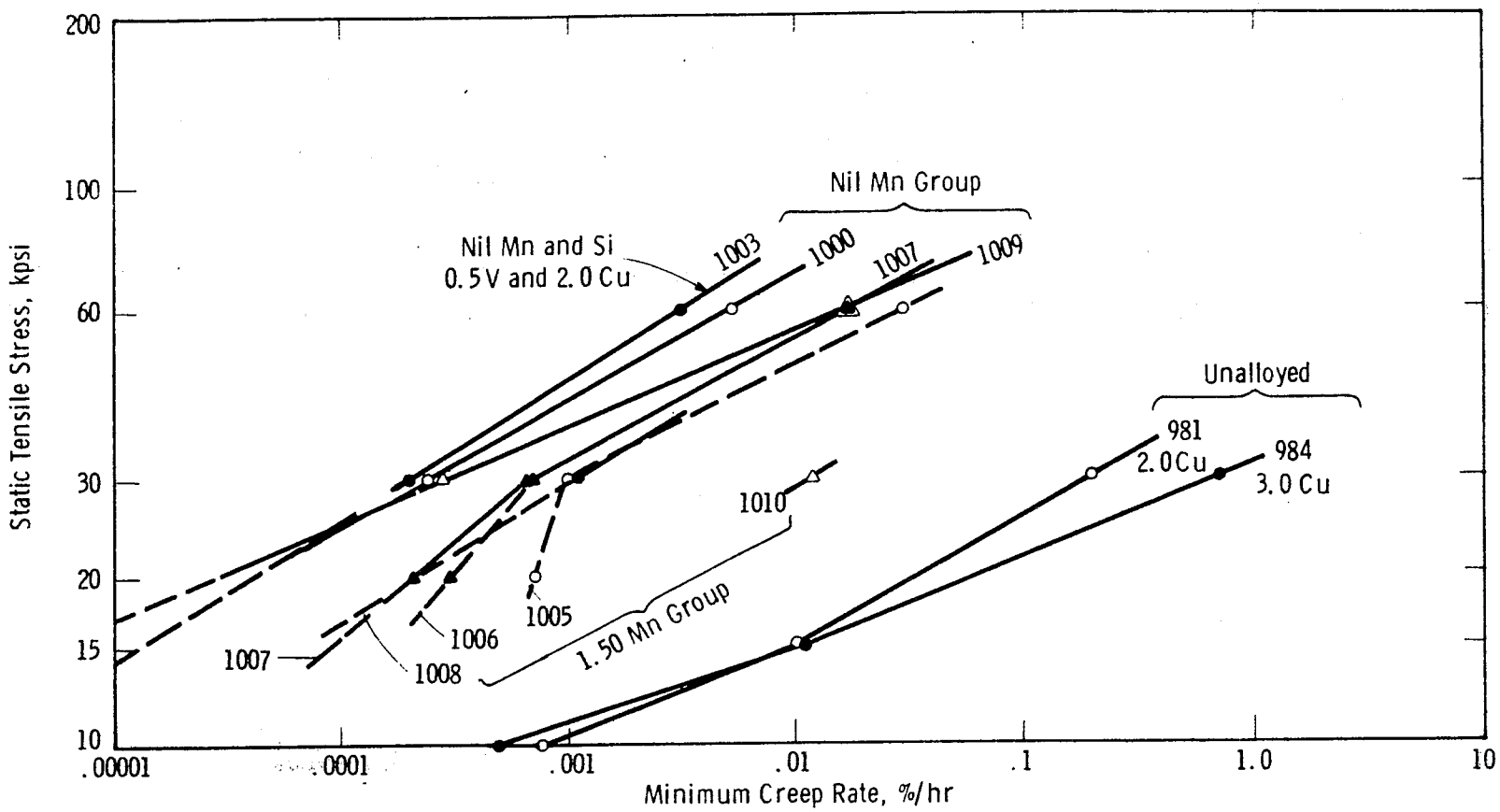
Figure 16B:
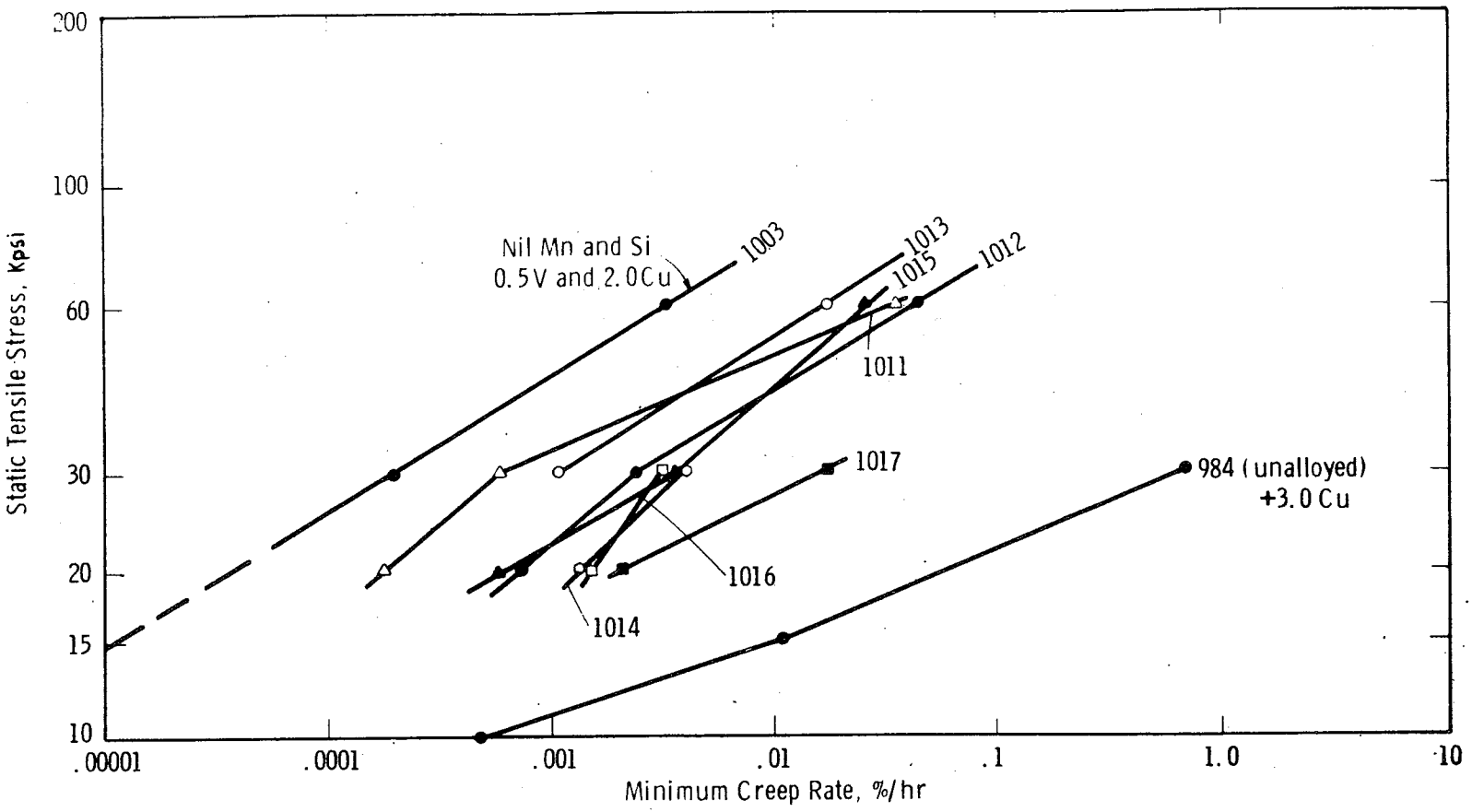
Figure 17:
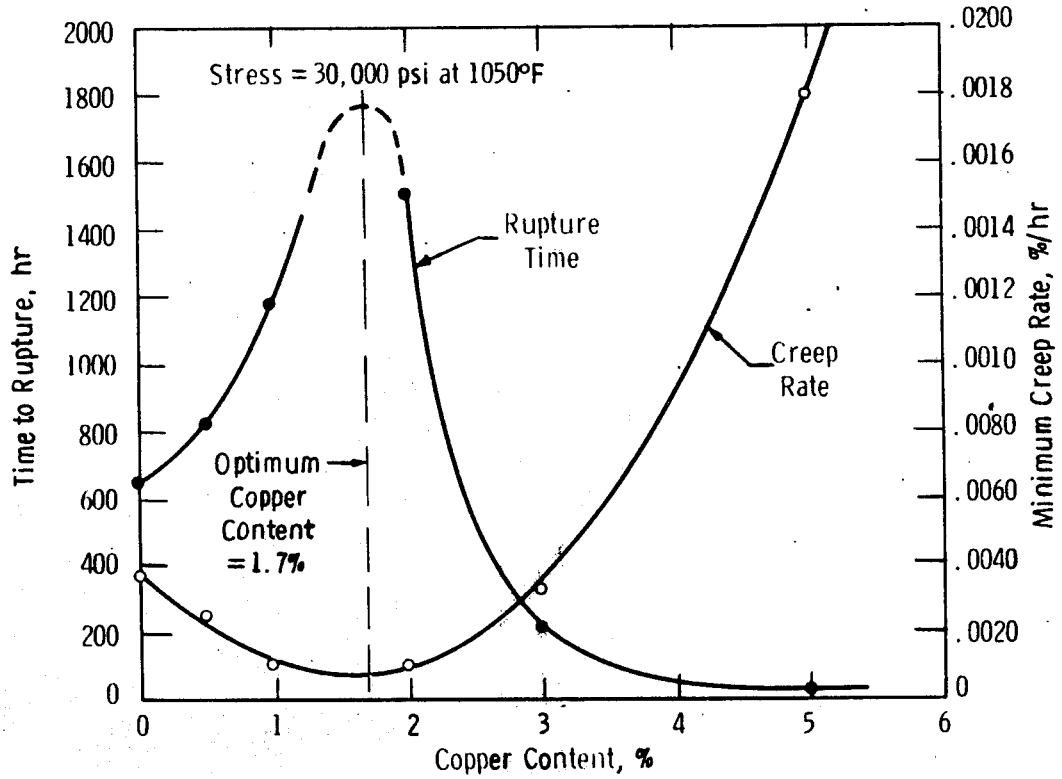
Figure 18:
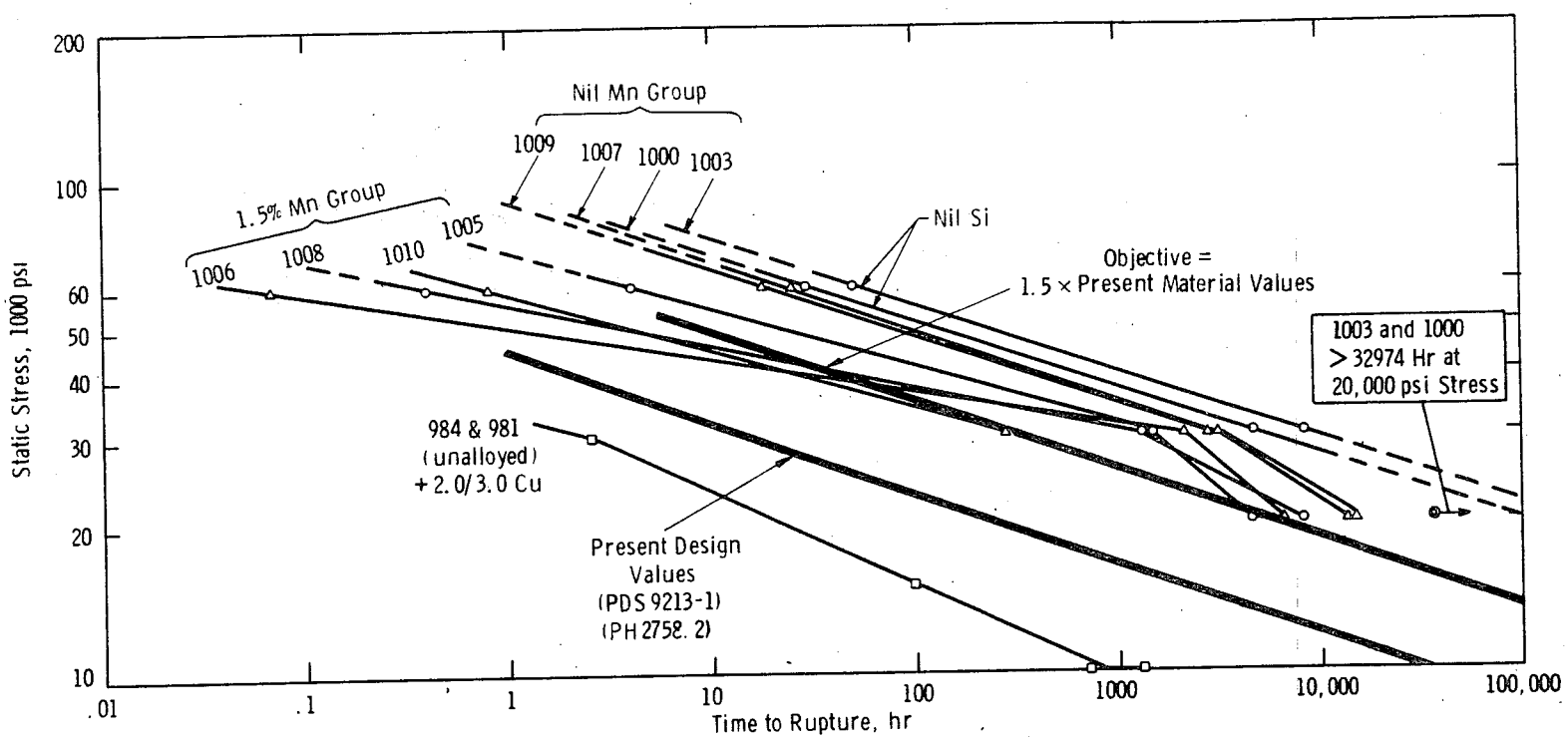
Figure 19:
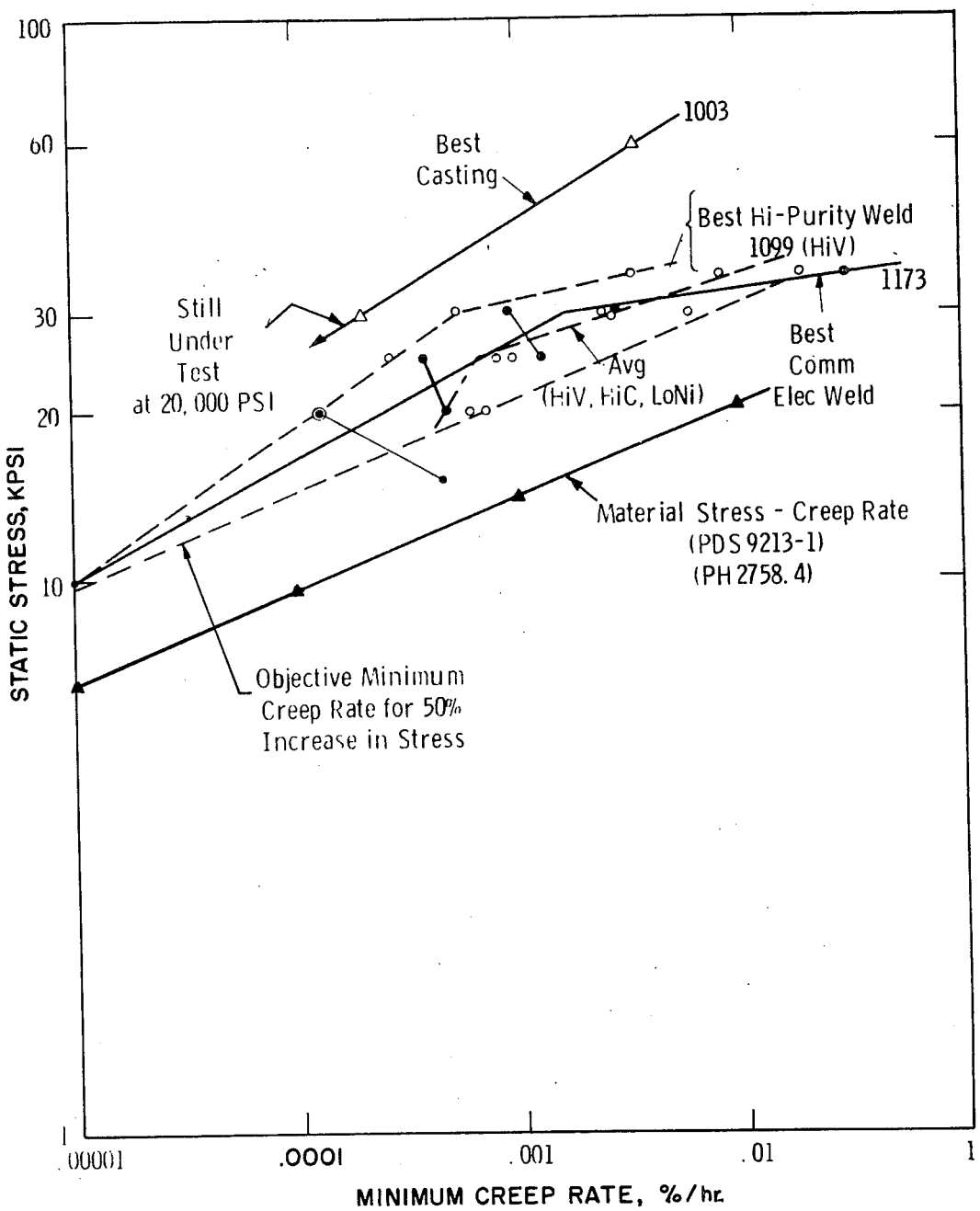
FIGS. 19(*a*) through (*j*) are graphs showing the trend of the influence of changes in the content alloying components on load resistance to creep of TIG weld metal at high temperature.

FIGS. (15(*a*) and (*b*) are graphs showing the relationship between the stress and the time interval after the application of the stress when rupture occurred for different compositions of cast material stressed at high temperature;

FIGS. 16(*a*) and (*b*) are graphs showing the relationship between the stress and the minimum creep rate for different compositions of cast material stressed at high temperature;

FIG. 17 is a graph showing the relationship between the time, after application of stress, and the creep rate for castings having different content of copper as a function of the copper content;

FIG. 18 is a graph showing the relationship between stress and the time interval, after application of stress, when rupture occurred for casting specimens of different compositions at high temperature; and FIG. 19 is a graph showing the relationship between stress and minimum creep rate for casting specimens of different compositions at high temperature.

DETAILED DESCRIPTION OF INVENTION

Figure 1:
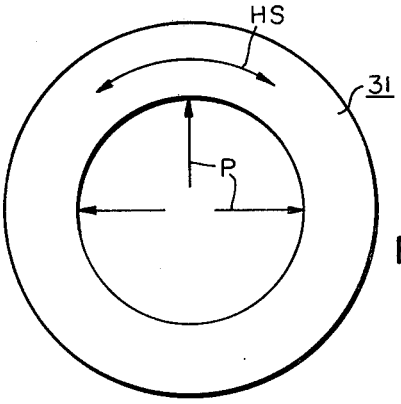
FIG. 1 is a fragmental view in transverse section of typical apparatus to which this invention is applicable.

FIG. 1 shows a fragmental part 31 of apparatus to which this invention is applicable. Typically this part 31 is a conductor of a steam generator operating at 1050°F. Steam at this temperature flows through the conductor 31 exerting static pressure P on the conductor. Such pressure produces a hoop stress HS. It has been found that stress produced by the pressure P, and particularly the hoop stress HS, progressively strains the conductor 31 resulting in failure if the pressure is applied for a long enough time interval. This phenomenon or strain is defined as creep and the static stress which produces it as creep stress.

Figure 2:
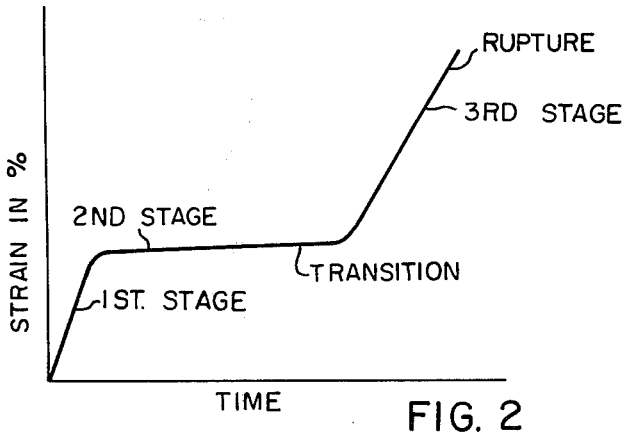
FIG. 2 is a graph showing how the strain varies as a function of time under creep for typical apparatus.

The manner in which creep progresses is a typical situation is shown in FIG. 2. In FIG. 2 strain, the deformation produced by stress, is plotted vertically in percent of departure from the unstressed structure, and time is plotted horizontally. The creep may be subdivided into three stages; a first stage which occurs when the stress is first applied and is at a relatively high rate, a second or working-life stage at a substantially lower rate, and a third stage at a very high rate which terminates in rupture. While the deformation is shown in FIG. 2 as linear; that is, at a constant rate, in all stages; it is usually not linear. However, in the transition between stages the slopes of the curve change abruptly. The minimum creep rate which serves as a measure of creep is defined as the lowest creep per unit time of the specimen under test in the second stage. In a situation such as is shown in FIG. 2 the minimum creep rate is nearly constant throughout the second state. The transition is defined as the point where the transition between stage 2 and stage 3 takes place (See FIG. 2).

No practicable facility for preventing creep in austenitic or ferritic structures has been devised. The invention is addressed to reducing the creep rate so as to prevent failure for a long interval, for example, 10 years or 87,600 hours assuming that the stress is applied continuously every day.

In arriving at this invention welding rod or wire for TIG welding of 21 different compositions were produced from vacuum melted alloys. The compositions are shown in Table I below.

TABLE I

| Variable Element | Vacuum Melt Heat No. | Weld Check Analysis Weight Percent No. | C | Mn | Si | Cu | Ni | Cr | Mo | V | W | Co |
|---|---|---|---|---|---|---|---|---|---|---|---|---|
| | 833 | 1058 | 0.002 | <0.002 | <0.005 | 0.92 | 3.46 | 0.68 | 1.94 | 0.48 | 0.20 | 0.83 |
| | | 1108 | | | | | | | | | | |
| C | 832 | 1057 | 0.1015 | <0.002 | 0.0185 | 0.91 | 3.405 | 0.72 | 2.07 | 0.49 | 0.265 | 0.82 |
| | 834 | 1061 | 0.216 | <0.002 | 0.009 | 0.96 | 3.425 | 0.72 | 2.11 | 0.48 | 0.28 | 0.84 |
| | | 1110 | | | | | | | | | | |
| | 832 | 1057 | 0.1015 | <0.002 | 0.0185 | 0.91 | 3.405 | 0.72 | 2.07 | 0.49 | 0.265 | 0.82 |
| | 835 | 1060 | 0.1115 | 1.11 | 0.008 | 1.09 | 3.40 | 0.74 | 2.06 | 0.51 | 0.31 | 0.76 |
| Mn | | 1109 | | | | | | | | | | |
| | 839 | 1063 | 0.0905 | 2.33 | 0.033 | 1.19 | 3.47 | 0.69 | 2.06 | 0.55 | 0.31 | 0.81 |
| | 832 | 1057 | 0.1015 | <0.002 | 0.0185 | 0.91 | 3.405 | 0.72 | 2.07 | 0.49 | 0.265 | 0.82 |
| Si | 840 | 1064 | 0.075 | <0.002 | 0.28 | 0.78 | 3.39 | 0.70 | 2.04 | 0.49 | 0.32 | 0.96 |
| | 846 | 1095 | 0.0965 | <0.002 | 0.555 | 0.80 | 3.39 | 0.71 | 2.06 | 0.54 | 0.29 | 2.68 |
| | 847 | 1096 | 0.089 | <0.002 | 0.032 | 0.004 | 3.04 | 0.72 | 2.05 | 0.50 | 0.33 | 0.86 |
| Cu | 832 | 1057 | 0.1015 | <0.002 | 0.0185 | 0.91 | 3.405 | 0.72 | 2.07 | 0.49 | 0.265 | 0.82 |
| | 852 | 1097 | 0.095 | <0.002 | 0.046 | 1.96 | 3.43 | 0.37 | 2.04 | 0.50 | 0.31 | 0.99 |
| | 836 | 1059 | 0.116 | 0.23 | 0.034 | 0.94 | <0.02 | 0.76 | 2.49 | 0.52 | 0.21 | 0.81 |
| Ni | 832 | 1057 | 0.1015 | <0.002 | 0.0185 | 0.91 | 3.405 | 0.72 | 2.07 | 0.49 | 0.265 | 0.82 |
| | 837 | 1062 | 0.0935 | <0.002 | 0.012 | 0.87 | 5.27 | 0.59 | 2.05 | 0.38 | 0.32 | 0.99 |
| | 858 | 1103 | 0.111 | — | — | 0.92 | 3.38 | <0.05 | 2.01 | 0.565 | 0.15 | 0.82 |
| Cr | 832 | 1057 | 0.1015 | <0.002 | 0.0185 | 0.91 | 3.405 | 0.72 | 2.07 | 0.49 | 0.265 | 0.82 |
| | 859 | 1098 | 0.1285 | <0.002 | 0.012 | 0.67 | 3.32 | 1.435 | 2.07 | 0.52 | 0.30 | 0.98 |
| | 863 | 1100 | 0.127 | <0.002 | 0.009 | 0.90 | 3.39 | 0.76 | <0.04 | 0.52 | 0.32 | 0.90 |
| Mo | 832 | 1057 | 0.1015 | <0.002 | 0.0185 | 0.91 | 3.405 | 0.72 | 2.07 | 0.49 | 0.265 | 0.82 |
| | 865 | 1101 | 0.1415 | <0.002 | <0.005 | 0.96 | 3.40 | 0.60 | 4.015 | 0.50 | 0.29 | 0.88 |
| | 866 | 1102 | 0.0875 | <0.002 | 0.020 | 0.90 | 3.35 | 0.61 | 2.06 | <0.05 | 0.32 | 0.84 |
| V | 832 | 1057 | 0.1015 | <0.002 | 0.0185 | 0.91 | 3.405 | 0.72 | 2.07 | 0.49 | 0.265 | 0.82 |
| | 867 | 1099 | 0.086 | <0.002 | 0.012 | 0.64 | 3.19 | 0.70 | 2.10 | 1.04 | 0.28 | 0.79 |
| | 870 | 1104 | 0.0885 | <0.002 | 0.023 | 0.84 | 3.43 | 0.64 | 2.04 | 0.50 | <0.03 | 0.91 |
| W | 832 | 1057 | 0.1015 | <0.002 | 0.0185 | 0.91 | 3.405 | 0.72 | 2.07 | 0.49 | 0.265 | 0.82 |
| | 871 | 1105 | 0.1355 | <0.002 | — | 0.95 | 3.26 | 0.64 | 2.05 | 0.51 | 0.59 | 0.81 |
| | 875 | 1106 | 0.1215 | <0.002 | 0.009 | 0.91 | 3.32 | 0.70 | 2.03 | 0.48 | 0.31 | <0.05 |
| Co | 832 | 1057 | 0.1015 | <0.002 | 0.0185 | 0.91 | 3.405 | 0.72 | 2.07 | 0.49 | 0.265 | 0.82 |
| | 877 | 1107 | 0.117 | <0.002 | 0.022 | 0.81 | 3.60 | 0.71 | 2.04 | 0.50 | 0.31 | 1.50 |
| Averages of Non Variable Elements | | | 0.106 | <0.002 | 0.018 | 0.89 | 3.37 | 0.67 | 2.07 | 0.50 | 0.29 | 0.36 |

| Variable Element | Vacuum Melt Heat No. | Weld No. | Check Analysis Weight Percent P | S | N | O |
|---|---|---|---|---|---|---|
| | 833 | 1058 | — | — | 0.0010 | 0.0026 |
| | | 1108 | | | | 0.0008 |
| C | 832 | 1057 | <0.002 | <0.0020 | 0.0010 | 0.0014 |
| | 834 | 1061 | — | — | 0.0010 | 0.0009 |
| | | 1110 | | | | |
| | 832 | 1057 | <0.002 | <0.0020 | 0.0010 | 0.0014 |
| | 835 | 1060 | — | — | 0.0005 | 0.0006 |
| Mn | | 1109 | | | | 0.0002 |
| | 839 | 1063 | — | 0.0028 | 0.0015 | 0.0170 |
| | 832 | 1057 | <0.002 | <0.0020 | 0.0010 | 0.0014 |
| Si | 840 | 1064 | — | — | 0.0010 | 0.0005 |
| | 846 | 1095 | <0.002 | <0.0020 | 0.0007 | 0.0009 |
| | 847 | 1096 | — | — | 0.0005 | 0.0004 |
| Cu | 832 | 1057 | <0.002 | <0.0020 | 0.0010 | 0.0014 |
| | 852 | 1097 | — | — | 0.0005 | 0.0010 |
| | 836 | 1059 | <0.002 | — | 0.0008 | 0.0016 |
| Ni | 832 | 1057 | <0.002 | <0.0020 | 0.0010 | 0.0014 |
| | 837 | 1062 | — | — | 0.0009 | 0.0007 |
| | 858 | 1103 | — | — | 0.0012 | 0.0006 |
| Cr | 832 | 1057 | <0.002 | <0.0020 | 0.0010 | 0.0014 |
| | 859 | 1098 | — | — | 0.0006 | 0.0004 |
| | 863 | 1100 | — | — | 0.0003 | 0.0005 |
| Mo | 832 | 1057 | <0.002 | <0.0020 | 0.0010 | 0.0014 |
| | 865 | 1101 | — | — | 0.0007 | 0.0006 |
| | 866 | 1102 | — | — | 0.0007 | 0.0006 |
| V | 832 | 1057 | <0.002 | <0.0020 | 0.0010 | 0.0014 |
| | 867 | 1099 | — | — | 0.0014 | 0.0003 |
| | 870 | 1104 | <0.002 | <0.0020 | 0.0006 | 0.0008 |
| W | 832 | 1057 | <0.002 | <0.0020 | 0.0010 | 0.0014 |
| | 871 | 1105 | 0.005 | — | 0.0009 | 0.0011 |
| | 875 | 1106 | — | — | 0.0011 | 0.0010 |
| Co | 832 | 1057 | <0.002 | <0.0020 | 0.0010 | 0.0014 |
| | 877 | 1107 | <0.002 | <0.0042 | 0.0015 | 0.0007 |
| | Averages of Non Variable Elements | | <0.002 | <0.0026 | 0.0009 | 0.0008 |

Table I presents the alloy number in the second column counting from left to right, and the number of the weld formed with the alloy in the third column. As indicated by the rectangles along the diagonal of Table I, the table may be divided into groups of three each. Except for one element, different for each group and tabulated in the first column, the compositions of the alloying components in each group are substantially the same. The compositions of the one element is markedly different for the three alloys of each group. The component of each group of three, which is varied is tabulated in the first column. Since alloy 832 is common to all groups, it is repeated in each group of three. For each alloy component or element, each group has an alloy with higher than heat 832, (Hi), and an alloy with a content lower than 832, (Lo).

Weld metal specimens were made for each alloy and tested for creep and other properties. The composition of the weld metal is shown in Table II below:

TABLE II

| Variable Element | Vacuum Melt Heat No. | Weld No. | Check Analyses (Weight Percent) C | Mn | Si | Cu | Ni | Cr | Mo | V | W | Co | P | S | N | O |
|---|---|---|---|---|---|---|---|---|---|---|---|---|---|---|---|---|
| | 833 | 1058 | 0.013 | 0.059 | <0.03 | 0.87 | 3.47 | 0.84 | 1.77 | 0.42 | 0.10 | 0.64 | 0.0023 | 0.004 | 0.0034 | 0.0002 |
| | | 1108 | | | | | | | | | | | | | | |
| C | 832 | 1057 | 0.096 | 0.058 | 0.05 | 0.82 | 3.415 | 0.89 | 1.66 | 0.41 | 0.13 | 0.65 | 0.0023 | 0.003 | 0.0041 | 0.0010 |
| | 834 | 1061 | 0.201 | 0.088 | 0.07 | 0.77 | 3.43 | 0.78 | 1.80 | 0.52 | 0.20 | 0.67 | 0.0015 | 0.005 | 0.0010 | 0.0003 |
| | | 1110 | | | | | | | | | | | | | | |
| | 832 | 1057 | 0.096 | 0.058 | 0.05 | 0.82 | 3.42 | 0.89 | 1.66 | 0.41 | 0.13 | 0.65 | 0.0023 | 0.003 | 0.0041 | 0.0010 |
| Mn | 835 | 1060 | 0.126 | 0.995 | 0.04 | 0.94 | 3.45 | 0.88 | 1.90 | 0.49 | 0.04 | 0.70 | 0.0012 | 0.003 | 0.0014 | 0.0002 |
| | | 1109 | | | | | | | | | | | | | | |
| | 839 | 1063 | 0.105 | 1.90 | 0.09 | 0.88 | 3.53 | 0.98 | 1.86 | 0.33 | <0.03 | 0.49 | 0.0023 | 0.004 | 0.0013 | 0.0015 |
| | 832 | 1057 | 0.096 | 0.058 | 0.05 | 0.82 | 3.42 | 0.89 | 1.66 | 0.41 | 0.13 | 0.65 | 0.0023 | 0.003 | 0.0041 | 0.0010 |
| Si | 840 | 1064 | 0.107 | 0.039 | 0.275 | 0.71 | 3.48 | 0.80 | 1.86 | 0.42 | 0.04 | 0.71 | 0.0045 | 0.004 | 0.0016 | 0.0013 |
| | 846 | 1095 | 0.084 | 0.032 | 0.53 | 0.68 | 3.39 | 0.80 | 1.89 | 0.48 | 0.14 | 0.74 | 0.0015 | 0.004 | 0.0018 | 0.0010 |
| | 847 | 1096 | 0.087 | 0.034 | 0.04 | 0.022 | 3.12 | 0.82 | 1.87 | 0.46 | 0.17 | 0.84 | 0.0025 | 0.003 | 0.0017 | 0.0014 |
| Cu | 832 | 1057 | 0.096 | 0.058 | 0.05 | 0.82 | 3.42 | 0.89 | 1.66 | 0.41 | 0.13 | 0.65 | 0.0023 | 0.003 | 0.0041 | 0.0010 |
| | 852 | 1097 | 0.078 | 0.035 | 0.09 | 1.81 | 3.42 | 0.47 | 1.83 | 0.45 | 0.12 | 0.75 | 0.0018 | 0.003 | 0.0013 | 0.0009 |
| | 836 | 1059 | 0.122 | 0.081 | 0.04 | 0.80 | 0.56 | 0.86 | 1.73 | 0.44 | <0.03 | 0.70 | 0.0023 | 0.004 | 0.0014 | 0.0006 |
| Ni | 832 | 1057 | 0.096 | 0.058 | 0.05 | 0.82 | 3.42 | 0.89 | 1.66 | 0.41 | 0.13 | 0.65 | 0.0023 | 0.003 | 0.0041 | 0.0010 |
| | 837 | 1062 | 0.117 | 0.065 | 0.04 | 0.90 | 5.06 | 0.72 | 1.86 | 0.35 | 0.19 | 0.67 | 0.0028 | 0.004 | 0.0032 | 0.0023 |
| | 858 | 1103 | 0.106 | 0.040 | 0.06 | 0.75 | 3.40 | 0.20 | 1.88 | 0.45 | 0.12 | 0.60 | 0.0018 | 0.003 | 0.0010 | 0.0008 |
| Cr | 832 | 1057 | 0.096 | 0.058 | 0.05 | 0.82 | 3.42 | 0.89 | 1.66 | 0.41 | 0.13 | 0.65 | 0.0023 | 0.003 | 0.0041 | 0.0010 |
| | 859 | 1098 | 0.098 | 0.035 | 0.07 | 0.67 | 3.38 | 1.51 | 1.75 | 0.43 | 0.16 | 0.61 | 0.0015 | 0.004 | 0.0015 | 0.0009 |
| | 863 | 1100 | 0.126 | 0.058 | 0.06 | 0.88 | 3.40 | 0.93 | 0.07 | 0.45 | 0.17 | 0.76 | 0.0018 | 0.003 | 0.0011 | 0.0011 |
| Mo | 832 | 1057 | 0.096 | 0.058 | 0.05 | 0.82 | 3.42 | 0.89 | 1.66 | 0.41 | 0.13 | 0.65 | 0.0023 | 0.003 | 0.0041 | 0.0010 |
| | 865 | 1101 | 0.135 | 0.054 | 0.05 | 0.82 | 3.43 | 0.85 | 3.36 | 0.43 | 0.09 | 0.70 | 0.0018 | 0.003 | 0.0011 | 0.0009 |
| | 866 | 1102 | 0.095 | 0.085 | 0.05 | 0.83 | 3.41 | 0.98 | 1.82 | 0.061 | 0.09 | 0.70 | 0.0023 | 0.003 | 0.0023 | 0.0004 |
| V | 832 | 1057 | 0.096 | 0.058 | 0.05 | 0.82 | 3.42 | 0.89 | 1.66 | 0.41 | 0.13 | 0.65 | 0.0023 | 0.003 | 0.0041 | 0.0010 |
| | 867 | 1099 | 0.099 | 0.091 | 0.08 | 0.71 | 3.49 | 0.90 | 1.92 | 0.85 | 0.19 | 0.73 | 0.0018 | 0.004 | 0.0015 | 0.0004 |
| | 870 | 1104 | 0.097 | 0.066 | 0.05 | 0.81 | 3.67 | 0.91 | 1.69 | 0.43 | <0.03 | 0.71 | 0.0031 | 0.003 | 0.0014 | 0.0005 |
| W | 832 | 1057 | 0.096 | 0.058 | 0.05 | 0.82 | 3.42 | 0.89 | 1.66 | 0.41 | 0.13 | 0.65 | 0.0023 | 0.003 | 0.0041 | 0.0010 |
| | 871 | 1105 | 0.144 | 0.032 | 0.04 | 0.87 | 3.33 | 0.88 | 1.90 | 0.45 | 0.57 | 0.65 | 0.0020 | 0.003 | 0.0012 | 0.0003 |
| | 875 | 1106 | 0.119 | 0.054 | 0.05 | 0.78 | 3.38 | 0.84 | 1.81 | 0.43 | — | 0.008 | 0.0015 | 0.003 | 0.0013 | 0.0014 |
| Co | 832 | 1057 | 0.096 | 0.058 | 0.05 | 0.82 | 3.42 | 0.89 | 1.66 | 0.41 | 0.13 | 0.65 | 0.0023 | 0.003 | 0.0041 | 1.0010 |
| | 877 | 1107 | 0.121 | 0.054 | 0.07 | 0.91 | 3.41 | 1.06 | 1.87 | 0.46 | 0.13 | 1.01 | 0.0010 | 0.004 | 0.0009 | 0.0003 |
| Average of Non-Variable Elements | | | 0.109 | 0.055 | 0.057 | 0.81 | 3.42 | 0.85 | 1.82 | 0.44 | 0.12 | 0.69 | 0.0021 | 0.0035 | 0.0017 | 0.0009 |

Table II includes rectangles corresponding to the rectangles of Table I in which the variable components, indicated on the left, are tabulated.

The weld metal of Table II was derived from inert-gas-shielded, tungsten arc, high purity welds deposited on a Ni-Cr-Mo-V steel, rolled, austenized, quenched-and-tempered plate stock, 1-¼ inches thick.

The weld metals of Table II are single element variations of a reference composition, Heat No. 832, weld 1057, of Table II. In addition to weld 1057 in each grouping there are one weld each of a "low" and a "high" level of each of the eight individual elements and two welds each of higher Mn and Si contents. The "high" level in each of the eight cases was intended to have a value twice the "reference" amount listed in the preceding table. The "low" level for each element was intended to be only that amount which resulted by enrichment from the remelted base plate during welding, when none of the element in question was included in the filler metal. A summary of the value limits, obtained by check analyses as listed in Table II are shown in Table III:

TABLE III

| Element | "Low" | "High" | Element | "Low" | "High" |
|---|---|---|---|---|---|
| Mn | 0.058* | 1.90 | Cr | 0.20 | 1.51 |
| Si | 0.05* | 0.53 | Mo | 0.07 | 3.36 |
| C | 0.013 | 0.201 | V | 0.06 | 0.85 |
| Cu | 0.022 | 1.81 | W | <0.03 | 0.57 |
| Ni | 0.56 | 5.06 | Co | 0.008 | 1.01 |

*Thus these values for Mn and Si are those of the "reference" composition, which is intended to have those two elements as low as practical.

By check analyses, this second series of welds had the average P, S, N, and O levels in weight percent:

P = 0.0021%
S = 0.0035
N = 0.0017
O = 0.0009

Room temperature (+80°F), short-time tensile properties of welds of Table II produced by testing are shown in the following Table IV:

TABLE IV

RESULTS OF TENSILE TESTS

| Variable Element | Variable Element Check Analysis (wt. %) Wire | Weld | Identification Number Wire Heat | Weld | Stresses (psi) Prop. Limit | 0.2% Yield | 0.5% Yield | Ultimate |
|---|---|---|---|---|---|---|---|---|
| | 0.002 | 0.013 | 833 | 1058 | 84000 | 93000 | 96800 | 106400 |
| | 0.096* | 0.098* | 832* | 1057* | 129900 | 145700 | 151000 | 161800 |
| C | | | | | 150600 | 171400 | 181400 | 200200 |
| | 0.216 | 0.210 | 834 | 1061 | | | | |
| | | | | | 182150 | 201550 | 202550 | 202550 |
| | 0.216 | 0.205 | 834 | 1110 | 176400 | 189100 | 191800 | 202500 |
| | 0.006* | 0.045* | 832* | 1057* | 129900 | 145700 | 151000 | 161800 |
| Mn | 1.11 | 1.00 | 835 | 1060 | 140200 | 160200 | 168800 | 186600 |
| | 2.33 | 1.90 | 839 | 1063 | 126200 | 152200 | 165400 | 189800 |
| | 0.023* | 0.04* | 832* | 1057* | 129900 | 145700 | 151600 | 161800 |
| Si | 0.28 | 0.27 | 840 | 1064 | 128200 | 142200 | 147400 | 157600 |
| | 0.56 | 0.53 | 846 | 1095 | 131200 | 143200 | 149600 | 161800 |
| | 0.004 | 0.022 | 847 | 1096 | 130200 | 143400 | 146800 | 153400 |
| Cu | 0.96* | 0.89* | 832* | 1057* | 129900 | 145700 | 151000 | 161800 |
| | 1.96 | 1.81 | 852 | 1097 | 135600 | 152200 | 157600 | 163600 |
| | <0.02 | 0.56 | 836 | 1059 | 126200 | 143200 | 146800 | 154800 |
| Ni | 3.32* | 3.41* | 832* | 1057* | 129900 | 145700 | 151000 | 161800 |
| | 5.27 | 5.06 | 837 | 1062 | 132000 | 152400 | 160600 | 176400 |
| | <0.05 | 0.20 | 858 | 1103 | 140200 | 152600 | 156800 | 164200 |
| Cr | 0.72* | 0.83* | 832* | 1057* | 129900 | 145700 | 151000 | 161800 |
| | 1.44 | 1.51 | 859 | 1098 | 136200 | 154400 | 163600 | 178200 |
| | <0.04 | 0.07 | 863 | 1100 | 131600 | 143200 | 144500 | 154300 |
| Mo | 2.06* | 1.77* | 832* | 1057* | 129900 | 145700 | 151000 | 161800 |
| | 4.02 | 3.36 | 865 | 1101 | 127800 | 138200 | 142200 | 153600 |
| | <0.05 | 0.06 | 866 | 1102 | 140800 | 148800 | 151800 | 165600 |
| V | 0.50 | 0.46* | 832* | 1057* | 129900 | 145700 | 151000 | 161800 |
| | 1.04 | 0.85 | 867 | 1099 | 124200 | 132800 | 135600 | 143000 |
| | <0.03 | <0.03 | 870 | 1104 | 134200 | 150400 | 155200 | 163800 |
| W | 0.29* | 0.17* | 832* | 1057* | 129900 | 145700 | 151000 | 161800 |
| | 0.59 | 0.57 | 871 | 1105 | 147600 | 164600 | 170800 | 179800 |
| | <0.05 | 0.008 | 875 | 1106 | 140800 | 160800 | 166400 | 174200 |
| Co | 0.81* | 0.68* | 832* | 1057* | 129900 | 145700 | 151000 | 161800 |
| | 1.50 | 1.01 | 877 | 1107 | 126400 | 147800 | 156200 | 171600 |
| | AIM | | | | | | | |
| None | C 0.10 | Cr 0.70 | 572 | 597 | 137500 | 152300 | 157300 | 166750 |
| (= Ref | Mn 0.01 | Mo 2.00 | 639 | 677 | 128250 | 142300 | 145200 | 153300 |
| Comp) | Si 0.01 | V 0.50 | 832 | 1057 | 124000 | 142400 | 150600 | 165400 |
| | Cu 1.00 | W 0.36 | Av of 3 | Av of 3 | 129900 | 145700 | 151000 | 161800 |
| | Ni 3.22 | Co 0.78 | | | | | | |

Tensile Properties at +80°F

| Variable Element | True Fracture | Stress Ratios 0.2Y P.L | 0.5Y P.L | ULT P.L | TFS P.L | UTS 0.2Y | Ductilities (%) Uniform Elong. | Total Elong. | Area Reduction | Ductility Ratios T.E. U.E. | A.R. U.E. | A.R. T.E. |
|---|---|---|---|---|---|---|---|---|---|---|---|---|
| | 234000 | 1.107 | 1.152 | 1.267 | 2.786 | 1.144 | 5.55 | 21.10 | 80.10 | 3.80 | 14.43 | 3.80 |
| | 334600 | 1.122 | 1.162 | 1.246 | 2.576 | 1.111 | 5.49 | 20.65 | 76.35 | 3.76 | 13.91 | 3.70 |
| C | — | 1.138 | 1.205 | 1.329 | — | — | — | 3.45 | — | — | — | — |
| | 337800 | 1.107 | 1.112 | 1.112 | 1.855 | 1.005 | 1.00 | 13.50 | 65.90 | — | — | 3.89 |
| | 374000 | 1.072 | 1.087 | 1.148 | 2.120 | 1.071 | 5.80 | 21.40 | 70.10 | 3.69 | 12.09 | 3.28 |
| | 334600 | 1.122 | 1.162 | 1.246 | 2.576 | 1.111 | 5.49 | 20.65 | 76.35 | 3.76 | 13.91 | 3.70 |
| Mn | 374500 | 1.143 | 1.204 | 1.331 | 2.671 | 1.165 | 5.60 | 20.10 | 74.80 | 3.59 | 13.36 | 3.72 |
| | 319500 | 1.206 | 1.311 | 1.504 | 2.532 | 1.247 | 3.85 | 16.00 | 65.40 | 4.16 | 16.99 | 4.09 |
| | 334600 | 1.122 | 1.162 | 1.246 | 2.576 | 1.111 | 5.49 | 20.65 | 76.35 | 3.76 | 13.91 | 3.70 |
| Si | 340500 | 1.109 | 1.150 | 1.229 | 2.656 | 1.108 | 5.95 | 20.65 | 76.20 | 3.47 | 12.81 | 3.69 |
| | 303500 | 1.091 | 1.140 | 1.233 | 2.313 | 1.130 | 6.00 | 20.75 | 77.80 | 3.46 | 12.97 | 3.75 |
| | 329000 | 1.101 | 1.127 | 1.178 | 2.527 | 1.070 | 5.60 | 21.55 | 78.90 | 3.85 | 14.09 | 3.66 |
| Cu | 334600 | 1.122 | 1.162 | 1.246 | 2.576 | 1.111 | 5.49 | 20.65 | 76.35 | 3.76 | 13.91 | 3.70 |
| | 304000 | 1.122 | 1.162 | 1.206 | 2.242 | 1.075 | 5.25 | 19.75 | 71.60 | 3.76 | 13.64 | 3.63 |
| | 336000 | 1.135 | 1.163 | 1.227 | 2.662 | 1.081 | 5.80 | 21.00 | 77.80 | 3.62 | 13.41 | 3.70 |
| Ni | 334600 | 1.122 | 1.162 | 1.246 | 2.576 | 1.111 | 5.49 | 20.65 | 76.35 | 3.76 | 13.91 | 3.70 |
| | 351500 | 1.155 | 1.217 | 1.336 | 2.663 | 1.157 | 5.50 | 20.30 | 75.70 | 3.69 | 13.76 | 3.73 |
| | 336000 | 1.088 | 1.118 | 1.171 | 2.397 | 1.076 | 5.40 | 20.40 | 75.00 | 3.78 | 13.89 | 3.68 |
| Cr | 334600 | 1.122 | 1.162 | 1.246 | 2.576 | 1.111 | 5.49 | 20.65 | 76.35 | 3.76 | 13.91 | 3.70 |
| | 277200 | 1.134 | 1.201 | 1.308 | 2.035 | 1.154 | 4.95 | 13.55 | 53.60 | 2.74 | 10.83 | 3.96 |
| | 291000 | 1.088 | 1.098 | 1.172 | 2.211 | 1.078 | 6.40 | 20.90 | 71.80 | 3.22 | 11.22 | 3.44 |
| Mo | 334600 | 1.122 | 1.162 | 1.246 | 2.576 | 1.111 | 5.49 | 20.65 | 76.35 | 3.76 | 13.91 | 3.70 |
| | 285200 | 1.081 | 1.113 | 1.202 | 2.232 | 1.111 | 5.00 | 18.15 | 71.60 | 3.63 | 14.32 | 3.94 |
| | 331000 | 1.057 | 1.078 | 1.176 | 2.351 | 1.113 | 7.15 | 21.55 | 72.80 | 3.01 | 10.18 | 3.38 |
| V | 334600 | 1.122 | 1.162 | 1.246 | 2.576 | 1.111 | 5.49 | 20.65 | 76.35 | 3.76 | 13.91 | 3.70 |
| | 298000 | 1.069 | 1.092 | 1.151 | 2.399 | 1.077 | 4.25 | 18.80 | 77.80 | 4.42 | 18.31 | 4.14 |
| | 339500 | 1.121 | 1.156 | 1.221 | 2.530 | 1.089 | 5.30 | 20.10 | 75.00 | 3.79 | 14.15 | 3.73 |
| W | 334600 | 1.122 | 1.162 | 1.246 | 2.576 | 1.111 | 5.49 | 20.65 | 76.35 | 3.76 | 13.91 | 3.70 |
| | 335200 | 1.115 | 1.157 | 1.218 | 2.271 | 1.092 | 4.65 | 18.75 | 71.60 | 4.03 | 15.40 | 3.82 |
| | 357000 | 1.142 | 1.182 | 1.237 | 2.536 | 1.083 | 4.85 | 19.10 | 75.90 | 3.94 | 15.65 | 3.97 |
| Co | 334600 | 1.122 | 1.162 | 1.246 | 2.576 | 1.111 | 5.49 | 20.65 | 76.35 | 3.76 | 13.91 | 3.70 |
| | 305000 | 1.169 | 1.236 | 1.358 | 2.413 | 1.161 | 4.75 | 16.80 | 66.90 | 3.54 | 14.08 | 3.98 |
| | Avg = | 1.117 | 1.158 | 1.242 | 2.422 | 1.109 | — | — | — | 3.68 | 13.80 | 3.75 |
| None | 352300 | 1.108 | 1.144 | 1.213 | 2.562 | 1.095 | 5.38 | 20.85 | 78.60 | 3.88 | 14.61 | 3.77 |
| (=Ref | 340000 | 1.110 | 1.132 | 1.195 | 2.651 | 1.077 | 6.00 | 22.50 | 79.15 | 3.75 | 13.19 | 3.52 |

TABLE IV-continued

| Variable Element | True Fracture | Tensile Properties at +80°F Stress Ratios 0.2Y P.L | 0.5Y P.L | ULT P.L | TFS P.L | UTS 0.2Y | Ductilities (%) Uniform Elong. | Total Elong. | Area Reduction | Ductility Ratios T.E. U.E. | A.R. U.E. | A.R. T.E. |
|---|---|---|---|---|---|---|---|---|---|---|---|---|
| Comp) | 311500 | 1.147 | 1.215 | 1.334 | 2.512 | 1.162 | 5.10 | 18.60 | 71.30 | 3.65 | 13.98 | 3.83 |
| | 334600 | 1.122 | 1.164 | 1.247 | 2.575 | 1.111 | 5.49 | 20.65 | 76.35 | 3.76 | 13.93 | 3.71 |

(Compositions and properties for reference heat are repeated in each 3-heat series and the values listed are the average of the three reference heats made and tested to date, see lower line.

The impact data is shown in the following Table IVA:

TABLE IVA

| Variable Element | Variable Element Check Analysis (wt.%) Wire | Weld | Identification Number Wire Heat | Weld | Rupture Energy, ft-lbs Test Temperature, °F −320 | −200 | −140 | −60 | 0 | +80 | +200 |
|---|---|---|---|---|---|---|---|---|---|---|---|
| | 0.002 | 0.013 | 833 | 1058 | | 136.0 | 143.0 | 179.0 | — | 210.5 | — |
| | | | | 1108 | 3.0 | 34 & 9.5 9.5 | 131.0 | — | — | 163.0 | 178.0 |
| C | 0.096* | 0.098* | 832* | 1057* | | 20.0 | 30.0 | 112.0 | 140.0 | 166.0 | 194.0 |
| | 0.216 | 0.210 | 834 | 1061 | | 8.0 | 18.5 | 38.5 | — | 67.0 | — |
| | 0.216 | 0.205 | 834 | 1110 | | — | — | — | 60.0 | 87.5 | 86.5 |
| | 0.006* | 0.045* | 832* | 1057* 1060& | | 20.0 | 30.0 | 112.0 | 140.0 | 166.0 | 194.0 |
| Mn | 1.11 | 1.00 | 835 | 1139 | 9.0 | 17.0 | 32.0 | 55.0 | — | 139.0 | 156.0 |
| | 2.33 | 1.90 | 839 | 1063 | | 15.5 | 22.0 | 27.5 | — | 87.0 | — |
| | 0.23* | 0.04* | 832* | 1057* | | 20.0 | 30.0 | 112.0 | 140.0 | 166.0 | 194.0 |
| Si | 0.28 | 0.27 | 840 | 1064 | | 57.5 | 51.0 | 72.0 | — | 206.0 | — |
| | 0.56 | 0.53 | 846 | 1095 | | 19.0 | 33.0 | 71.0 | 148.5 | 153.5 | 162.0 |
| | 0.004 | 0.022 | 847 | 1096 | | 67.0 | 119.0 | 197.0 | 179.0 | 239.0 | 204.0 |
| Cu | 0.96* | 0.89* | 832* | 1057* | | 20.0 | 30.0 | 112.0 | 140.0 | 166.0 | 194.0 |
| | 1.96 | 1.81 | 852 | 1097 | | 21.0 | 20.0 | 120.0 | 139.0 | 169.0 | 173.5 |
| | <0.02 | 0.56 | 836 | 1059 | | — | — | 12.0 | 61.5 | 188.5 | 203.0 |
| Ni | 3.32* | 3.41* | 832* | 1057* | | 20.0 | 30.0 | 112.0 | 140.0 | 166.0 | 194.0 |
| | 5.27 | 5.06 | 837 | 1062 | | 73.0 | 55.5 | 176.0 | — | 157.5 | — |
| | <0.05 | 0.20 | 858 | 1103 | | 19.5 | 35.5 | 124.0 | 155.0 | 171.0 | 159.0 |
| Cr | 0.72* | 0.83* | 832* | 1057* | | 20.0 | 30.0 | 112.0 | 140.0 | 166.0 | 194.0 |
| | 1.44 | 1.51 | 859 | 1098 | | 12.0 | 29.0 | 33.5 | 99.0 | 173.0 | 167.5 |
| | <0.04 | 0.07 | 863 | 1100 | | 23.5 | 70.0 | 122.0 | 156.0 | 156.5 | 164.5 |
| Mo | 2.06* | 1.77* | 832 | 1057* | | 20.0 | 30.0 | 112.0 | 140.0 | 166.0 | 194.0 |
| | 4.02 | 3.36 | 865 | 1101 | | 29.0 | 43.5 | 73.0 | 133.0 | 113.0 | 132.0 |
| | <0.05 | 0.06 | 866 | 1102 | | 80.0 | 117.0 | 181.0 | 198.0 | 191.5 | 191.5 |
| V | 0.50* | 0.46* | 832* | 1057* | | 20.0 | 30.0 | 112.0 | 140.0 | 166.0 | 194.0 |
| | 1.04 | 0.85 | 867 | 1099 | | 41.0 | 113.5 | 174.0 | 180.0 | 188.0 | 196.5 |
| | <0.03 | <0.03 | 870 | 1104 | | 20.0 | 56.0 | 162.0 | 185.0 | 167.0 | 194.0 |
| W | 0.29* | 0.17* | 832* | 1057* | | 20.0 | 30.0 | 112.0 | 140.0 | 166.0 | 194.0 |
| | 0.59 | 0.57 | 871 | 1105 | | 14.0 | 23.0 | 39.0 | 59.5 | 132.0 | 142.0 |
| | <0.05 | 0.008 | 875 | 1106 | | 26.5 | 90.0 | 153.5 | 151.5 | 173.5 | 193.5 |
| Co | 0.81* | 0.68* | 832* | 1057* | | 20.0 | 30.0 | 112.0 | 140.0 | 166.0 | 194.0 |
| | 1.50 | 1.01 | 877 | 1107 | | 8.0 | 13.0 | 90.0 | 105.0 | 167.0 | 173.0 |
| | AIM | | | | | | | | | | |
| None | C = 0.10 | Cr = 0.70 | 572 | 597 | | 36.0 | — | 180.0 | — | 200.0 | 222.0 |
| (=Ref | Mn= 0.01 | Mo = 2.00 | 639 | 677 | | 5.5 | — | — | 200.0 | 183.5 | 167.0 |
| Comp) | Si= 0.01 | V = 0.50 | 832 | 1057 | | 18.5 | 30.0 | 34.0 | — | 116.5 | — |
| | Cu= 1.00 | W = 0.36 | Av of 3 | Av of 3= | | 20.0 | 30.0 | 107.0 | 200.0 | 166.7 | 194.5 |
| | Ni= 3.22 | Co = 0.78 | | | | | | | | | |
| | | | | | | −120 | −100 | −80 | −40 | | |
| | | | 572 | 597 | | 40.5 | 153.5 | 153.0 | 189.0 | | |
| | | | 639 | 677 | | — | — | 42.0 | 58.0 | | |
| | | | 832 | 1057 | | — | — | — | — | | |
| | | | Av of 3 | Av of 3= | | 40.5 | 153.5 | 97.5 | 123.5 | | |

| Variable Element | Brittle Fracture, % Test Temperature, °F −320 | −200 | −140 | −60 | 0 | +80 | +200 | lateral Expansion, Ins. Test Temperature, °F −320 | −200 | −140 | −60 | 0 | +80 | +200 |
|---|---|---|---|---|---|---|---|---|---|---|---|---|---|---|
| | | 40 | 20 | 0 | | 0 | — | | .090 | .096 | >.10 | | >.10 | — |
| | 100 | 90 | 35 | | | 0 | 0 | .003 | .022 | .082 | | | .100 | .099 |
| C | | | | | | | | | | | | | | |
| | | 95 | 95 | 75 | | 10 | | | .0015 | .009 | .017 | | .032 | |
| | | | | | 10 | 0 | 0 | | | | | .030 | .047 | 0.046 |
| Mn | 100 | 100 | 95 | 60 | — | 0 | 0 | .004 | .0085 | .018 | .031 | | .077 | .080 |
| | | 100 | 100 | 95 | — | 5 | — | | .006 | .007 | .015 | | 0.045 | |
| Si | | 95 | 95 | 85 | — | 0 | — | | .037 | .027 | .039 | | >.10 | |
| | | 98 | 95 | 90 | 15 | 10 | 0 | | .010 | .015 | .041 | .078 | .084 | .094 |
| | | 90 | 70 | 10 | 0 | 0 | 0 | | .038 | .061 | .097 | .091 | >.10 | .098 |
| | | 95 | 85 | 35 | 15 | 0 | 0 | | .011 | .011 | .062 | .072 | .085 | .083 |
| | | | | 100 | 80 | 0 | 0 | | | | .008 | .035 | >.10 | .093 |
| Ni | | | | | | | | | | | | | | |
| | | 70 | 30 | 0 | | 0 | | | | | | | | |
| | | 98 | 90 | 0 | 0 | 0 | 0 | | .012 | .016 | .063 | .081 | .085 | .080 |
| Cr | | | | | | | | | | | | | | |

TABLE IVA-continued

| Variable Element | Brittle Fracture, % Test Temperature, °F −320 | −200 | −140 | −60 | 0 | +80 | +200 | lateral Expansion, Ins. Test Temperature, °F −320 | −200 | −140 | −60 | 0 | +80 | +200 |
|---|---|---|---|---|---|---|---|---|---|---|---|---|---|---|
| | | 100 | 95 | 98 | 15 | 5 | 0 | | .018 | .012 | .016 | .051 | .074 | .082 |
| | | 90 | 60 | 20 | 0 | 0 | 0 | | 0.10 | .037 | .065 | .074 | .083 | .086 |
| Mo | | | | | | | | | | | | | | |
| | | 95 | 80 | 40 | 0 | 0 | 0 | | .015 | .020 | .044 | .080 | .062 | .078 |
| | | 85 | 30 | 0 | 0 | 0 | 0 | | .035 | .050 | .084 | .089 | .084 | .093 |
| V | | | | | | | | | | | | | | |
| | | 95 | 65 | 0 | 0 | 0 | 0 | | .025 | .067 | .071 | .097 | .095 | .094 |
| | | 98 | 85 | 5 | 0 | 0 | 0 | | .006 | .024 | 0.74 | .076 | .081 | .087 |
| W | | | | | | | | | | | | | | |
| | | 95 | 90 | 25 | 20 | 0 | 0 | | .009 | .018 | .024 | .038 | .067 | .065 |
| | | 95 | 80 | 0 | 0 | 0 | 0 | | .008 | .040 | .076 | .076 | .086 | .086 |
| Co | | | | | | | | | | | | | | |
| | | 100 | 100 | 65 | 20 | 0 | 0 | | .003 | .003 | .050 | .053 | .078 | .080 |
| None (=Ref Comp) | | 98 | 95 | 95 | | 10 | | | .012 | .018 | .020 | | .063 | |

Note:
Compositions and Properties for Reference Heat are Repeated In Each 3-Heat Series and the Values Listed are the Averages of the three Reference Heats as Tabulated Hereon and as Considered Most Nearly Accurately Representative in FIG. 25

The proportional limit values varied from 84,000 psi (low C, weld 1058) up to 176,400 psi (high C, weld 1110). Short-time tensile tests (750% strain per hour) were made at 1050°F for only two of these welds (Nos. 1110, 0.210 and 1109, 1.0Mn). The properties obtained and the corresponding values for the room temperature tests for welds 1110 and 1111 are tabulated in Table V below:

TABLE V

| Property | Weld 1110 (0.201% C) +80°F | +1050°F | 1050/80 | Weld 1109 (1.0 Mn) +80°F | +1050°F | 1050/80 | Av. Ratios |
|---|---|---|---|---|---|---|---|
| Prop.Lim.(psi) | 163,500 | 109,400 | 0.67 | 140,200 | 96,000 | 0.68 | 0.68 |
| 0.2% Yield | 180,250 | 127,800 | 0.71 | 160,200 | 106,800 | 0.67 | 0.69 |
| 0.5% Yield | 186,600 | 133,800 | 0.72 | 168,800 | 111,800 | 0.66 | 0.69 |
| Ultimate | 202,525 | 136,600 | 0.67 | 186,600 | 117,400 | 0.63 | 0.65 |
| Fracture | 374,000 | 208,500 | 0.56 | 374,500 | 192,000 | 0.51 | 0.54 |
| Unif.Elong.(%) | 5.80 | 2.10 | 0.36 | 5.60 | 2.15 | 0.38 | 0.37 |
| Total El. | 19.18 | 16.15 | 0.84 | 20.10 | 15.25 | 0.76 | 0.80 |
| Area Red. | 69.0 | 64.70 | 0.94 | 74.80 | 70.10 | 0.94 | 0.94 |

The creep data based on tests at 1050°F is shown in the following Table VI:

TABLE VI

| Spec No. | Alloy Variation | Static Stress (psi) | Load Time (Hrs) | % Strain in time Period | Min Creep Rate %/Hr) | Elongation % | Area Reduction % | Time To 0.5% Strain % | Hardness Change (DPH) | Total Ton-Hrs to Rupture |
|---|---|---|---|---|---|---|---|---|---|---|
| 1057-3 | Ref | 20,000 | 522 | 1.37 | 0.0016 | | | | | |
| | Comp | 25,000 | 504 | 1.47 | 0.0029 | | | | | |
| | | 30,000 | 311 | 12.0 | 0.012 | 15.3 | 25.3 | 35 | −117 | 1618 |
| 1058-3 | Lo C | 15,000 | 691 | 31.0 | 0.020 | 30.8 | 56.6 | 25 | −46 | 518 |
| 1061-3 | Hi C | 20,000 | 500 | 1.0 | 0.00072 | | | | | |
| | | 25,000 | 504 | 0.6 | 0.00084 | | | | | |
| | | 30,000 | 504 | 1.5 | 0.00250 | | | | | |
| | | 35,000 | 32N<br>217* | 2.0 | 0.00810 | | | | | |
| | | 30,000 | 546 | 7.7 | 0.00610 | 12.8 | 27.8 | 10 | −33 | 3141 |
| 1060-3 | 1.0Mn | 20,000 | 572 | 12.9 | 0.00750 | 11.3 | 22.0 | 30 | −133 | 572 |
| 1063-3 | 2.0Mn | 20,000 | 594 | 3.0 | 0.00450 | | | 35. | | |
| | | 25,000 | 353 | 27.2 | 0.02700 | 29.9 | 53.5 | 13. | −135 | 1035 |
| 1064-3 | 0.25 Si | 20,000 | 524 | 1.27 | 0.00180 | | | | | |
| | | 25,000 | 504 | 1.57 | 0.00280 | | | | | |
| | | 30,000 | 576 | 24.9 | 0.01200 | 27.9 | 73.2 | 21. | −98 | 2018 |
| 1095-3 | 0.50 Si | 20,000 | 522 | 1.2 | 0.00120 | | | | | |
| | | 25,000 | 1022** | 3.8 | 0.00290 | | | | | |
| | | 30,000 | 316 | 25.8 | 0.01800 | 29.7 | 62.7 | 28. | −119 | 2274 |
| 1096-3 | Lo Cu | 20,000 | 498 | 1.53 | 0.00270 | | | | | |
| | | 25,000 | ~503 | 33.1 | 0.01300 | 35.3 | 89.4 | 35. | −140 | 1127 |
| 1097-3 | Hi Cu | 20,000 | 498 | 1.2 | 0.00160 | | | | | |
| | | 25,000 | 504 | 1.9 | 0.00350 | | | | | |
| | | 30,000 | 270 | 14.4 | 0.01500 | 18.3 | 43.5 | 35. | −117 | 1533 |
| 1059-3 | Lo Ni | 20,000 | 502 | 0.60 | 0.00062 | | | | | |
| | | 25,000 | 500 | 0.60 | 0.00098 | | | | | |
| | | 30,000 | 575 | 1.60 | 0.00270 | | | | | |
| | | 35,000 | 189 | 20.2 | 0.01900 | 23.8 | 75.1 | 10. | −120 | 2320 |
| 1062-3 | Hi Ni | 20,000 | 238N | 21.2 | 0.02000 | 18.1 | 20.0 | 17. | −115 | 238 |
| 1103-3 | Lo Cr | 20,000 | 503 | 1.4 | 0.00082 | | | | | |
| | | 25,000 | 649 | 2.2 | 0.00410 | | | | | |
| | | 30,000 | 286 | 21.4 | 0.02100 | 26.2 | 52.0 | 21. | −112 | 1743 |
| 1098-3 | Hi Cr | 20,000 | 499 | 1.88 | 0.00250 | | | | | |
| | | 25,000 | 556 | 18.4 | 0.00970 | 20.2 | 44.0 | 30. | −143 | 1194 |

TABLE VI-continued

| Spec No. | Alloy Variation | Static Stress (psi) | Load Time (Hrs) | % Strain in time Period | Min Creep Rate %/ Hr) | Elongation % | Area Reduction % | Time To 0.5% Strain % | Hardness Change (DPH) | Total Ton-Hrs to Rupture |
|---|---|---|---|---|---|---|---|---|---|---|
| 1100-3 | Lo Mo | 20,000 | 669 | 6.0 | 0.00450 | 8.8 | 14.5 | 40 | −98 | 669 |
| 1101-3 | Hi Mo | 20,000 | 439 | 50.0 | 0.02200 | 48.1 | 61.6 | 10. | −148 | 439 |
| 1102-3 | Lo V | 20,000 | 407*** | 21.7 | 0.01200 | 20.7 | 26.3 | 30. | −110 | 407 |
| 1099-3 | Hi V | 20,000 | 501 | 0.41 | 0.00013 | | | | | |
| | | 25,000 | 501 | 0.25 | 0.00027 | | | | | |
| | | 30,000 | 506 | 0.46 | 0.00053 | | | | | 3188 |
| | | 35,000 | 742 | 11.7 | 0.00330 | 13.7 | 49.0 | 135 | −112 | |
| 1104-3 | Lo W | 20,000 | 503 | 2.2 | 0.00390 | | | | | |
| | | 25,000 | 383 | 32.5 | 0.01900 | 35.3 | 76.7 | 30. | −140 | 982 |
| 1105-3 | Hi W | 20,000 | 500 | 2.1 | 0.00410 | | | | | |
| | | 25,000 | 288 | 19.5 | 0.01900 | 20.0 | 35.8 | 16. | −154 | 860 |
| 1106-3 | Lo Co | 20,000 | 1226 | 35.8 | 0.00780 | 34.6 | 53.3 | 40. | −139 | 1226 |
| 1107-3 | Hi Co | 20,000 | 502 | 1.0 | 0.00110 | | | | | |
| | | 25,000 | 501 | 1.3 | 0.00250 | | | | | |
| | | 30,000 | 414 | 29.0 | 0.01200 | 32.0 | 71.6 | 42. | −108 | 1753 |

Figure 4:
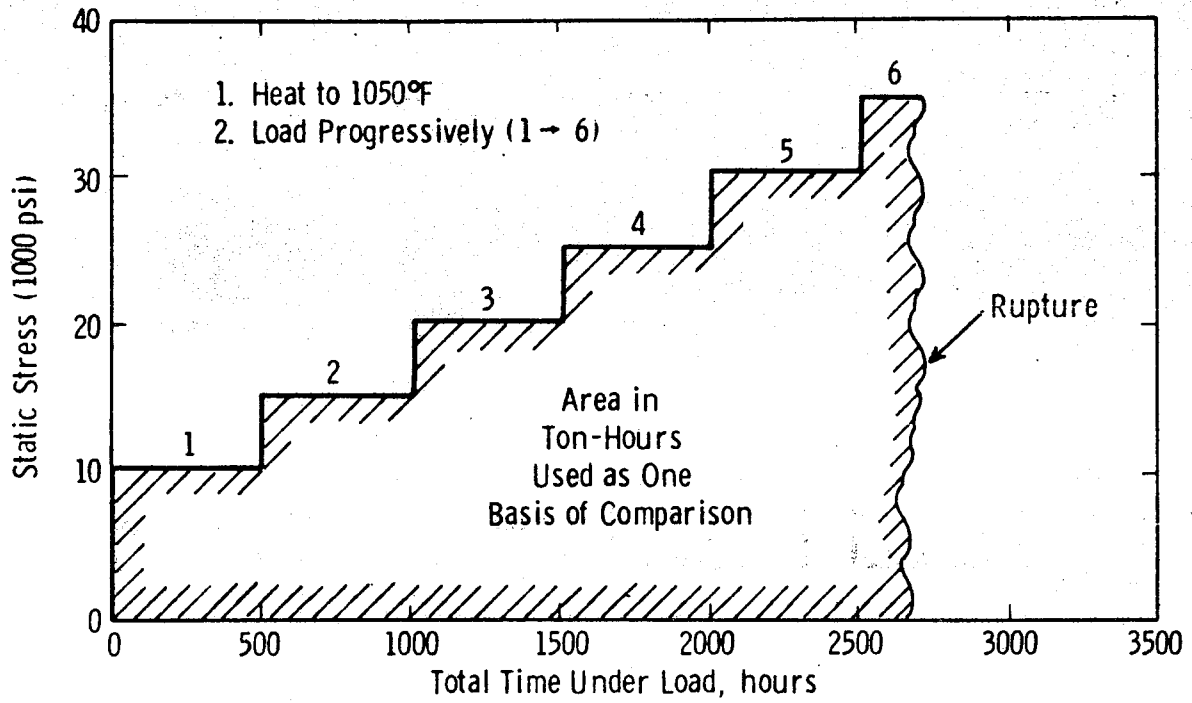
FIG. 4 is a graph showing a procedure for producing an accelerated creep test

*Holder failed after 217 hrs and 35,000 psi
**Failed in notch after 499 hr; 1022 includes this time period
***Failed in notch after 314 hrs; 407 includes this time period In measuring creep the load was progressively increased in increments until rupture occurred. The mode of loading is shown in FIG. 4 in which the static load in 1000 psi is plotted vertically and the time of loading horizontally. The actual loading is shown in Table VI.

As shown in Table VI the loading started with 20,000 pounds per square inch (psi) and increased in increments of 5000 psi, except in the case of the low carbon (.013) weld metal which was loaded only at 15,000 psi. In each case the specimen was loaded at 20,000 psi for the time indicated (522 hr. for reference compositions), then the loading was increased to 25,000 psi for the time indicated (504 hr), then to 30,000 or higher until failure occurred (311 hr). The smooth-bar specimen was also notched at one end, and sometimes failed in the notch. When this happended the specimen was rethreaded and the test continued as indicated in the footnotes. The one exception was the "high " (5.06%) nickel content weld, which was so badly cracked in the smooth-bar region when it failed in the notch that there was no reason for continuing the test. Failure in a notch is also indicated by an N following a number of hours.

After rupture, all specimens reported on in Table VI were acid pickled and brushed to remove most of the 1050°F test oxidization products. Following that cleaning operation, all specimens were examined under an 30 binocular microscope over 360°, i.e., around the full circumference. The results of those observations are tabulated in the following Table VII.

TABLE VII

| Nominal Composition Variable | Test Mark | Location of Failure Nearest End: | Notch | Secondary Transverse Cracking Smooth Bar Portion Notched End Shoulder | Notched End Cylinder | Unnotched End Cylinder | Unnotched End Shoulder |
|---|---|---|---|---|---|---|---|
| Ref | 1057-3 | Smooth | Cracked | None | Few Sm | Small | None |
| Low C | 1058-3 | Notched | Cracked | None | One | None | None |
| Hi C | 1061-3 | Notched | Complete | Few | Numer-ous | Several | Few |
| 1.0 Mn | 1060-3 | Smooth | Cracked | Lg Crack | Several | Several | None |
| 2.0 Mn | 1063-3 | Smooth | Cracked | None | Few | Few | None |
| .25 Si | 1064-3 | Smooth | Cracked | None | Few | Several | None |
| .50 Si | 1095-3 | Notched | Complete | None | Few | Few | Small |
| Lo Cu | 1096-3 | Center | Small Cr | Small | None | None | None |
| Hi Cu | 1097-3 | Smooth | Si Cr | None | Few Sm | Few | None |
| Lo Ni | 1059-3 | Smooth | None | None | Numer-ous | Few | None |
| Hi Ni | 1062-3 | Notch | Complete | Small | Large | Many | Small |
| Lo Cr | 1103-3 | | Smooth (specimen lost after taking recheck millings) | | | | |
| Hi Cr | 1098-3 | Notch | — | None | Several | Several | None |
| Lo Mo | 1100-3 | Center | None | None | Numer-ous | Several | None |
| Hi Mo | 1101-3 | Notch | Sm Cr | None | None | None | None |
| Lo V | 1102-3 | Notch | Complete | None | Numer-ous | Numer-ous | None |
| Hi V | 1099-3 | Smooth | None | None | None | None | None |
| Lo W | 1104-3 | Notch | Cracked | None | None | None | None |
| Hi W | 1105-3 | Notch | Cracked | None | Numer-ous | Numer-ous | Crack |
| Lo Co | 1006-3 | Notch | Cracked | Crack | Numer-ous | Numer-ous | Crack |
| Hi Co | 1107-3 | Smooth | None | None | None | None | None |

Only four of the 21 weld specimens failed completely in the notch. These were the "high" (0.201%) carbon, the "high" (0.53%) silicon, the "high" (5.06%) nickel, and the "low" (0.061%) vanadium welds, Table VII. Table VII lists four welds which were completely free of X30 observed cracks at the notch roots. These are tabulated in Table XIII:

TABLE VIII

| Weld | Variable | Max. Stress | Load Resistance (Ton-Hr) |
|---|---|---|---|
| 1099-3 | High (0.85) V | 35,000 | 3188 |
| 1059-3 | Low (0.56) Ni | 35,000 | 2319 |
| 1107-3 | High (1.01) Co | 30,000 | 1753 |
| 1100-3 | Low (0.07) Mo | 20,000 | 699 |

More detailed examination revealed that only three of these four welds were completely free of microcracks, on one randomly selected longitudinal section. These were the 0.85 V, the 1.01 Co, and the 0.07 Mo welds. The 0.56 Ni weld, was found to contain incipient cracking, readily visible at X100. No cracking was observed at a magnification of X100 on the other three welds in this group.

Fourteen specimens, which did not fail in the notch were nevertheless cracked in the notch-root region, (Table VII). The cracks are generally intergranular, i.e., interdendritic, and are usually more extensive in the coarse-grained regions than in the fine-grained regions of the welds.

Absence of cracking at the notch root, therefore, is not conclusive proof of a superior weld. It may only indicate that the metal was so weak that notch root cracking and ultimate rupture would not occur until after the bulk of the metal had already failed. However, absence of such root cracking in a strong weld which withstood loading for a long time period is desirable. It is indicative of resistance to extension of local cracks or weld flaws.

The time-strain values observed are recorded in the following Table IX.

TABLE IX

| Spec Mark | Static Stress (psi) | Hr Time to Strain 0.5% | 1.0% | 3.0% | Transition Strain % | Hr | Alloy |
|---|---|---|---|---|---|---|---|
| 1099 | 35,000 | 135 | 302 | 612 | 1.8 | 559 | Hi V |
| 1059 | 35,000 | 10 | 35 | 107 | 2.1 | 85 | Lo Ni |
| 1107 | 30,000 | 42 | 82 | 231 | 2.8 | 221 | Hi Co |
| 1057 | 30,000 | 35 | 75 | 170 | 1.5 | 100 | Ref |
| 1097 | 30,000 | 35 | 70 | 155 | 1.5 | 95 | Hi Cu |
| 1095 | 30,000 | 28 | 55 | 142 | 1.7 | 90 | 0.5 Si |
| 1064 | 30,000 | 21 | 61 | 235 | 4.3 | 320 | 0.25 Si |
| 1103 | 30,000 | 21 | 37 | 127 | 3.1 | 132 | Lo Cr |
| 1061 | 30,000 | 10 | 111 | 368 | 2.3 | 318 | Hi C |
| 1096 | 25,000 | 35 | 75 | 207 | 3.6 | 242 | Lo Cu |
| 1098 | 25,000 | 30 | 72 | 240 | 3.8 | 290 | Hi Cr |
| 1104 | 25,000 | 30 | 70 | 161 | 3.6 | 181 | Lo W |
| 1105 | 25,000 | 10 | 45 | 130 | 2.2 | 100 | Hi W |
| 1063 | 25,000 | 13 | 30 | 105 | 4.0 | 130 | 1.9 Mn |
| 1100 | 20,000 | 40 | 160 | 583 | 2.3 | 512 | Lo Mo |
| 1106 | 20,000 | 40 | 120 | 423 | 4.6 | 596 | Lo Co |
| 1063 | 20,000 | 35 | 150 | 574 | — | — | 1.9 Mn |
| 1060 | 20,000 | 30 | 100 | 310 | 3.0 | 310 | 1.0 Mn |
| 1102 | 20,000 | 30 | 80 | 175 | 2.0 | 129 | Lo V |
| 1062 | 20,000 | 17 | 41 | 120 | 2.6 | 110 | Hi Ni |
| 1101 | 20,000 | 10 | 32 | 100 | 2.4 | 84 | Hi Mo |

TABLE IX-continued

| Spec Mark | Static Stress (psi) | Hr Time to Strain 0.5% | 1.0% | 3.0% | Transition Strain % | Hr | Alloy |
|---|---|---|---|---|---|---|---|
| 1058 | 15,000 | 25 | 97 | 150 | 6.1 | 292 | Lo C |

At the stress levels for which data are available, the relative rankings of the alloys with the higher creep resistant above the lower are as shown in the following Table X:

TABLE X

| Strain Order (Least to Most) at Five Stress Levels | | | | |
|---|---|---|---|---|
| 35,000 psi | 30,000 psi | 25,000 psi | 20,000 psi | 15,000 psi |
| 1. 1099(Hi V) | 1. 1061(Hi C) | 1. 1098(Hi Cr) | 1. 1100(Lo Mo) | 1. 1058 (Lo C) |
| 2. 1059(Lo Ni) | 2. 1064(.25 Si) | 2. 1096(Lo Cu) | 2. 1063(1.9 Mn)* | |
| | 3. 1107(Hi Co) | 3. 1104(Lo W) | 3. 1106(Lo Co) | |
| | 4. 1057(Ref.) | 4. 1105(Hi W) | 4. 1060(1.0 Mn) | |
| | 5. 1097(Hi Cu) | 5. 1063(1.9 Mn) | 5. 1102(Lo V) | |
| | 6. 1095(.53 Si) | | 6. 1062(Hi Ni) | |
| | 7. 1103(Lo Cr) | | 7. 1101(Hi Mo) | |

*Did not break in 500 hr.

Only two specimens withstood loading to 35,000 psi stress. These were the "high" (0.85%) V and the "low" (0.56%) Ni variations. The amount of strain for the high V weld was superior to the low nickel content weld; i.e., it was less in a given time under the same load.

Seven of the 21 welds withstood 30,000 psi stress levels before failure. The high carbon content weld was superior to all the others in this group, with the 0.25 Si and the 1.01 Co welds being next in order. All three of these welds were superior to the "reference" composition, indicating that further additions of C, Si, and Co are beneficial.

Five of the 21 welds withstood only 25,000 psi stress. In this group, the high (1.51%) Cr and the low (0.02%) Cu exhibited the lowest strain rates.

Six of the 21 welds withstood only 20,000 psi stress. Of these the low (0.07%) Mo and the 1.9% Mn weld had the lowest strain rates.

Only the low (0.013%) C weld withstood only 15,000 psi stress. While this weld was ductile, it was too weak to withstand higher stresses.

This portion of the data indicates a preference for the use of higher C, V and Co with the addition of at least 0.25% Si to provide the highest strength, low strain rate welds. Low (<0.5%) Ni and intermediate (2.0%) Mo contents are also preferred, since those conditions provided means of reaching the higher strength levels.

Figure 5:
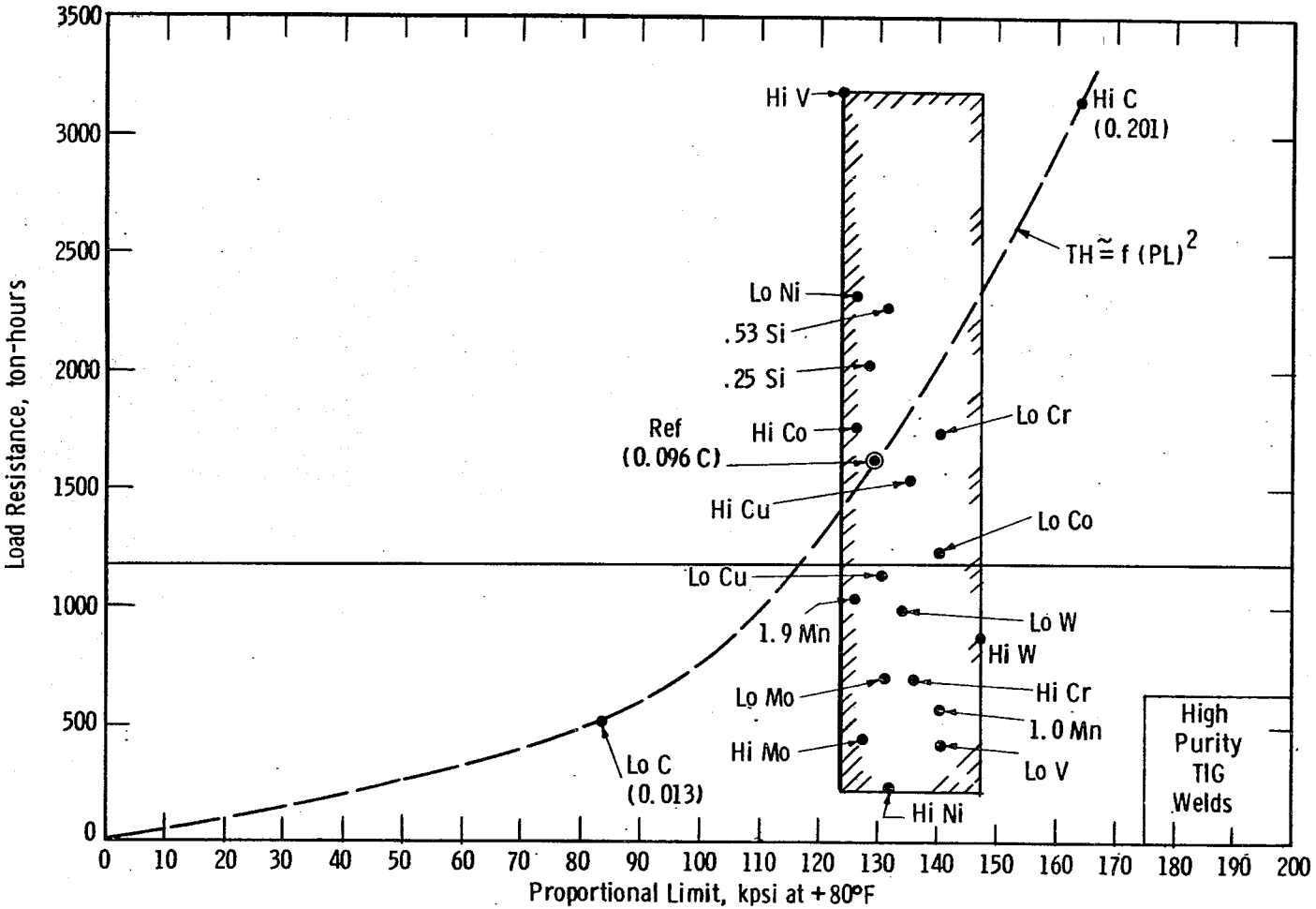
FIG. 5 is a graph showing the relationship between the creep properties at a high temperature and the tensile properties at normal temperature (80°F) for ferrous TIG weld metal having various alloy compositions; from this Figure may be determined the alloying components which are desirable or undesirable in achieving high creep resistance accompanied by high tensile strength.

The static ton-hour load resistances are related to the room temperature proportional limits, obtained from the short-time tensile test (Table IV) in FIG. 5. In FIG. 5 load-time in ton-hours at 1050°F is plotted vertically and proportional limit horizontally. The loading is the force applied to the specimen and is determined by multiplying the strength in Table VI by the cross-sectional area of the specimen. The load-time products at 1050°F increased approximately as the second power of the short-time (+80°F) proportion limit values for the carbon variable series only. All of the points except Lo C and the Hi C points are within the long narrow rectangle which reveals graphically that the proportional limits of most of the alloys fell within narrow limits while the creep properties at 1050°F varied over a wide range. For 18 welds the +80°F proportional limits ranged only from 124,000 to 147,500 psi, while the creep varied from about 200 ton-hours to 3200 ton-hours. Typically, the high and the low vanadium-content welds were not much dissimilar in short-time tensile strength at +80°F (about 122,000 and 140,000 psi) but had wide variations in 1050°F load-time product resistance (400 and 3200 TH). This comment applies even better to the low and high nickel variations.

Figure 6:
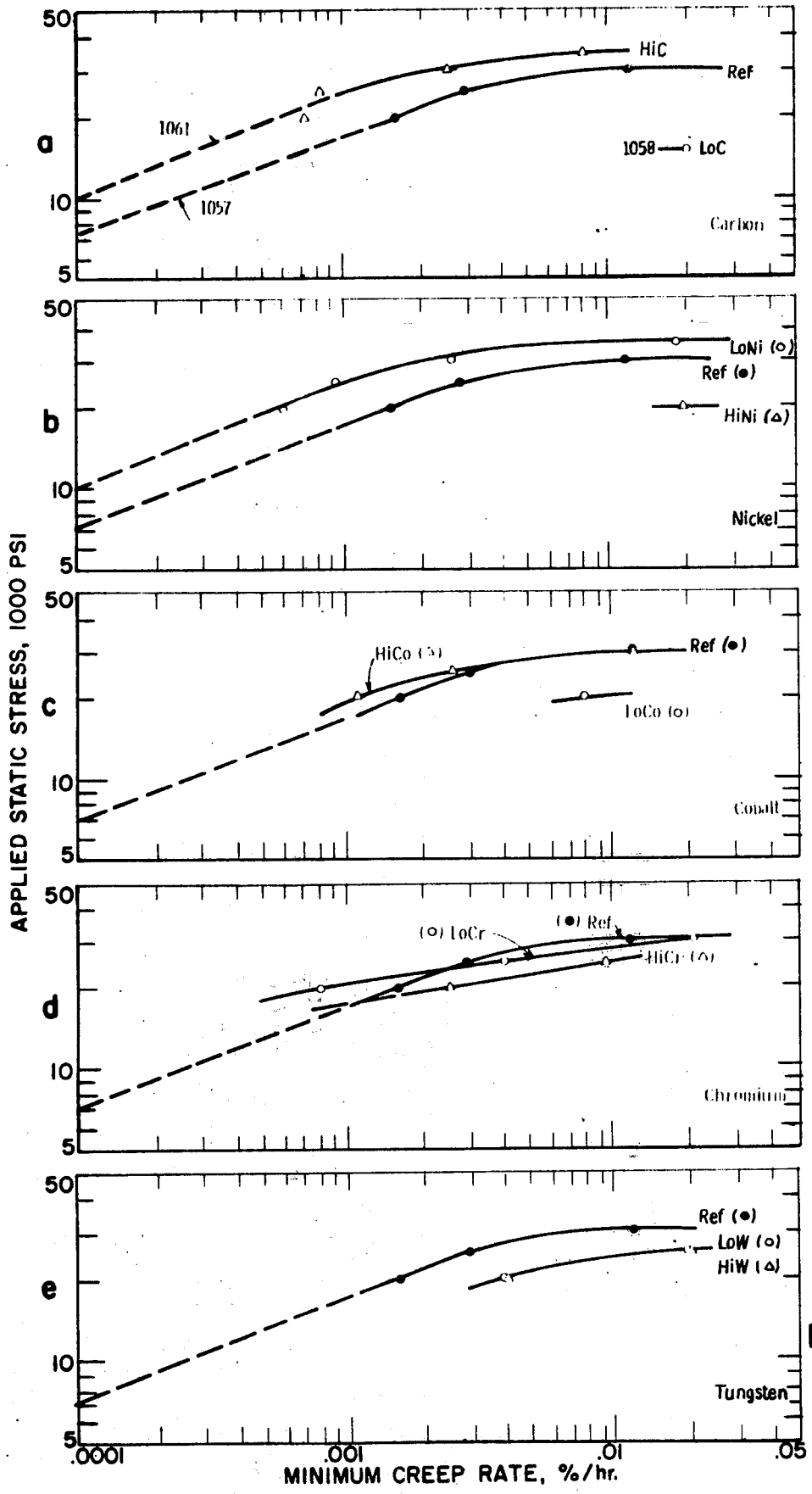
FIGS. 6(*a* ) through (*j*) are a series of graphs showing the influence of stress level and various alloying components on the minimum creep rate of TIG weld metal at high temperatures.
Figure 6:
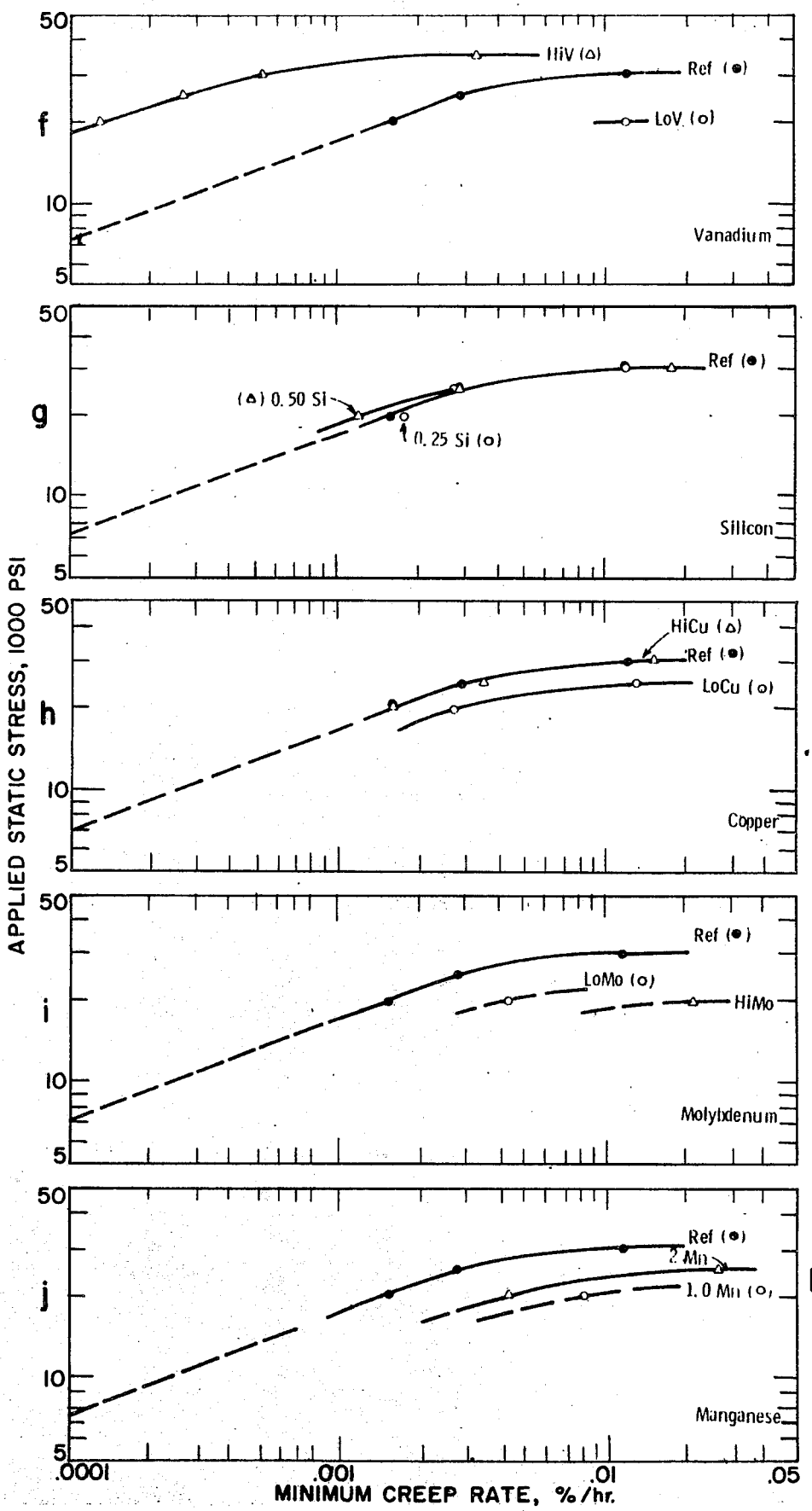

In each of the eight graphs of FIGS. 6(*a*) through (*j*) static stress is plotted vertically and minimum creep rate horizontally for the eight alloying elements of the alloys under consideration. The element corresponding to a curve is indicated on the graph. Separate curves are presented for the reference alloy, for the alloy with high content of the element and for the alloy with low content of the element. For example FIG. 6(*a*) has curves Hi C, Ref. and Lo C.

Figure 7:
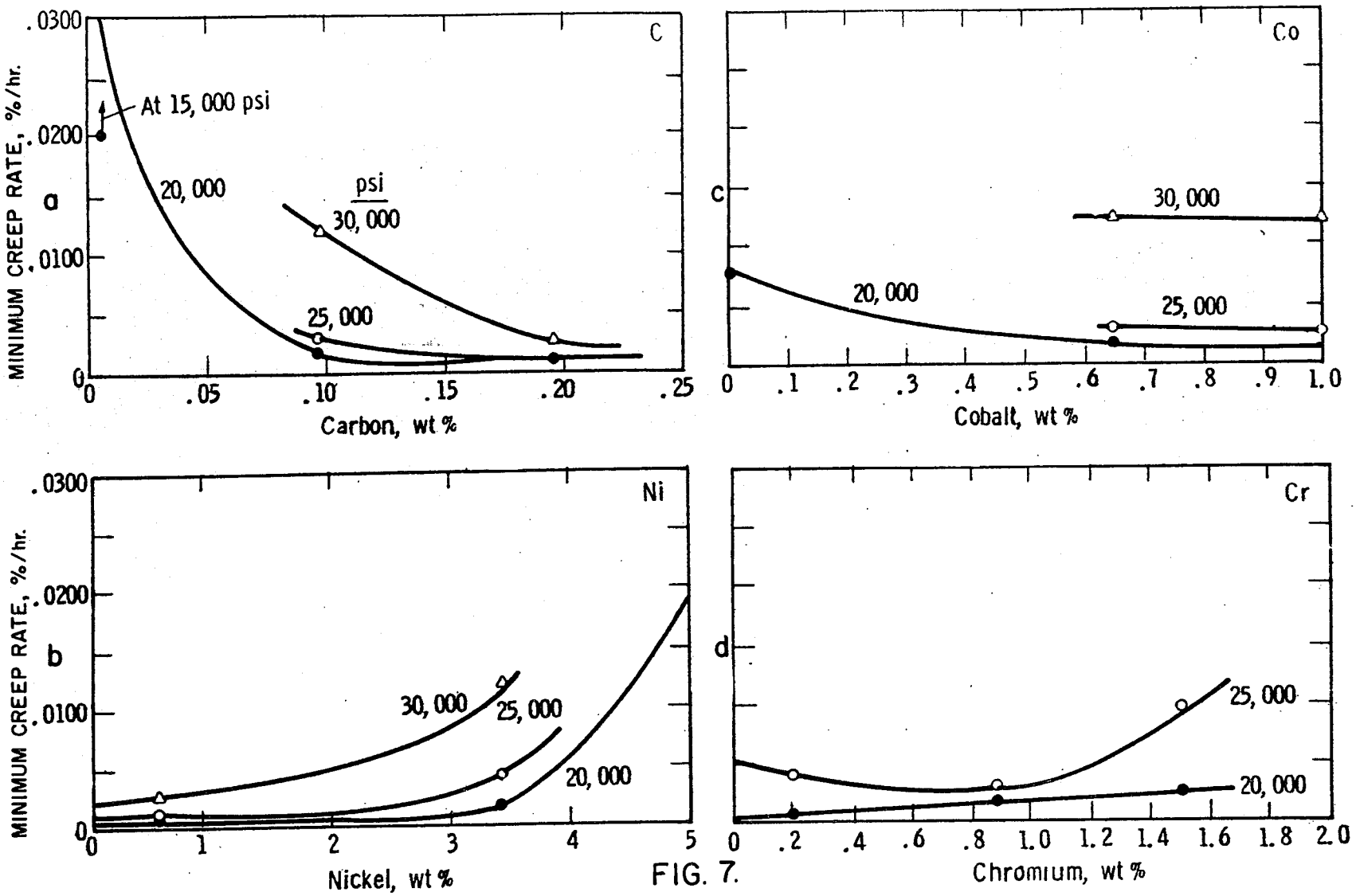
FIGS. 7(*a*) through (*j*) are a series of graphs showing the influence of changes in the content of various alloying elements on the minimum creep rate of TIG weld metal at high temperatures.
Figure 7:
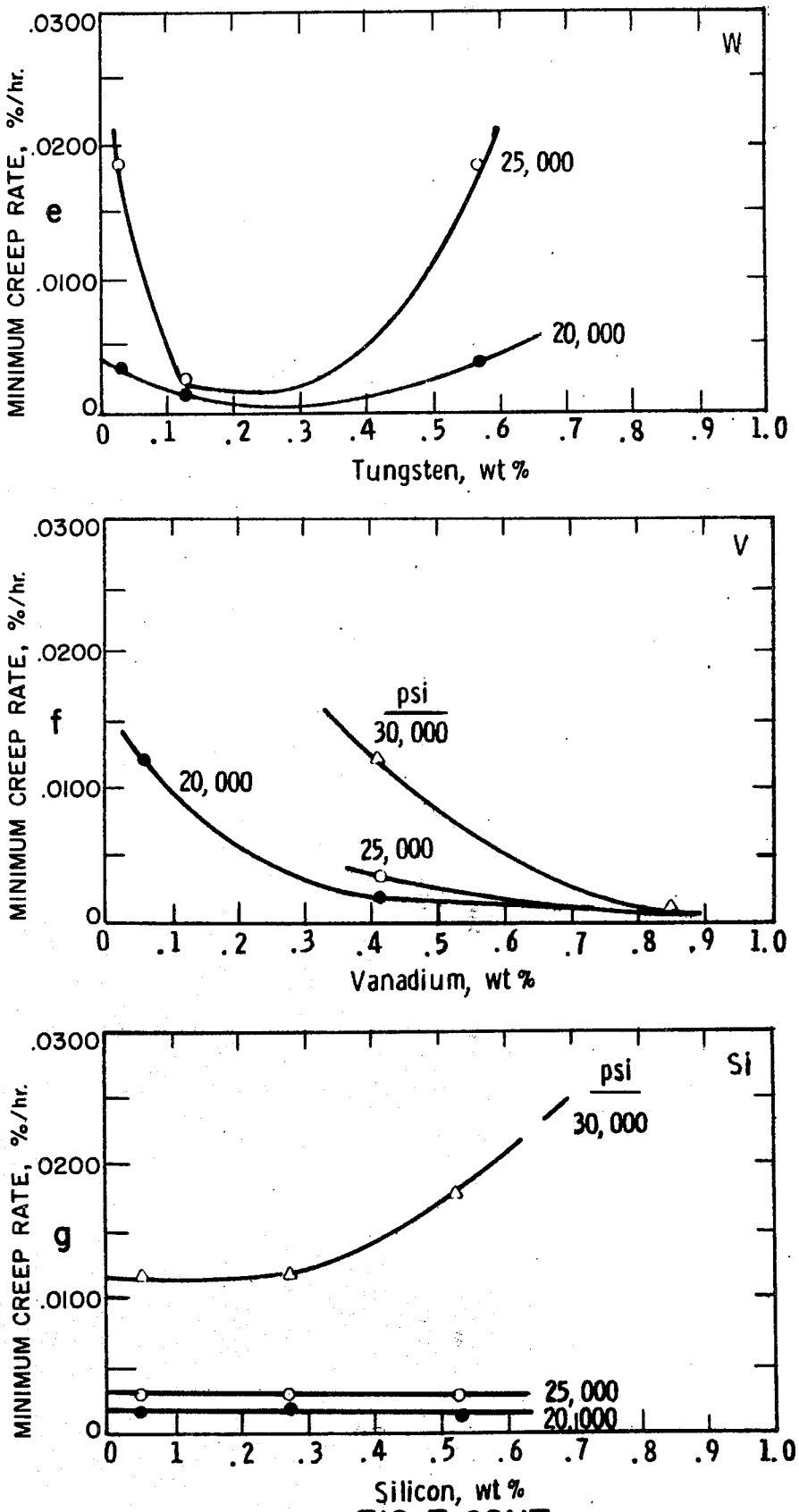
Figure 7:
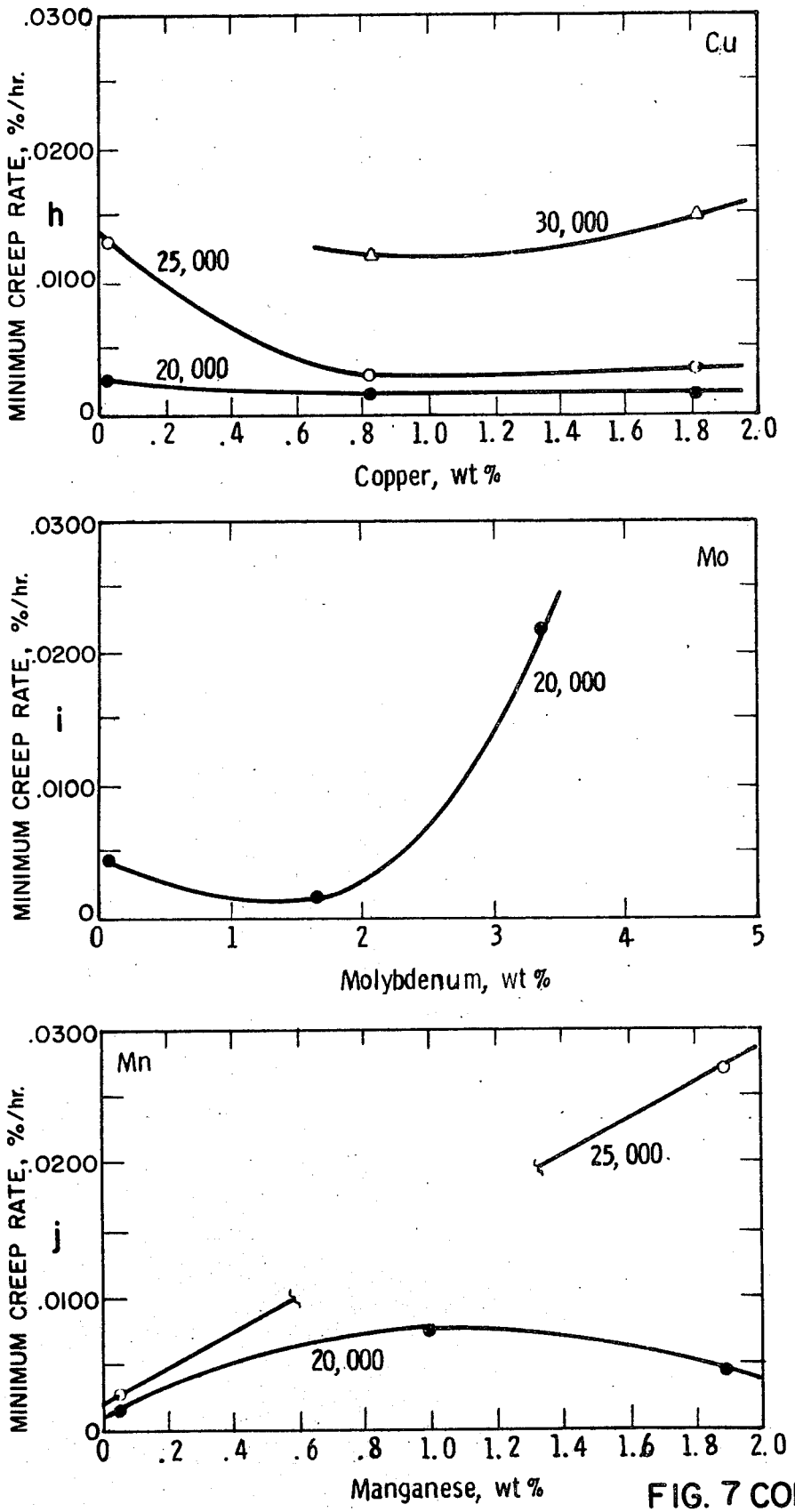

In each of the eight graphs of FIGS. 7(*a*) through (*j*) minimum creep rate is plotted vertically and content of the element is plotted horizontally for the eight elements. Separate curves are presented for stresses of 20,000; 25,000; and 30,000.

Figure 8:
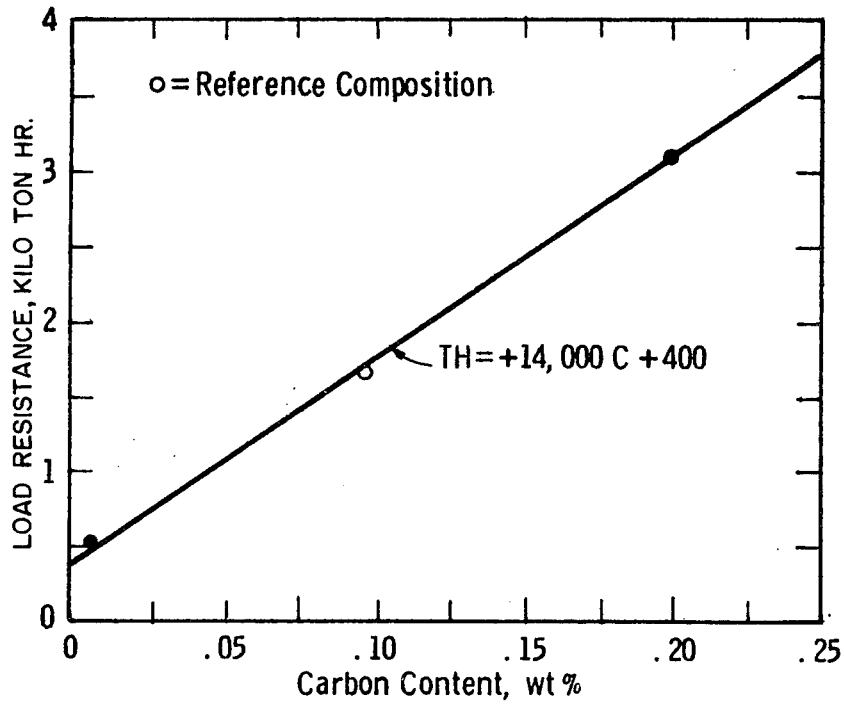
FIGS. 8(*a*) through (*j*) are a series of graphs showing the influence of changes in the content of various alloying elements on the load resistance to creep of TIG weld metal at high temperature.
Figure 8:
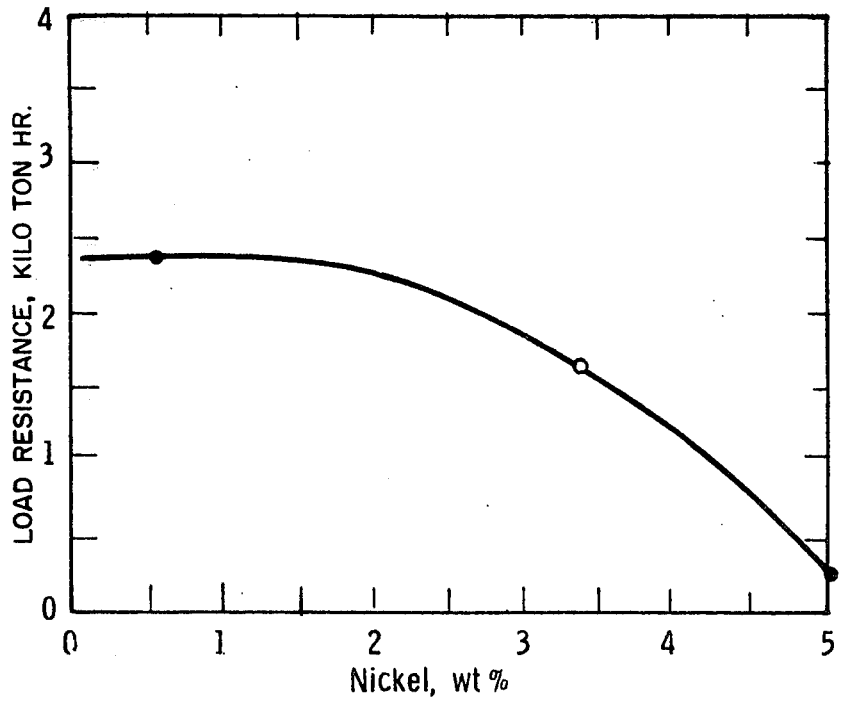
Figure 8:
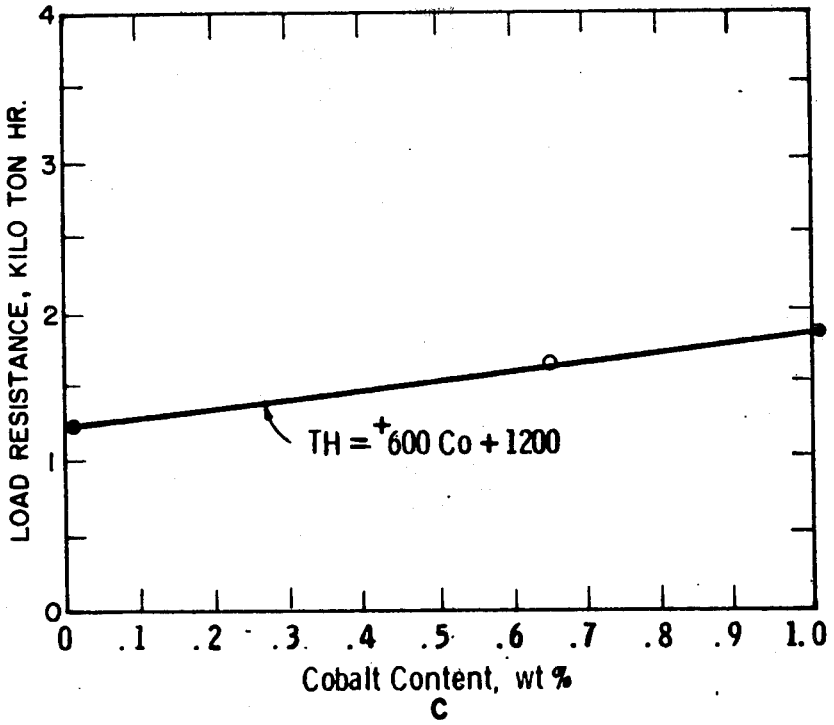
Figure 8:
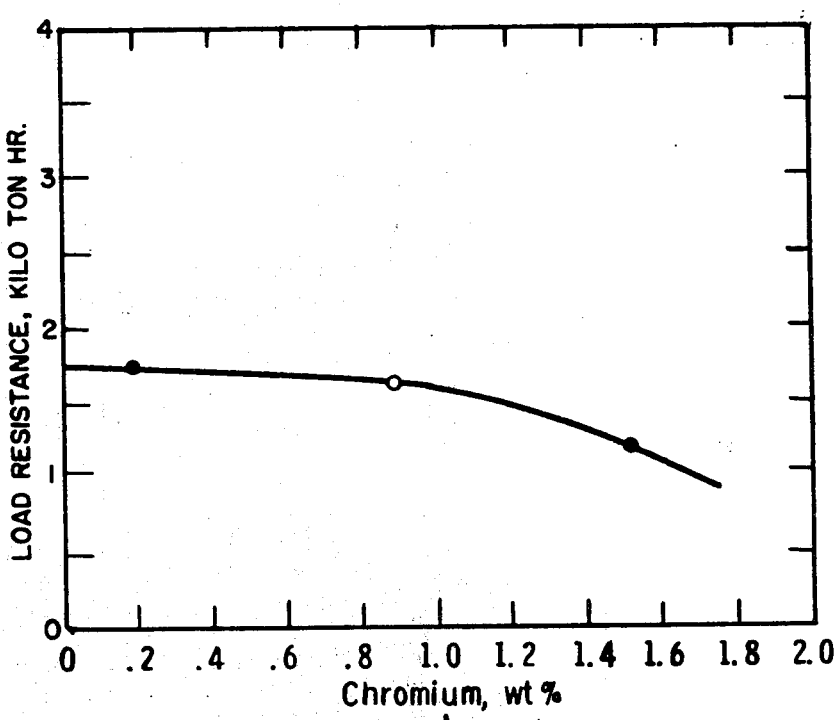
Figure 8:
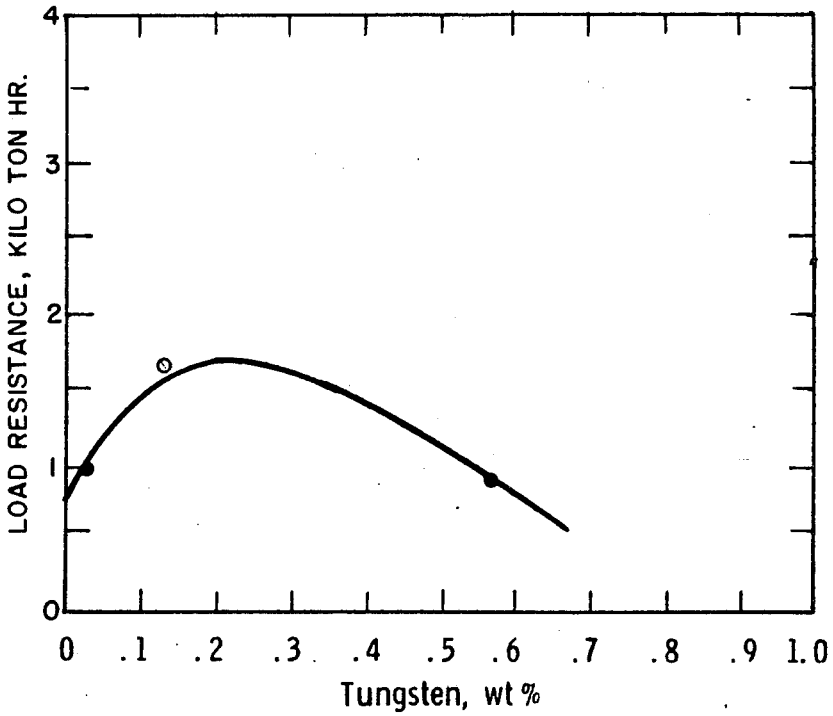
Figure 8:
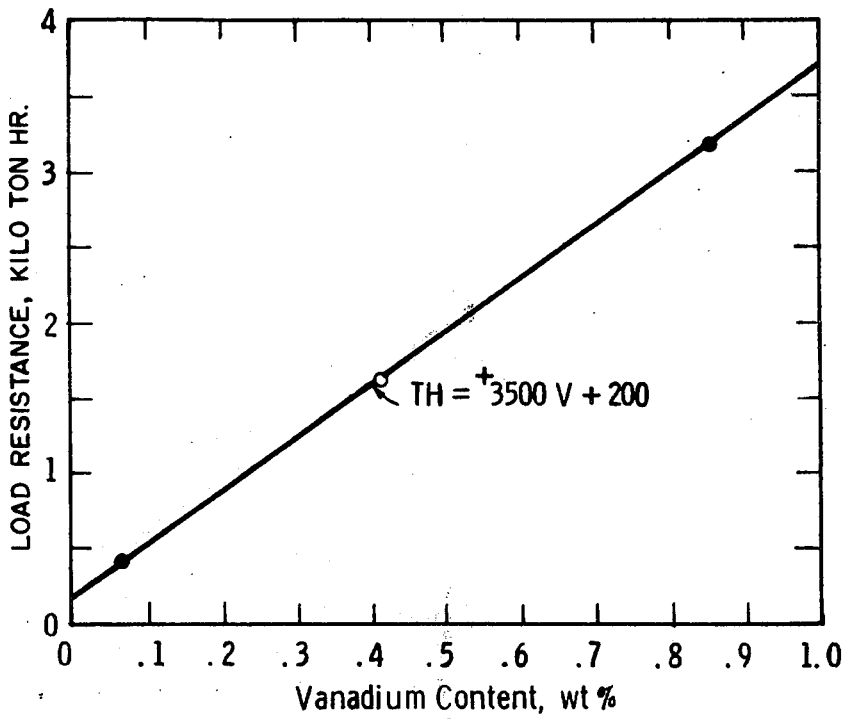
Figure 8:
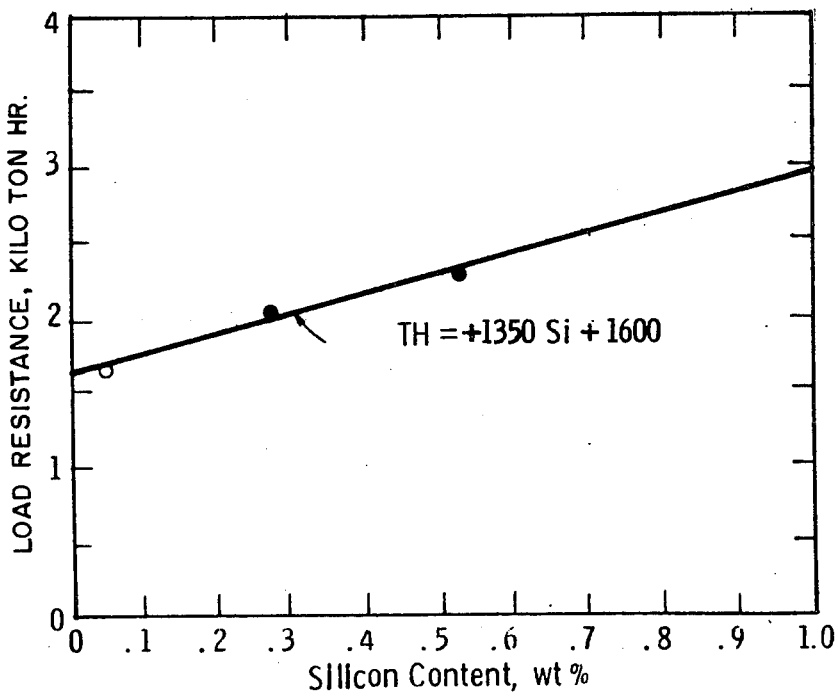
Figure 8:
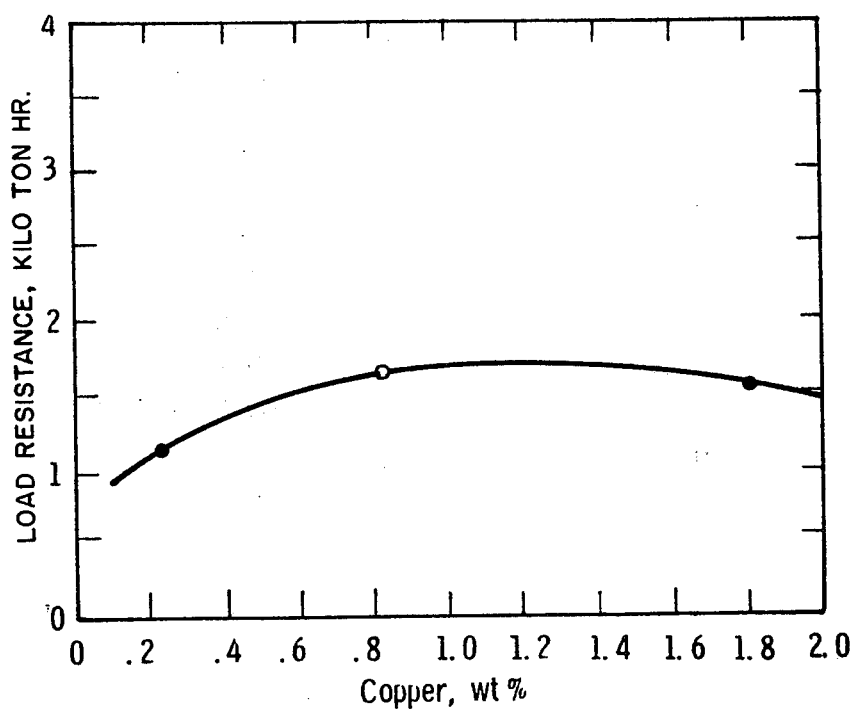
Figure 8:
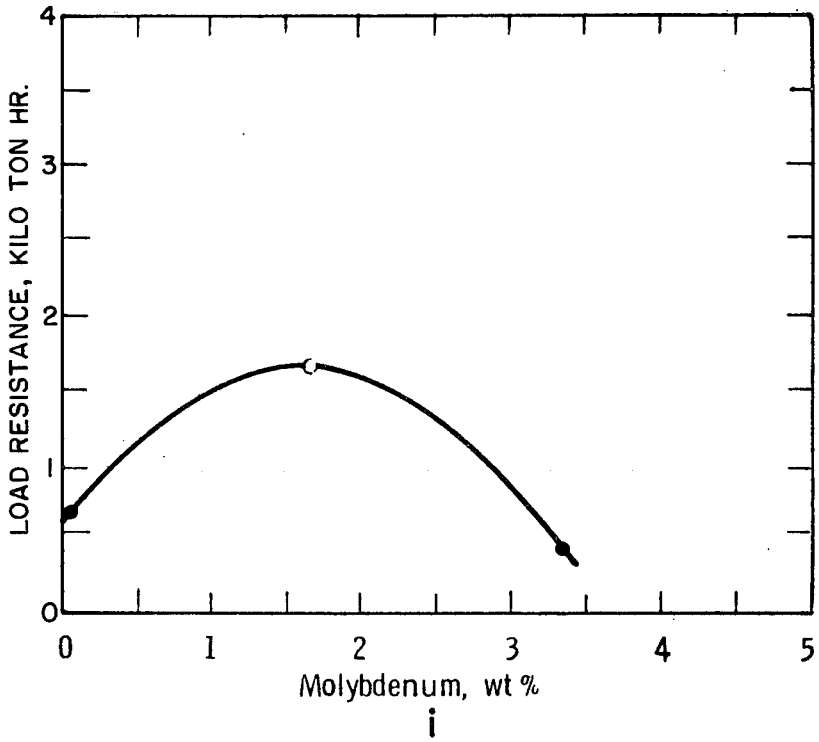
Figure 8:
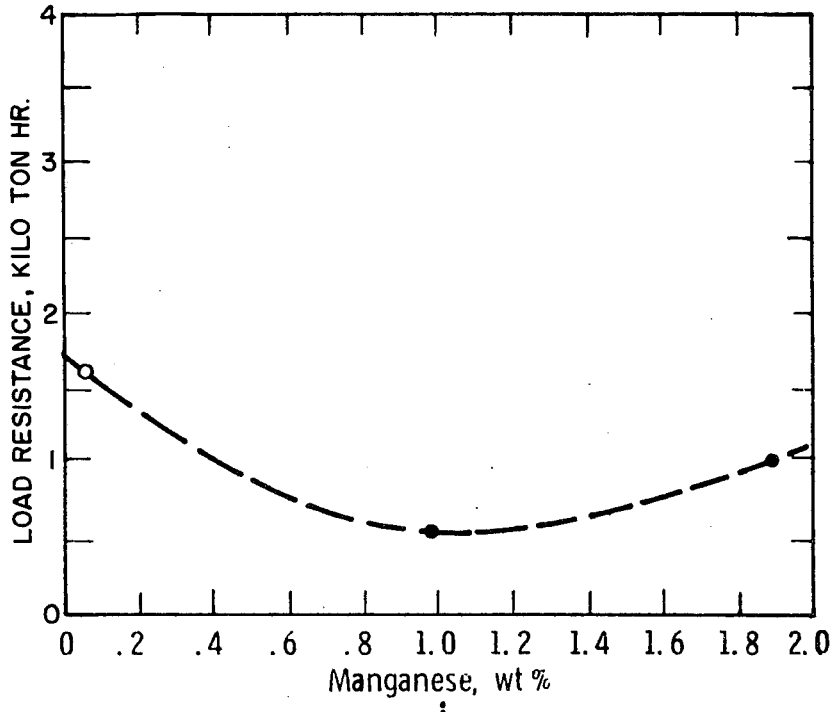

In each of the eight graphs of FIGS. 8(*a*) through (*j*) load resistance in ton-hours (TH) in kiloton hours is plotted vertically and content of the element is plotted horizontally for the eight elements. The curves for carbon, vanadium, silicon and cobalt are linear, the equations being shown adjacent the curves.

The high C, high V, and low Ni content welds had the lower minimum creep rates, FIGS. 6*a*, 6*f* and 6*b*. Conversely, the low C, low V, and high Ni content welds had highest creep rates. Since low minimum creep rates are desirable, this is a clear indication that, in the ideal weld, the nickel content should be as low as practicable and the V and C contents should be optimized at their respective best higher values, FIGS. 6*a* through 8*j*.

The influence of each of the ten individual alloying elements studied upon minimum creep rate and upon load-time product resistance are summarized in FIGS. 7(*a*) through (*j*) and 8(*a*) through (*j*). These are presented in the following Table XA:

TABLE XA

| Effect Of Increasing Element | On Minimum Creep Rate | On Load-Time Product Resistance |
|---|---|---|
| Carbon | Decreases | Increases, strongly |
| Vanadium | Decreases | Increases, strongly |
| Silicon | Neutral to increasing | Increases, slightly |
| Cobalt | Decreases | Increases, slightly |
| Copper | Decreases then increases | Increases then decreases |
| Molybdenum | Increases | Increases then decreases |
| Tungsten | Decreases then increases | Increases then decreases |
| Nickel | Increases | Decreases |
| Chromium | Increases | Decreases |
| Manganese | Increases | Decreases |

Since the tests were not exhaustive, Table XA indicates trends rather than categorical conditions.

Thus, presence of some silicon is not detrimental to creep rate, FIG. 7(*g*), and may be slightly beneficial, up to 0.53%. The notch sensitivity is then increased. The load-time product to rupture was progressively increased by silicon additions, FIG. 8(*g*).

Both additions of manganese to the reference composition level increased the creep rate, FIG. 7(*j*), and decreased the load-time products, FIG. 8(*j*). This observation is particularly interesting since the original basis for achieving ultra-tough weld metals also required the near absence of manganese. (References 6 and 7.) Both observations imply that the absence, or near absence, of manganese, and probably silicon, tend to minimize temper embrittlement.

Increasing the C, V, and Co contents, within the limits studied, is beneficial with respect to increasing creep resistance. Increasing the cobalt content above the 0.65% reference amount is slightly beneficial up to the 1.01% studied. Elimination of cobalt increases the creep rate and also increases the susceptibility to cracking.

The usual individual element effect is reversed for the minimun creep rates and the load-time product resistances. This is encouraging because the industrial objective is to obtain the lowest possible creep rates while securing maximum stress-time product resistance. The data obtained indicate that these objectives can best be achieved by using higher C, V, and Co contents and content of Si which is lower than usually encountered, while eliminating Ni and Mn and while using intermediate levels of Cr, Cu, Mo, and W. While Si may improve creep resistance somewhat, it reduces toughness.

Copper additions above 0.82% (up to 1.81%) are not harmful, FIGS. 7(*h*) and 8(*h*). However, the deletion of all copper is harmful.

FIG. 7(*d*) indicates that the creep rate passes through a minimum for chromium at 25,000 psi; this appears to be contradicted by the 20,000 psi curve which is linear with positive slope. The composition of the "high" and "low" specimens were reanalyzed and confirmed by analysis. It is believed that the contradiction arises from the grain structure of the "low" chromium specimen.

The measured percent "total elongation" for each individual specimen (Column 7, Table VI) is about the same as the sum of the several increments of observed strain at each load level (Column 5, Table VI). Individual variations exist, but, on the whole, they average out to being the same.

The percent area reduction, as an average, was 2.05 times the total elongation values. Highest values of ductility (elongation>25% and area reduction>50%) were obtained from the welds including 0.25 and 0.53% silicon, from the welds wherein the C, Co, Cr, Cu, Ni, and W were on the low side, and from the welds in which the Co and Mo were on the high side. The 1.9% Mn content weld also exhibited high ductility.

Figure 9:
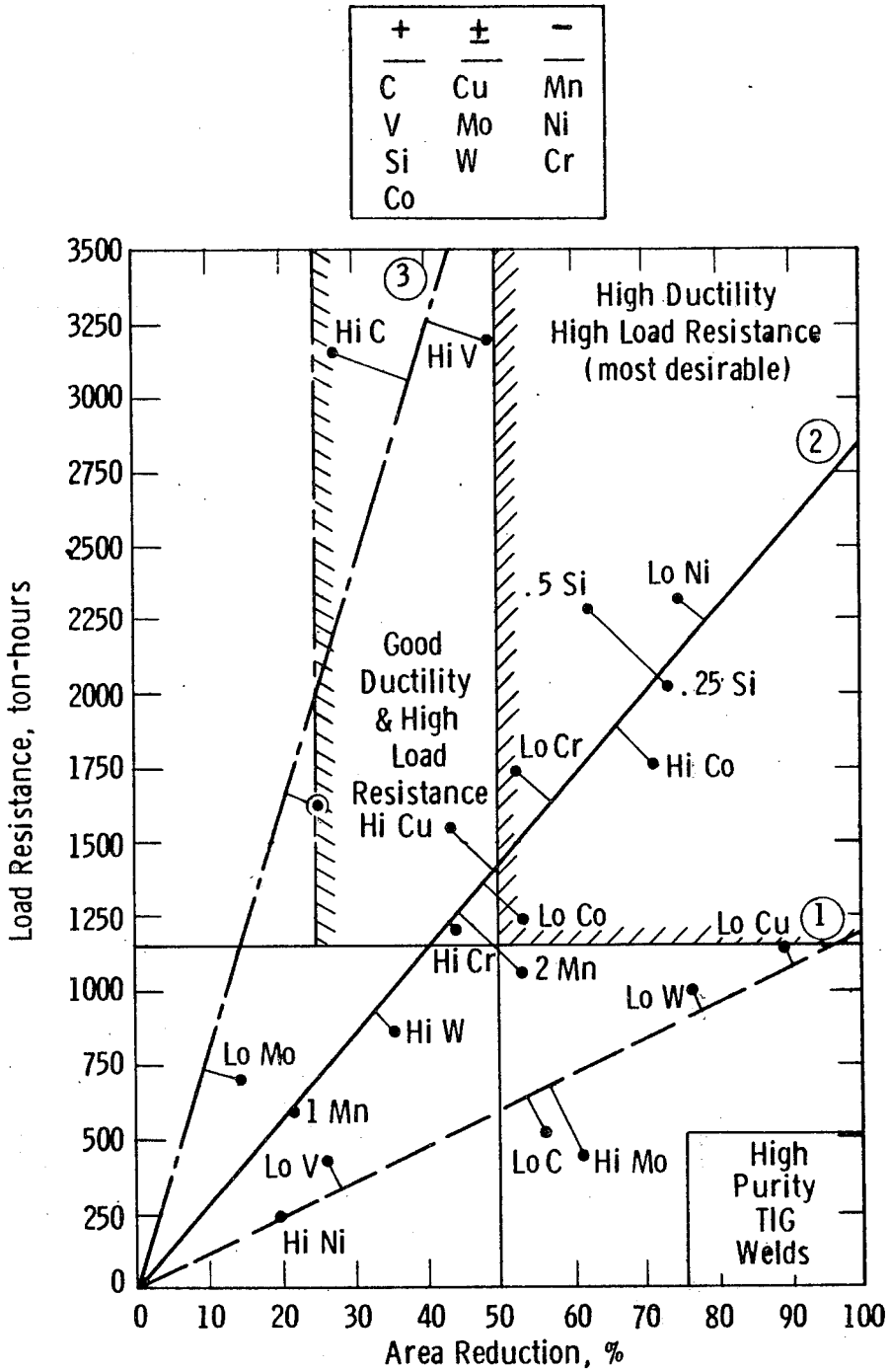
FIG. 9 is a graph showing the correlation of ductibility and high creep resistance of TIG weld metal with various alloying components at high temperature.

Having demonstrated that the load-time products of this series of welds were not related to room temperature strength, (FIG. 5), it is relevant to inquire if they were related to the 1050°F ductility in the creep tests. A general positive relationship appears to exist, with a strong secondary influence from the alloying elements being present. This can be understood from FIG. 9 in which loading as load resistance in TH is plotted vertically and area reduction horizontally. Load-time products increase with ductility. This increase is a minimum for the group of six welds which contained minimum levels of vanadium, carbon, tungsten, and copper and maximum levels of nickel and molybdenum.

For any given level of ductility the load resistance was a maximum when the maximum tested levels of vanadium and carbon were present. The reference composition and the low-molybdenum content welds, both of which had lesser ductility, also followed the same higher load-time product to ductility relation, FIG. 9.

The other eleven welds followed an intermediate relationship to ductility. The five welds in this group which exhibited the highest combined ductility and load resistance were the ones containing minimum amounts of chromium and nickel, maximum cobalt, and the two silicon contents.

The changes in hardness (Table VI, tenth column) of the threaded ends of the test specimens were negative in every case, i.e., the weld metal softened upon unstressed exposure to 1050°F for the total life of the test specimens (238 to 2303 hours). Except for the two extreme limits of carbon content, the average hardness reduction was 124 DPH. This was independent of time of exposure, within the stated limits, and was independent of weld composition. This 19-specimen group of welds was within a 0.075 to 0.140% carbon content range (av. = 0.109% C).

The low (0.013%) carbon content weld, which was exposed to the 1050°F temperature for a total of 691 hr, reduced in hardness by 46 DPH units. The high (0.201%) carbon content weld, which was exposed to 1050°F for a total of 2303 hours, reduced in hardness by only 33 DPH units.

Figure 10:
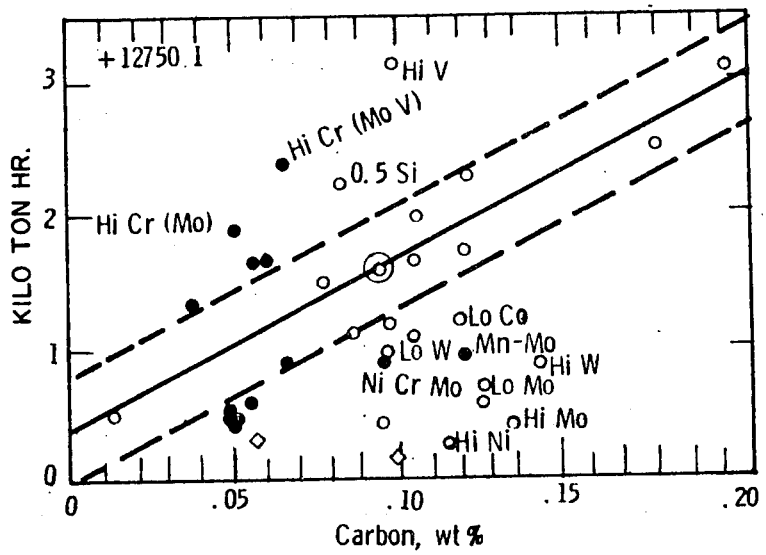
Figure 10:
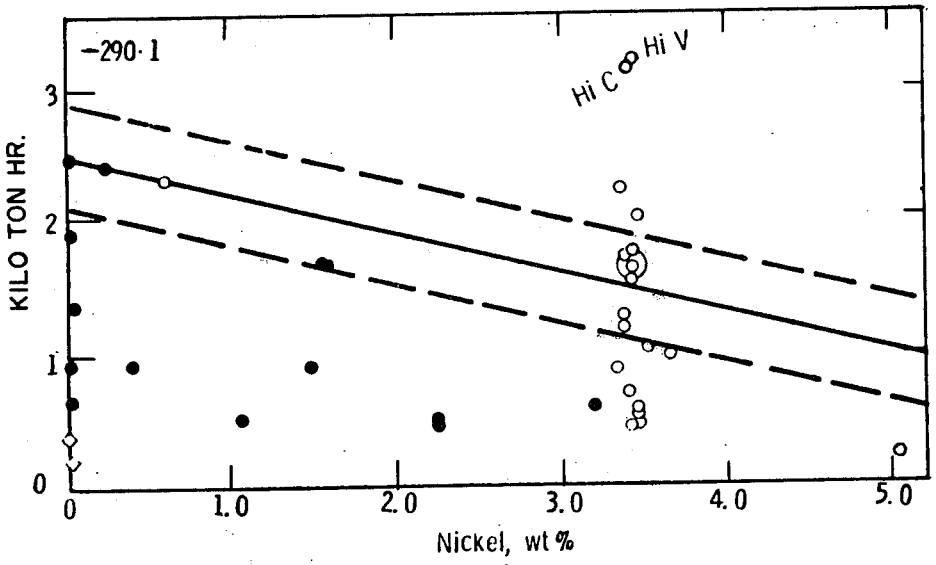
Figure 10:
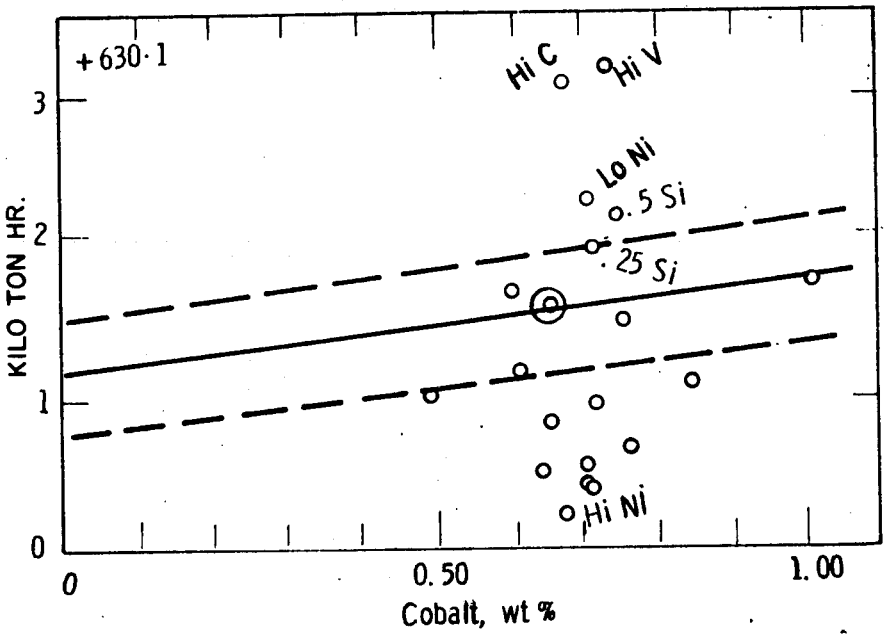
Figure 10:
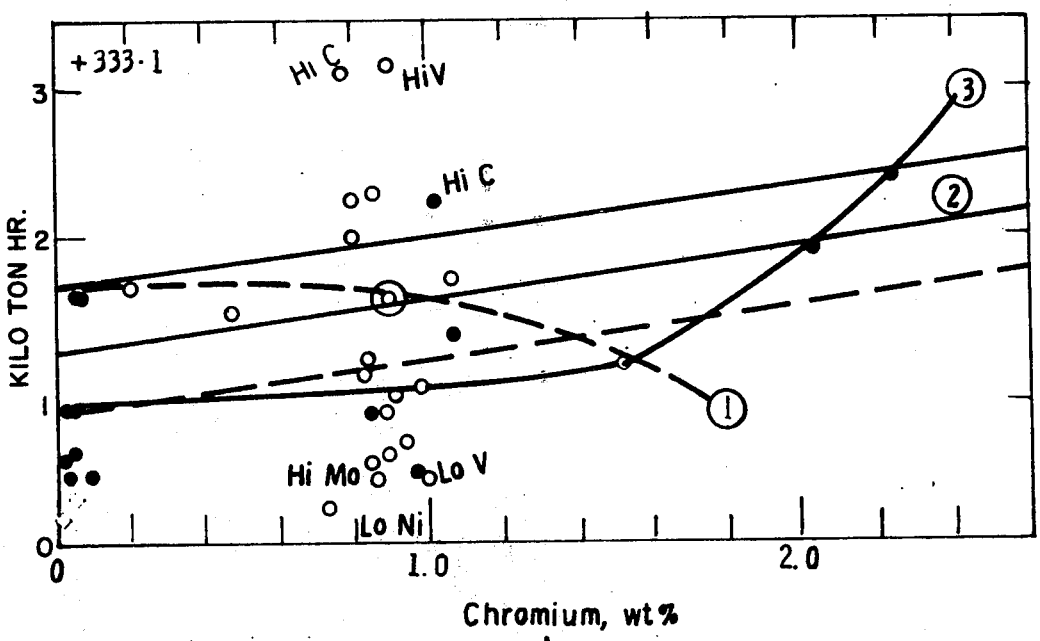
Figure 10:
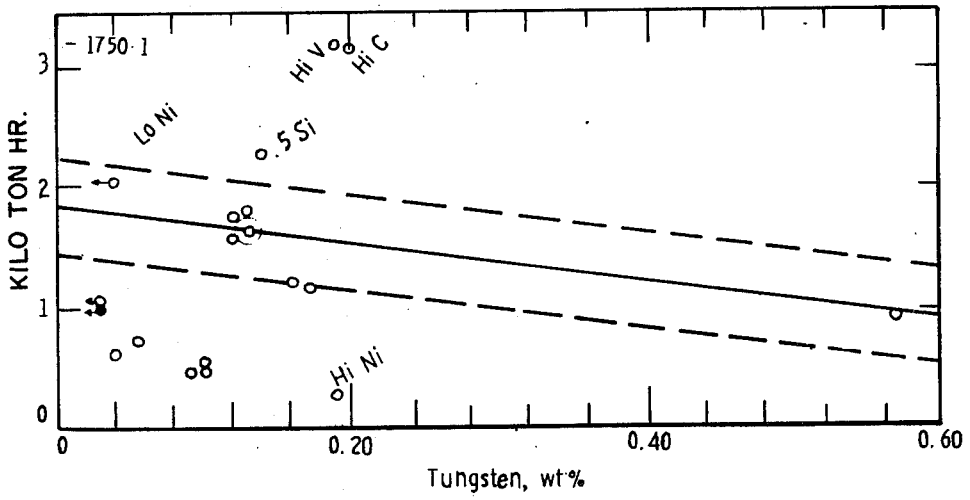
Figure 10:
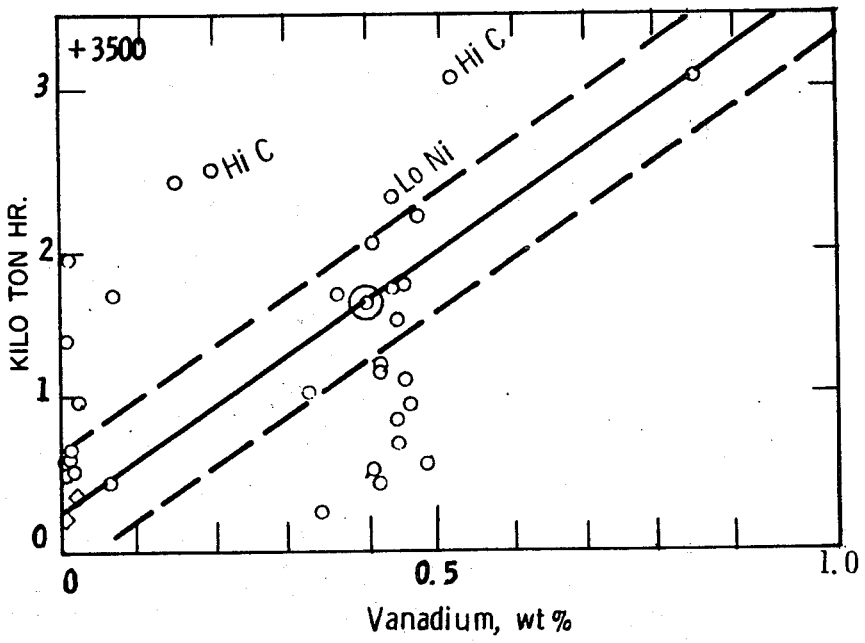
Figure 10:
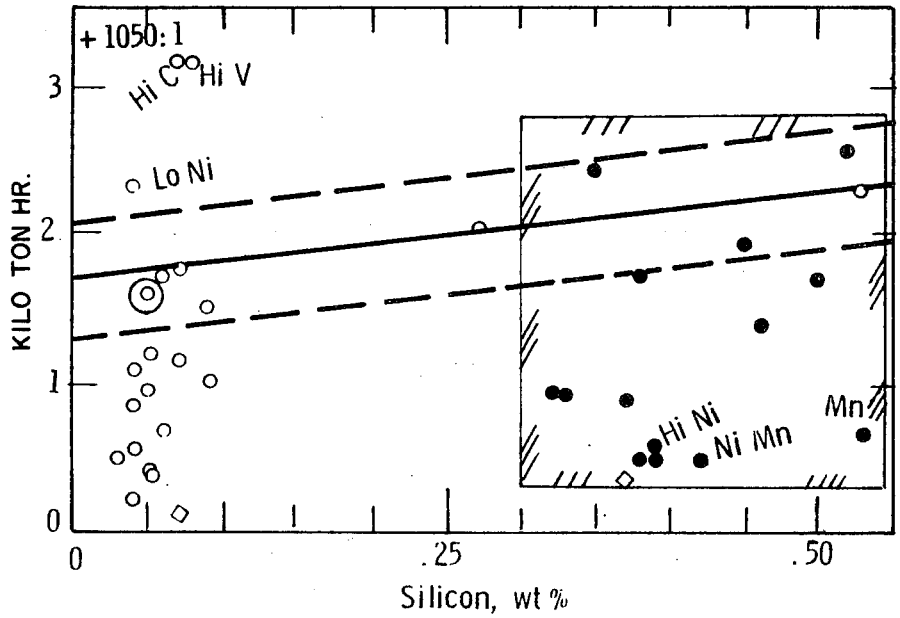
Figure 10:
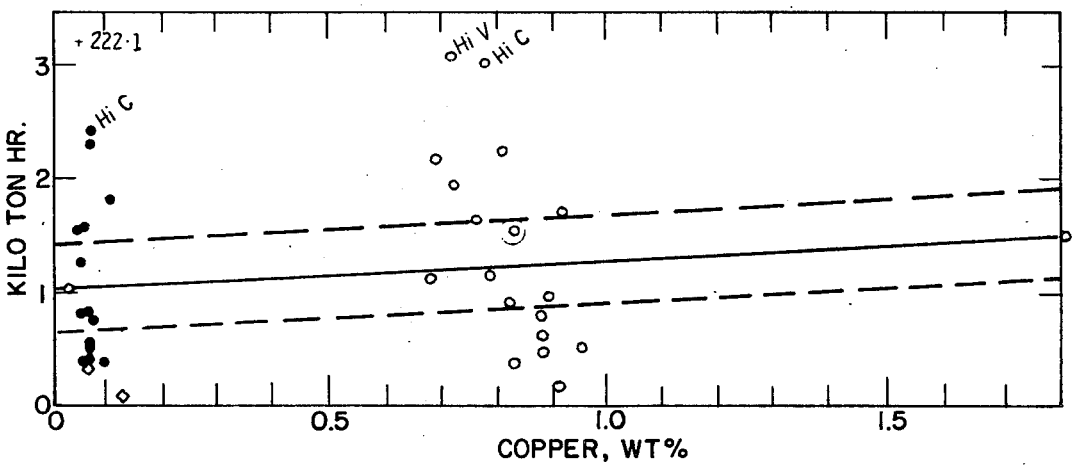
Figure 10:
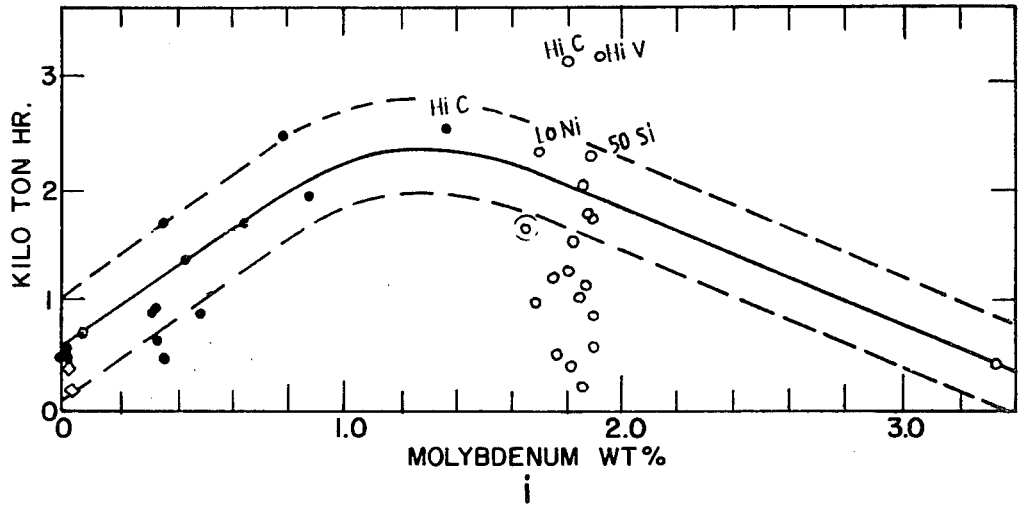
Figure 10:
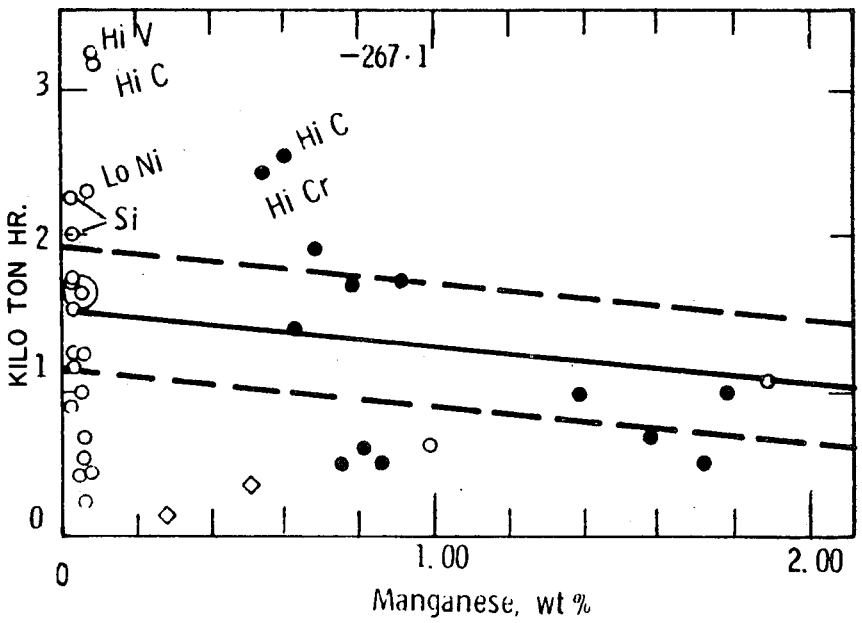

FIGS. 10(*a*) through (*j*) presents trend curves for the various elements or components of the alloys. Load-time in kiloton-hours is plotted vertically and content horizontally for each element. For improved reliability points were added to the graphs from data taken (but not shown in this application) with weld metal from commercial coated allow steel electrodes and from commercial coated unalloyed steel electrodes. "Unalloyed steel" means electrodes of iron with the conventional small quantities of carbon, silicon and manganese. Each graph includes a solid curve (line in most graphs) extending along the points corresponding to the element indicated along the abscissa and broken-line curves (lines) on both sides of the solid curve corresponding to the extent of variation of these points.

FIG. 10 shows from the viewpoints of minimizing strain rates, both C and V should be used to the higher sides of the composition ranges. For the same reasons, nickel should be completely eliminated from the base metal and from the filler metals so that it will be absent from the weld metal. Again from the viewpoint of creep rates, silicon can be deleted or permitted up through 0.50%. Amounts of cobalt between 0.60 and 1.0%, or higher, are preferred; deletion of cobalt is detrimental. The highest, and best, value obtained was with 1.0% Co. Higher quantities may result in improvement. Molybdenum, chromium, copper, and tungsten appear to be at or near their optimum values in the reference TIG composition. This is also true for manganese, although the reference composition seeks to have no (<0.05%) manganese present. All further additions of manganese are harmful, i.e., they increase the creep rate.

Figure 3:
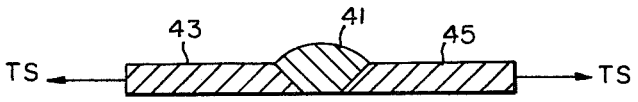
FIG. 3 is a view in section showing the manner in which a transverse reputure is produced.

In arriving at this invention transverse welded joints were also tested. The manner in which a transverse welded joint is subjected to stress is shown in FIG. 3. The joint is formed by a weld 41 joining parts 43 and 45. The stress TS is applied to the parts 43 and 45. The hoop stress HS (FIG. 1) would be applied in this way to the longitudinal weld of a conductor or tube closed by a seam weld.

In carrying out the tests two transverse smoothbar, 0.357-inch-diameter, stress-rupture specimens were prepared from each of the 21 welded joints which were made to evaluate the high-purity, variable-composition welds just described. These 42 individual specimens were tested to rupture at 1050°F under differing constant loads. The loads were such that they imposed tensile stresses across the range of from 20,000 to 80,000 psi. Under these conditions, rupture occurred within time spans of from 0.0 to 150 hr, i.e., these were all relatively short-time stress-rupture tests.

The data is tabulated in the following Table XI:

TABLE XI

| Spec No. | Alloy Variation | Stress Level (psi) | Rupture Time (hr) | Rupture Strain (%) | Elongation (%) | Area Reduction (%) | (%/hr) Min Creep Rate | Time to 0.5% Strain (hr) | Failure Location (origin) |
|---|---|---|---|---|---|---|---|---|---|
| 1057 -1 | Ref | 41,000 | 19 | 1.9 | 1.3 | 9.0 | 0.064 | 5.5 | HAZ |
| -2 | Comp | 25,000 | 87.5 | 2.7 | 2.6 | 9.0 | 0.012 | 16 | HAZ |
| 1058 -1 | | 36,000 | 10 | 15.4 | 17.7 | 74.0 | 0.16 | 2 | Weld |
| | Lo C | | | | | | | | |
| -2 | | 25,000 | 58 | 21.1 | 21.6 | 65.4 | 0.048 | 8 | Weld |
| 1061 -1 | | 40,000 | 25.5 | 2.1 | 1.6 | 7.0 | 0.056 | 5 | HAZ |
| | Hi C | | | | | | | | |
| -2 | | 25,000 | 95 | 2.1 | 2.6 | 8.0 | 0.017 | 20 | HAZ |
| 1060 -1 | | 47,000 | 9 | 2.1 | 2.6 | 10.0 | 0.11 | 2 | HAZ |
| | 1.0 Mn | | | | | | | | |
| -2 | | 25,000 | 89 | 3.3 | 3.3 | 10.0 | 0.016 | 20 | HAZ |
| 1063 -1 | | 40,000 | 15.5 | 2.4 | 2.6 | 6.7 | 0.089 | 2 | HAZ |
| | 2.0 Mn | | | | | | | | |
| -2 | | 25,000 | 65 | 2.3 | 2.6 | 2.0 | 0.022 | 15 | HAZ |
| 1064 -1 | | 79,000 | 0.2 | 10.5 | 17.0 | 75.7 | — | 0.0 | Base Base Metal |
| | 0.25 Si | | | | | | | | |
| -2 | | 25,000 | 84.0 | 2.9 | 2.6 | 10.0 | 0.018 | 14 | HAZ |
| 1095 -1 | | 70,000 | 1.3 | 3.5 | 4.0 | 18.7 | 2.0 | 0.1 | HAZ |
| | 0.5 Si | | | | | | | | |
| -2 | | 60,000 | 3.0 | 2.6 | 4.6 | 16.7 | 0.46 | 0.5 | HAZ* |
| 1096 -1 | | 50,000 | 8.5 | 2.6 | 3.3 | 10.4 | 0.19 | 1.5 | Bond |
| | Lo Cu | | | | | | | | |
| -2 | | 40,000 | 14.5 | 2.0 | 2.0 | 8.0 | 0.086 | 3.0 | Bond |
| 1097 -1 | | 50,000 | 8 | 2.9 | 2.9 | 8.8 | 0.21 | 1.0 | HAZ |
| | Hi Cu | | | | | | | | |
| -2 | | 40,000 | 14 | 2.6 | 2.9 | 11.4 | 0.029 | 1.5 | HAZ |
| 1059 -1 | | 52,000 | 7 | 1.7 | 3.3 | 14.0 | 0.21 | 0.5 | HAZ |
| | Lo Ni | | | | | | | | |
| -2 | | 25,000 | 75.7 | 2.9 | 2.6 | 10.0 | 0.016 | 18 | HAZ |
| 1062 -1 | | 44,000 | 14 | 3.4 | 4.6 | 10.4 | 0.14 | 1.5 | Weld |
| | Hi Ni | | | | | | | | |
| -2 | | 25,000 | 110 | 5.4 | 4.6 | 9.0 | 0.014 | 10 | Weld |
| 1103 -1 | | 80,000 | 0.5 | 6.3 | 9.2 | 44.0 | — | 0.1 | HAZ* |

TABLE XI-continued

| Spec No. | Alloy Variation | Stress Level (psi) | Rupture Time (hr) | Rupture Strain (%) | Elongation (%) | Area Reduction (%) | (%/hr) Min Creep Rate | Time to 0.5% Strain (hr) | Failure Location (origin) |
|---|---|---|---|---|---|---|---|---|---|
| | Lo Cr | | | | | | | | |
| -2 | | 35,000 | 18.5 | 18.5 | 4.2 | 21.0 | 0.077 | 2.5 | HAZ |
| 1098 -1 | | 80,000 | 0.5 | 5.2 | 6.5 | 34.8 | 4.1 | 0.0 | HAZ* |
| | Hi Cr | | | | | | | | |
| -2 | | 35,000 | 21.0 | 1.6 | 1.3 | 8.0 | 0.048 | 7.0 | HAZ |
| 1100 -1 | | 60,000 | 0.1 | 1.1 | 4.2 | 17.6 | — | 0.05 | Weld |
| | Lo Mo | | | | | | | | |
| -2 | | 35,000 | 3.0 | 1.7 | 2.6 | 9.2 | 0.18 | 1.5 | Weld |
| 1101 -1 | | 60,000 | 4.5 | 5.8 | 7.2 | 15.7 | 0.77 | 0.5 | HAZ |
| | Hi Mo | | | | | | | | |
| -2 | | 35,000 | 27.0 | 4.1 | 4.6 | 13.7 | 0.089 | 5.0 | HAZ |
| 1102 -1 | | 50,000 | 3.5 | 1.3 | 2.0 | 8.8 | 0.031 | 0.2 | HAZ |
| | Lo V | | | | | | | | |
| -2 | | 30,000 | 41 | 3.6 | 3.9 | 14.0 | 0.033 | 7.0 | HAZ |
| 1099 -1 | | 70,000 | 0.9 | 2.3 | 4.0 | 14.5 | 1.7 | 0.2 | HAZ |
| | Hi V | | | | | | | | |
| -2 | | 60,000 | 1.5 | 2.0 | 2.0 | 12.0 | 0.77 | 0.2 | HAZ |
| 1104 -1 | | 30,000 | 37 | 2.2 | 2.0 | 6.0 | 0.038 | 8 | HAZ |
| | Lo W | | | | | | | | |
| -2 | | 20,000 | 134 | 2.9 | 2.6 | 10.0 | 0.010 | 35 | HAZ |
| 1105 -1 | | 30,000 | 40 | 2.8 | 2.6 | 13.4 | 0.027 | 9 | HAZ |
| | Hi W | | | | | | | | |
| -2 | | 20,000 | 150 | 5.1 | 4.6 | 16.6 | 0.009 | 15 | HAZ |
| 1106 -1 | | 40,000 | 17 | 2.9 | 3.9 | 15.4 | 0.082 | 4 | HAZ |
| | Low Co | | | | | | | | |
| -2 | | 20,000 | 127 | 4.3 | 4.6 | 10.2 | 0.010 | 11 | HAZ |
| 1107 -1 | | 40,000 | 14 | 1.6 | 2.9 | 10.0 | 0.072 | 6 | HAZ |
| | Hi Co | | | | | | | | |
| -2 | | 20,000 | 103 | 1.6 | 1.3 | 6.0 | 0.012 | 10 | HAZ |

*Start of failure. Progressed into base metal

The abbreviation HAZ in the column on the extreme right means heat-affected zone. Failure usually occurred at the weld edge, either in the heat-affected zone or at the bond interface, Table XI, Right Column.

Both of the low carbon and both of the low molybdenum-content welded-joint specimens were sufficiently weak that failure, in those cases, occurred in the weld metals. The two high (5.06%) nickel content joints also were ruptured in the weld metals, but at times comparable to those of the other test joints. Except for these three welds (low carbon, low molybdenum, and high nickel), all but one of the joints broke starting in the heat-affected or bond zones. An exception was a 0.25% Si content weld (1064) which failed in the bulk base metal in one case (−1), but in the weld bond in the second case (−2).

Whereas Table XI generally lists failure locations as in the heat-affected zone, more detailed studies show that, with the exceptions noted, the failures usually occurred at the bond between weld and the base metals. In every case, the weld metal has a composition different from the plate. These differences usually existed for all 10 of the alloying elements, as summarized in the following Table XII:

TABLE XII

| Element | Low Weld | Plate | High Weld | Element | Low Weld | Plate | High Weld |
|---|---|---|---|---|---|---|---|
| C | 0.013 | 0.17 | 0.201 | Cr | 0.20 | 1.63 | 1.51 |
| Mn | 0.058 | 0.35 | 1.90 | Mo | 0.07 | 0.31 | 3.36 |
| Si | 0.05 | 0.22 | 0.53 | V | 0.06 | 0.10 | 0.85 |
| Cu | 0.02 | 0.08 | 1.81 | W | <0.03 | Nil | 0.57 |
| Ni | 0.56 | 3.53 | 5.06 | Co | 0.008 | Nil | 1.01 |

These observations suggest that the ideal weldment consists of a weld metal haing the proper physical characteristics joining two pieces of either wrought or cast base metals having compositions identical with those of the weld metals.

Figure 11:
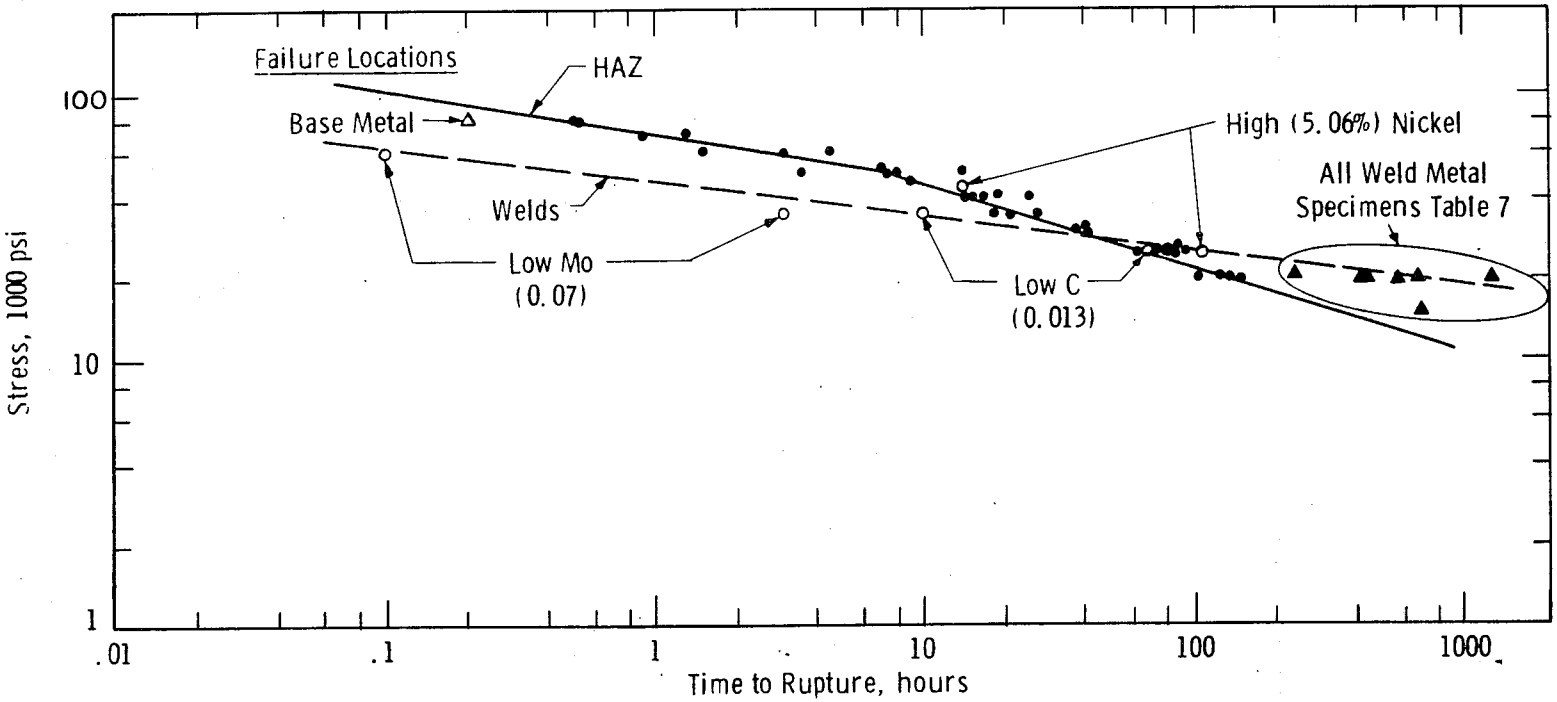
FIG 11 is a graph showing the relationship of stress and rupture time for TIG weld metal with different alloying components at high temperaure.

The time-to-rupture values, Table XI, for each of the several stress levels are plotted in FIG. 11 in which stress is plotted vertically and time horizontally both on log scales. Except for the one low (0.0131%) carbon and the two low (0.07%) molybdenum-content weld specimens, all joint rupture times fell on or near the same stress-time curve. A strict interpretation of the data, however, requires the conclusion that, at the lower stress levels (<28,000 psi), which require longer times to cause rupture, the weld metals are stronger than the plate heat-affected zone. This observation is supported by adding data points from the six welds in Table VII which were tested under constant loads corresponding to 20,000 and 15,000 psi (low C, 1058; 1.0 Mn, 1060; 5.06 Ni, 1062; 0.07 Mo, 1100; 3.36 Mo, 1101; 0.06 V, 1102; and 0.01 Co, 1106).

These collective data, therefore, identify a serious technical industrial principle namely, under the long-time creep conditions (>100 hr), the heat-affected zone can be the critical region in a welded joint. The weld metal and the bulk base metal are not the weak regions under those conditions.

The HAZ stress-time rupture curve, FIG. 11, plotted on log-log coordinates, exhibits a distinct slope change at the 50,000 psi stress level. A projection of this curve to 100,000 hours rupture time indicates that, should the plotted relationship hold up to that time limit, stresses in the heat-affected zone must be less than 2400 psi to achieve that life duration at 1050°F, for this particular base metal (Ni, Cr, Mo, V).

Figure 12:
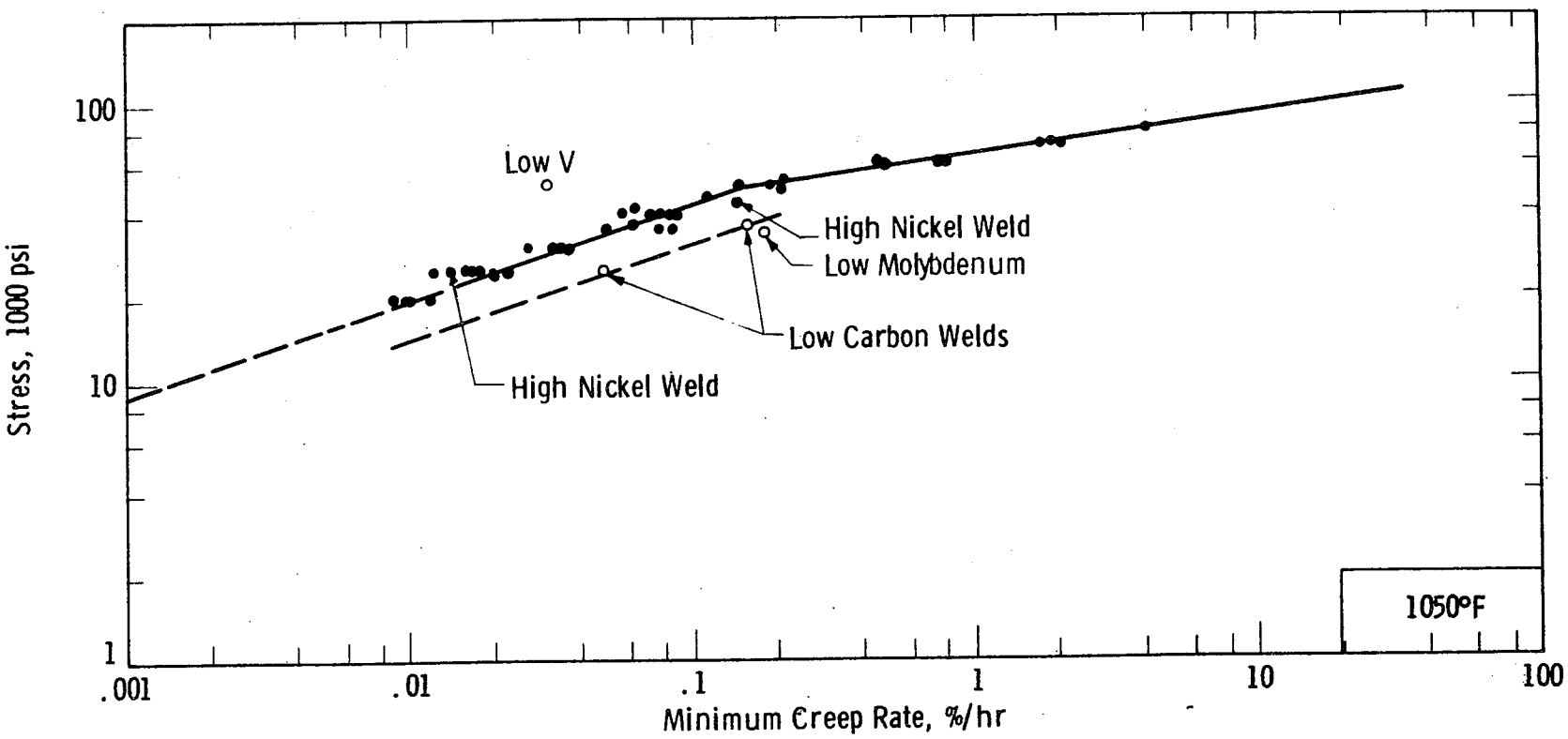
FIG. 12 is a graph showing the relationship between transverse stress and minimum creep rate for various alloying components to TIG weld metal at high temperature.
Figure 13:
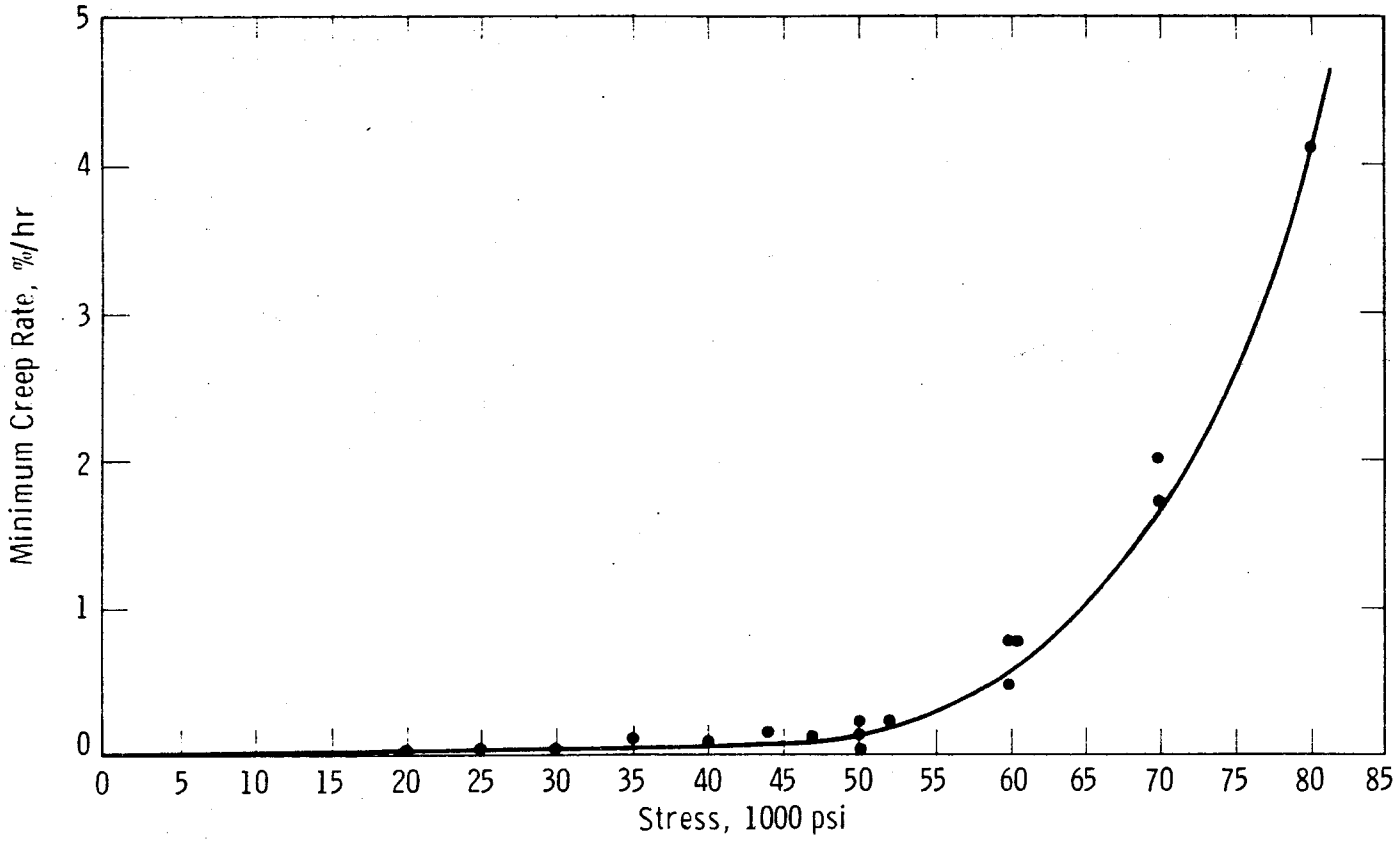
FIG. 13 is a graph showing the relationship between minimum creep rate and transverse stress for TIG weld metal at high temperature.

The individual relationship between applied stress levels and measured minimum creep rates in %/hr, as recorded in Table XI, are plotted in FIG. 12 in which stress is plotted vertically and creep rate horizontally both on log scales. The minimum creep rate to applied stress relationship is about the same for all joints, except the creep rate is higher for the low carbon and low molybdenum content welds. Here, too, there is a change in slope above a stress level of 50,000 psi. The same creep rate data are plotted on rectangular coordinates in FIG. 13 creep rate vertically and stress horizontally.

Figure 14:
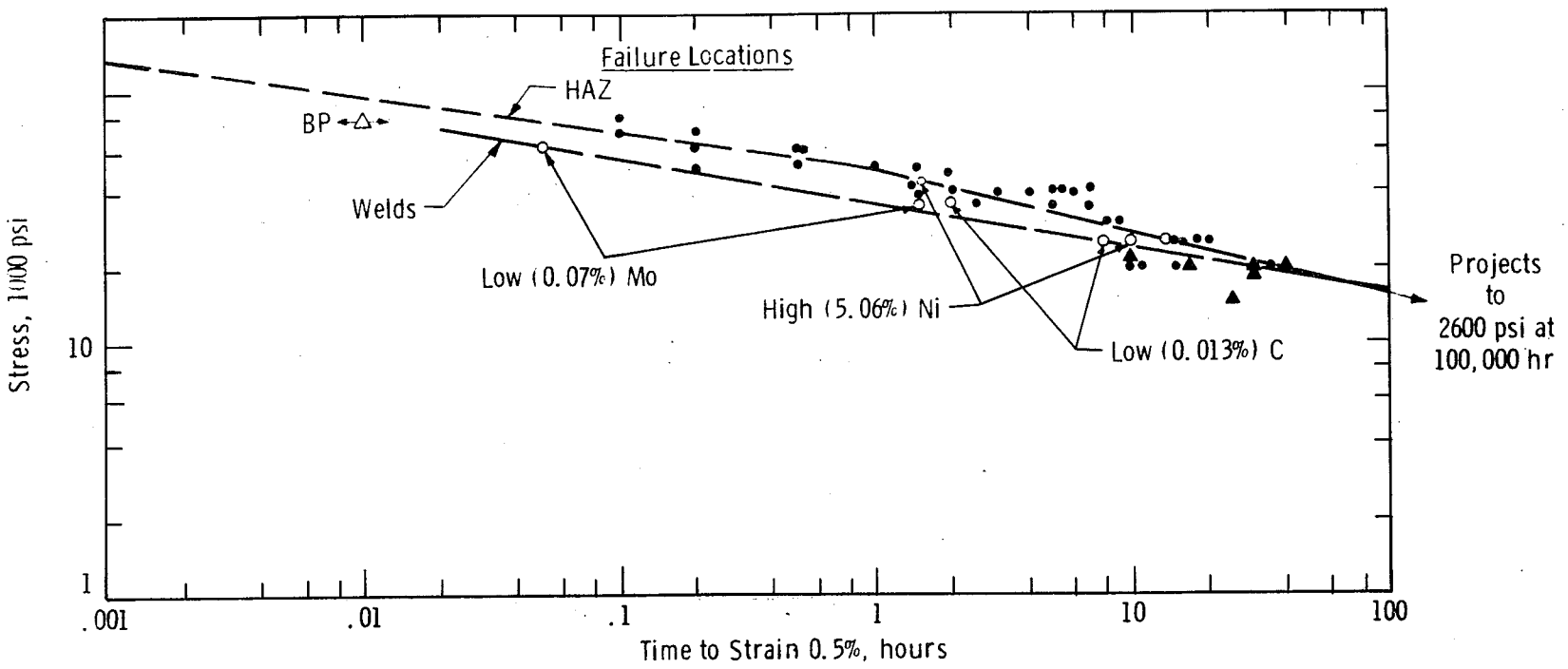
FIG. 14 is a graph showing the time interval, after the application of transverse stress, when failure occurred for different compositions of TIG weld metal at high temperature.

The time required to strain a total of 0.5% for these welds joints is shown in FIG. 14 in which stress is plotted vertically and time horizontally both in log scales. The curve form is similar to that of stress vs. time-to-rupture (FIG. 11) and is the inverse of the stress vs. creep rate curve (FIG. 12).

While all of the specimens had a capacity to strain more than 1.0%, Table XI, 27 of the 42 did not have the capability of straining 3.0%. This is shown in Table XIII:

TABLE XIII

| Specimen Mark | Static Stress | Hr Time to Strain 0.5% | 1.0% | 3.0% | Transition Strain % | Hr | Weld Alloy |
|---|---|---|---|---|---|---|---|
| 1057 -1 | 41,000 | 5.5 | 13.5 | — | 1.3 | 16.5 | |
| -2 | 25,000 | 16.0 | 54.0 | — | 1.3 | 70 | Ref |
| 1058 -1 | 36,000 | 2.0 | 4.5 | 8.0 | 1.0 | 4.5 | |
| | | | | | | | Low C |
| -2 | 25,000 | 8.0 | 16.0 | 35.0 | 1.3 | 20 | |
| 1061 -1 | 40,000 | 5.0 | 13.0 | — | 1.5 | 20.0 | |
| | | | | | | | Hi C |
| -2 | 25,000 | 20.0 | 55.0 | — | 1.7 | 85 | |
| 1060 -1 | 47,000 | 2.0 | 7.0 | — | 1.3 | 8.5 | |
| | | | | | | | 1.0 Mn |
| -2 | 25,000 | 20.0 | 48.0 | 88.0 | 1.4 | 60 | |
| 1063 -1 | 40,000 | 2.0 | 7.0 | — | 1.6 | 13.0 | |
| | | | | | | | 1.9 Mn |
| -2 | 25,000 | 15.0 | 25.0 | — | 1.6 | 58 | |
| 1064 -1 | 29,000 | 0.0 | 0.0 | 0.05 | — | — | |
| | | | | | | | 0.25 Si |
| -2 | 25,000 | 14.0 | 38.0 | — | 1.7 | 67 | |
| 1095 -1 | 70,000 | 0.1 | 0.4 | 1.2 | 2.4 | 0.8 | |
| | | | | | | | 0.53 Si |
| -2 | 60,000 | 0.5 | 1.7 | — | 1.4 | 2.5 | |
| 1096 -1 | 50,000 | 1.5 | 4.3 | — | 1.5 | 6.5 | |
| | | | | | | | Lo Cu |
| -2 | 40,000 | 30 | 9.0 | — | 1.4 | 12.0 | |
| 1097 -1 | 50,000 | 1.0 | 3.5 | — | 1.6 | 6.0 | |
| | | | | | | | Hi Cu |
| -2 | 40,000 | 1.5 | 7.5 | — | 1.5 | 13.5 | |
| 1059 -1 | 52,000 | 0.5 | 3.0 | — | — | — | |
| | | | | | | | Lo Ni |
| -2 | 25,000 | 18.0 | 49.0 | — | 1.4 | 65 | |
| 1062 -1 | 44,000 | 1.5 | 5.0 | 14.0 | 2.0 | 11.5 | |
| | | | | | | | Hi Ni |
| -2 | 35,000 | 10.0 | 13.0 | 43.0 | 1.5 | 65.0 | |
| 1103 -1 | 50,000 | 0.1 | 0.2 | 0.4 | — | — | |
| | | | | | | | Lo Cr |
| -2 | 35,000 | 2.5 | 9.0 | 18.5 | 1.8 | 17.0 | |
| 1098 -1 | 80,000 | 0.0 | 0.1 | 0.4 | 2.0 | 0.3 | |
| | | | | | | | Hi Cr |
| -2 | 35,000 | 7.0 | 18.0 | — | — | — | |
| 1100 1 | 60,000 | 0.05 | 0.1 | — | — | — | |
| | | | | | | | Lo Mo |
| -2 | 35,000 | 1.5 | 2.5 | — | 0.7 | 2.0 | |
| 1101 -1 | 60,000 | 0.5 | 1.0 | 3.5 | 2.6 | 3.0 | |
| | | | | | | | Hi Mo |
| -2 | 35,000 | 5.0 | 10.5 | 24.5 | 1.8 | 18.0 | |
| 1102 -1 | 50,000 | 0.2 | 3.0 | — | 0.75 | 2.0 | |
| | | | | | | | Lo V |
| -2 | 30,000 | 7.0 | 21.0 | 40 | 1.4 | 29 | |
| 1099 -1 | 20,000 | 0.2 | 0.4 | — | 1.8 | 0.9 | |
| | | | | | | | Hi V |
| -2 | 60,000 | 0.2 | 0.8 | — | 1.4 | 1.4 | |
| 1104 -1 | 30,000 | 8.0 | 21.0 | — | 1.5 | 32 | |
| | | | | | | | Lo W |
| -2 | 20,000 | 35.0 | 70.0 | — | 1.6 | 106 | |
| 1105 -1 | 30,000 | 9.0 | 26.0 | — | 1.4 | 35 | |
| | | | | | | | Hi W |
| -2 | 20,000 | 15.0 | 70 | 145 | 1.4 | 90 | |
| 1106 -1 | 40,000 | 4.0 | 10.0 | — | 1.4 | 15 | |
| | | | | | | | Lo Co |
| -2 | 20,000 | 11.0 | 61 | 126 | 1.3 | 76 | |
| 1107 -1 | 40,000 | 6.0 | 12.5 | — | — | — | |
| | | | | | | | Hi Co |
| 2 | 20,000 | 10.0 | 50.0 | — | — | — | |

Avg.=1.52%

The average strain at the transition between second and third stage creep is 1.52%. Table XIII. It is concluded that a stronger, more ductile heat-affected zone adjacent to the weld is desirable. This indicates the need for using a low nickel, low-to-nil manganese, and low-to-nil silicon content steel. Note that some silicon may be desirable to achieve fluidity.

Based on the study of specimens described above, it is concluded that the alloys within the part of the rectangle in FIG. 5 above load resistance of about 1150 ton-hours have satisfactory creep properties. These alloys having load resistance exceeding 1150 ton-hours are called in this application and in the claims as alloys having high creep resistance. These are heats 832, 834, 840, 846, 852, 836, 858, 867, 870, 875, 877 of Tables I and II and welds metals 1057, 1061, 1064, 1095, 1097, 1059, 1103, 1099, 1106, 1107 of Table II.

The following Tables XIV and XV are derived from Tables I and II respectively and present the composition data for the wires or rods which served to produce weld metal with satisfactory creep properties and of the weld metal.

TABLE XIV

| Variable Element | Vacuum Melt Heat No. | Weld No. | Check Analyses (Weight Percent) C | Mn | Si | Cu | Ni | Cr | Mo | V | W |
|---|---|---|---|---|---|---|---|---|---|---|---|
| C | 832 | 1057 | 0.1015 | <0.002 | 0.0185 | 0.91 | 3.405 | 0.72 | 2.07 | 0.49 | 0.265 |
| | 834 | 1061 | 0.216 | <0.002 | 0.009 | 0.96 | 3.425 | 0.72 | 2.11 | 0.48 | 0.28 |
| | | 1110 | | | | | | | | | |
| Mn | | | | | | | | | | | |
| Si | 840 | 1064 | 0.075 | <0.002 | 0.28 | 0.78 | 3.39 | 0.70 | 2.04 | 0.49 | 0.32 |
| | 846 | 1095 | 0.0265 | <0.002 | 0.555 | 0.80 | 3.39 | 0.71 | 2.06 | 0.54 | 0.29 |
| Cu | | | | | | | | | | | |
| | 852 | 1097 | 0.095 | <0.002 | 0.046 | 1.96 | 3.43 | 0.37 | 2.04 | 0.50 | 0.31 |
| | 836 | 1059 | 0.116 | 0.23 | 0.034 | 0.94 | <0.02 | 0.76 | 2.49 | 0.52 | 0.21 |
| Ni | | | | | | | | | | | |
| | 858 | 1103 | 0.111 | — | — | 0.92 | 3.38 | <0.05 | 2.01 | 0.565 | 0.15 |
| Cr | | | | | | | | | | | |
| Mo | | | | | | | | | | | |
| V | | | | | | | | | | | |
| | 867 | 1099 | 0.086 | <0.002 | 0.012 | 0.64 | 3.19 | 0.70 | 2.10 | 1.04 | 0.28 |
| | 870 | 1104 | 0.0885 | <0.002 | 0.023 | 0.84 | 3.43 | 0.64 | 2.04 | 0.50 | <0.03 |
| W | | | | | | | | | | | |
| | 875 | 1106 | 0.1215 | <0.002 | 0.009 | 0.91 | 3.32 | 0.70 | 2.03 | 0.48 | 0.31 |
| Co | | | | | | | | | | | |
| | 877 | 1107 | 0.117 | <0.002 | 0.022 | 0.81 | 3.60 | 0.71 | 2.04 | 0.50 | 0.31 |
| Averages of Non-Variable Elements | | | 0.106 | <0.002 | 0.018 | 0.89 | 3.37 | 0.67 | 2.07 | 0.50 | 0.29 |

| Variable Element | Vacuum Melt Heat No. | Weld No. | Check Analyses (Weight Percent) Co | P | S | N | O |
|---|---|---|---|---|---|---|---|
| C | 832 | 1057 | 0.82 | <0.002 | <0.0020 | 0.0010 | 0.0014 |
| | 834 | 1061 | 0.84 | — | — | 0.0010 | 0.0009 |
| | | 1110 | | | | | |
| Mn | | | | | | | |
| Si | 840 | 1064 | 0.96 | — | — | 0.0010 | 0.0005 |
| | 846 | 1095 | 0.68 | <0.002 | <0.0020 | 0.0007 | 0.0009 |
| Cu | | | | | | | |
| | 852 | 1097 | 0.99 | — | — | 0.0005 | 0.0010 |
| | 836 | 1059 | 0.81 | <0.002 | — | 0.0008 | 0.0016 |
| Ni | | | | | | | |
| | 858 | 1103 | 0.82 | — | — | 0.0012 | 0.0006 |
| Cr | | | | | | | |
| MO | | | | | | | |
| V | | | | | | | |
| | 867 | 1099 | 0.79 | — | — | 0.0014 | 0.0003 |
| | 870 | 1104 | 0.91 | <0.002 | <0.0020 | 0.0006 | 0.0008 |
| W | | | | | | | |
| | 875 | 1106 | <0.05 | — | — | 0.0011 | 0.0010 |
| Co | | | | | | | |
| | 877 | 1107 | 1.50 | <0.002 | <0.0042 | 0.0015 | 0.0007 |
| Averages of Non-Variable Elements | | | 0.36 | <0.002 | <0.0026 | 0.0009 | 0.0008 |

TABLE XV

| Variable Element | Vacuum Melt Heat No. | Weld No. | Check Analyses (Weight Percent) C | Mn | Si | Cu | Ni | Cr | Mo | V | W |
|---|---|---|---|---|---|---|---|---|---|---|---|
| C | 832 | 1057 | 0.096 | 0.058 | 0.05 | 0.82 | 3.415 | 0.89 | 1.66 | 0.41 | 0.13 |
| | 834 | 1061 | 0.201 | 0.088 | 0.07 | 0.77 | 3.43 | 0.78 | 1.80 | 0.52 | 0.20 |
| Si | 840 | 1064 | 0.107 | 0.039 | 0.275 | 0.71 | 3.48 | 0.80 | 1.86 | 0.42 | 0.04 |
| | 846 | 1095 | 0.084 | 0.032 | 0.53 | 0.68 | 3.39 | 0.80 | 1.89 | 0.48 | 0.14 |
| Cu | 852 | 1097 | 0.078 | 0.035 | 0.09 | 1.81 | 3.42 | 0.47 | 1.83 | 0.45 | 0.12 |
| | 836 | 1059 | 0.122 | 0.081 | 0.04 | 0.80 | 0.56 | 0.86 | 1.73 | 0.44 | <0.03 |
| Ni | 858 | 1103 | 0.106 | 0.040 | 0.06 | 0.75 | 3.40 | 0.20 | 1.88 | 0.45 | 0.12 |
| V | 867 | 1099 | 0.099 | 0.091 | 0.08 | 0.71 | 3.49 | 0.90 | 1.92 | 0.85 | 0.19 |
| W | 875 | 1106 | 0.119 | 0.054 | 0.05 | 0.78 | 3.38 | 0.84 | 1.81 | 0.43 | — |
| Co | 877 | 1107 | 0.121 | 0.054 | 0.07 | 0.91 | 3.41 | 1.06 | 1.87 | 0.46 | 0.13 |
| Average of Non-Variable Elements | | | 0.109 | 0.055 | 0.057 | 0.81 | 3.42 | 0.85 | 1.82 | 0.44 | 0.12 |

| Variable | Vacuum Melt Heat | Weld | Check Analyses (Weight Percent) |
|---|---|---|---|

TABLE XV-continued

| Variable Element | Vacuum Melt Heat No. | Weld No. | Check Analyses (Weight Percent) C | Mn | Si | Cu | Ni | Cr | Mo | V | W |
|---|---|---|---|---|---|---|---|---|---|---|---|
| | | | Element | No. | No. | Co | | P | S | N | O |
| | | | C | 832 | 1057 | 0.65 | | 0.0023 | 0.003 | 0.0041 | 0.0010 |
| | | | | 834 | 1061 | 0.67 | | 0.0015 | 0.005 | 0.0010 | 0.0003 |
| | | | Si | 840 | 1064 | 0.71 | | 0.0045 | 0.004 | 0.0016 | 0.0013 |
| | | | | 846 | 1095 | 0.74 | | 0.0015 | 0.004 | 0.0018 | 0.0010 |
| | | | Cu | 852 | 1097 | 0.75 | | 0.0018 | 0.003 | 0.0013 | 0.0009 |
| | | | | 836 | 1059 | 0.70 | | 0.0023 | 0.004 | 0.0014 | 0.0006 |
| | | | Ni | 858 | 1103 | 0.60 | | 0.0018 | 0.003 | 0.0010 | 0.0008 |
| | | | V | 867 | 1099 | 0.73 | | 0.0018 | 0.004 | 0.0015 | 0.0004 |
| | | | W | 875 | 1106 | 0.008 | | 0.0015 | 0.003 | 0.0013 | 0.0014 |
| | | | Co | 877 | 1107 | 1.01 | | 0.0010 | 0.004 | 0.0009 | 0.0003 |
| Average of Non-Variable Elements | | | | | | 0.69 | | 0.0021 | 0.0035 | 0.0017 | 0.0009 |

Based on Table XIV a creep resistant alloy for welding has the following composition in weight percent:

| | |
|---|---|
| C | .075–.216 |
| Mn | <.002–.23 |
| Si | –.009–.555 |
| Cu | .64–1.96 |
| Ni | <.02–3.60 |
| Cr | <.05 to .76 |
| Mo | 2.01–2.49 |
| V | .48–1.04 |
| W | <.03–.32 |
| Co | <.05–1.50 |

with P, S, N and O maintained as low as practicable.

Based on Table XV a creep resistant ferrous-alloy weld metal has the following composition in weight percent:

| | |
|---|---|
| C | .078 to .201 |
| Mn | .032 to .091 |
| Si | .04 to .53 |
| Cu | .68 to 1.81 |
| Ni | .56 to 3.67 |
| Cr | .20 to 1.06 |
| Mo | 1.66 to 1.92 |
| V | .41 to .85 |
| W | <.03 to .20 |
| Co | .008 to 1.01 |

with P, S, N and O maintained as low as practicable.

Detailed consideration of Tables XIV and XV and FIGS. 5 through 14 reveals the following preferred composition for weld metal alloy or base metal, which is joined by the weld metal, in weight percent:

| | |
|---|---|
| C | 0.14–0.20 |
| Mn | <0.088 |
| P | <0.0045 |
| S | <0.005 |
| Si | <.09 |
| Cu | 1.4–2.0 |
| Ni | 0.0–3.67 |
| Cr | 0.0–1.51 |
| Mo | 1.0–2.0 |
| V | 0.0–0.85 |
| W | 0.0–0.40 |
| Co | 0.0–1.01 |
| N | <0.0041 |
| O | <0.0023 |
| Fe | Remainder |

wherein the nickel content depends on the toughness requirements; usually <0.56 is preferred.

The basic composition chosen for the investigation of castings was nominally 0.18% C, 1.5 Cr, 2.0 Mo, and 2.5 Ni, with the variables being Mn (0.01 to 1.50), Si (0.00 to 0.90), V (0.00 to 0.50), and Cu (0.00 to 5.0). These compositions are shown in the following Table XVI:

TABLE XVI

| Heat No. | Primary Variables Mn | Si | Cu | V | Mostly Constant C | Ni | Cr | Mo | Single Variation W | Co |
|---|---|---|---|---|---|---|---|---|---|---|
| 1003 | 0.01* | 0.00* | 2.00 | 0.50 | 0.18 | 2.50 | 1.50 | 2.00 | 0.00 | 0.00 |
| 1000 | 0.01 | 0.00 | 2.00 | 0.00 | 0.18 | 2.50 | 1.50 | 2.00 | 0.00 | 0.00 |
| 1007 | 0.01 | 0.50 | 2.00 | 0.00 | 0.18 | 2.50 | 1.50 | 2.00 | 0.00 | 0.00 |
| 1009 | 0.01 | 0.50 | 2.00 | 0.50 | 0.18 | 2.50 | 1.50 | 2.00 | 0.00 | 0.00 |
| 1008 | 1.50 | 0.50 | 2.00 | 0.50 | 0.18 | 2.50 | 1.50 | 2.00 | 0.00 | 0.00 |
| 1005 | 1.50 | 0.00 | 2.00 | 0.00 | 0.18 | 2.50 | 1.50 | 2.00 | 0.00 | 0.00 |
| 1012 | 1.50 | 0.15 | 0.50 | 0.00 | 0.18 | 2.50 | 1.50 | 2.00 | 0.00 | 0.00 |
| 1013 | 1.50 | 0.15 | 1.00 | 0.00 | 0.18 | 2.50 | 1.50 | 2.00 | 0.00 | 0.00 |
| 1006 | 1.50 | 0.00 | 2.00 | 0.50 | 0.18 | 2.50 | 1.50 | 2.00 | 0.00 | 0.00 |
| 1015 | 1.50 | 0.15 | 0.00 | 0.00 | 0.18 | 2.50 | 1.50 | 2.00 | 0.00 | 0.00 |
| 1011 | 0.01 | 0.00 | 3.00 | 0.25 | 0.05 | 1.61 | 0.35 | 1.00 | 0.18 | 0.39 |
| 1014 | 1.50 | 0.15 | 2.00 | 0.00 | 0.18 | 2.50 | 1.50 | 2.00 | 0.00 | 0.00 |
| 1016 | 1.50 | 0.15 | 3.00 | 0.00 | 0.18 | 2.50 | 1.50 | 2.00 | 0.00 | 0.00 |
| 1017 | 1.50 | 0.15 | 5.00 | 0.00 | 0.18 | 2.50 | 1.50 | 2.00 | 0.00 | 0.00 |
| 1010 | 1.50 | 0.50 | 2.00 | 0.00 | 0.18 | 2.50 | 1.50 | 2.00 | 0.00 | 0.00 |
| 984 | 1.20 | 0.90 | 3.00 | 0.00 | 0.09 | 0.00 | 0.00 | 0.00 | 0.00 | 0.00 |
| 981 | 1.20 | 0.90 | 2.00 | 0.00 | 0.09 | 0.00 | 0.00 | 0.00 | 0.00 | 0.00 |

*Arrows connect heats identical except for manganese or silicon contents

The series of 17 castings included two heats that were essentially nonalloyed, Nos. 984 and 981, Table XVI. These 0.09 C, 1.20 Mn, 0.90 Si, and 2.0 or 3.0 Cu, balance iron, ingots serve as a base to show the results of effective alloy additions. The 15 alloyed ingots provide an opportunity to evaluate the individual variable effects of Mn, Si, Cu, and V in a fixed matrix of Fe-C-Cr-Mo-Ni, with no W or Co present.

The short-time tensile properties obtained for a 750%/hr strain rate at +80°F and at 1050°F are shown in the following Tables XVII and XVIII:

TABLE XVII

| Heat No. | Strengths (psi) Prop Limit | 0.2% Yield | 0.5% Yield | Ultimate | Fracture | Ductility (%) Unif Elong | Total Elong | Area Reduction |
|---|---|---|---|---|---|---|---|---|
| 1003 | 123200 | 147300 | 159300 | 194500 | 227600 | 7.30 | 7.65 | 14.85 |
| 1000 | 100200 | 128800 | 142200 | 177500 | 244300 | 8.35 | 13.73 | 33.36 |
| 1007 | 101400 | 136700 | 150300 | 189800 | 237500 | 8.15 | 10.50 | 21.95 |
| 1009 | 102200 | 140800 | 157300 | 215300+ | None | — | 6.30 | 6.92 |
| | 169250 | 212350 | 223650 | 226600 | 237250 | 0.70 | 7.80* | 5.20** |
| 1008 | 137300 | 170400 | 186750 | 206400+ | None | — | 1.08 | 1.60 |
| | 134400 | 198850 | 218450 | 223500 | 265450 | 3.7 | 8.28* | 17.6** |
| 1005[a] | 130000 | 155200 | 168600 | 196400 | 306000 | 5.55 | 12.34 | 44.00 |
| 1012 | 128000 | 158000 | 171600 | 211800+ | None | — | 3.47 | 5.40 |
| | 164650 | 217500 | 222800 | 223550 | 252250 | 0.7 | 9.17* | 18.20** |
| 1013 | 100500 | 131700 | 144800 | 180800 | 267000 | 7.14 | 14.60 | 42.00 |
| 1006 | 137300 | 173000 | 188500 | 205200+ | None | — | 1.06 | 1.90 |
| | 155750 | 214500 | 221500 | 223700 | 263150 | 3.0 | 8.26* | 18.40** |
| 1015 | 119500 | 147750 | 160500 | 195500 | 272300 | 7.10 | 11.86 | 33.18 |
| 1011 | 103200 | 126300 | 133300 | | 159300 | — | 5.55 | 8.52 |
| 1014 | 136300 | 161500 | 177500 | 206600+ | None | — | 2.10 | 2.70 |
| | 163250 | 214450 | 219350 | 219900 | 277400 | 0.6 | 8.60* | 2.67** |
| 1016 | 118250 | 155200 | 176000 | 206000+ | None | — | 1.57 | 2.20 |
| | 154950 | 215150 | 220550 | 222850 | 285350 | 0.8 | 8.67* | 2.90** |
| 1017 | 118250 | 156300 | 180400 | 206000+ | None | — | 1.30 | 2.20 |
| | 155750 | 216700 | 221050 | 222850 | 272650 | 2.5 | 8.40* | 2.70 |
| 1010 | 112000 | 153000 | 176300 | 206200+ | None | — | 1.37 | 2.70 |
| | 143900 | 209650 | 220950 | 223550 | 266950 | 1.7 | 8.47 | 21.3** |
| 984 | 54100 | 63150 | 66150 | 83200 | 151500 | 11.05 | 24.52 | 60.80 |
| 981 | 51000 | 58600 | 61000 | 80000 | 158500 | 12.50 | 25.90 | 64.40 |

[a]Small void in gage length

*Sum of first and second loadings, because specimen was too strong for 20,000 lb capacity tensile machine

**From second loading only

TABLE XVIII

| Heat No. | Strengths (psi) Prop Limit | 0.2% Yield | 0.5% Yield | Ultimate | Fracture | Ductility (%) Uniform Elong | Total Elong | Area Red |
|---|---|---|---|---|---|---|---|---|
| 1003 | 110250 | 130250 | — | — | 141000 | — | 0.45 | 4.11 |
| 1000 | 92200 | 107250 | — | — | 123700 | — | 0.40 | 11.72 |
| 1007 | 105600 | 123000 | 130700 | — | 138500 | — | 0.68 | 4.93 |
| 1009 | 74400 | — | — | — | 79350 | — | 0.09 | 2.21 |
| 1008 | 97200 | — | — | — | 100300 | — | 0.03 | 2.70 |
| 1005 | 102250 | 121250 | — | — | 131000 | — | 0.33 | 6.32 |
| 1012 | 92200 | 122600 | 131400 | 137000 | 143500 | 1.45 | 1.83 | 5.82 |
| 1013 | 98000 | 118400 | 126600 | 134000 | 164000 | 2.54 | 7.85 | 29.30 |
| 1006[a] | 93200 | — | — | — | 96300 | — | 0.05 | 3.01 |
| 1015 | 96000 | 116400 | 124600 | 127000 | 131200 | 0.90 | 1.60 | 9.20 |
| 1011 | 71000 | — | — | — | 90100 | — | 0.18 | 13.40 |
| 1014 | 100000 | 122400 | — | — | 129000 | — | 0.25 | 4.90 |
| 1016[a] | 100000 | — | — | — | 109500 | — | 0.14 | 5.40 |
| 1019[a] | 46100 | — | — | — | 47500 | — | 0.03 | 2.51 |
| 1010 | 93500 | — | — | — | 103200 | — | 0.12 | 2.72 |
| 984 | 28750 | 34700 | 36500 | 38650 | 40800 | 4.00 | 8.66 | 19.10 |
| 981 | 27570 | 33220 | 35150 | 37730 | 39350 | 4.55 | 12.40 | 18.44 |

[a]Visible voids within gage lengths

All these properties are for the "as-cast" condition. The 0.2% yield strength range, for the alloyed castings, was from 126,300 to 173,000 psi on first loading. Eight of the fifteen alloyed castings had nominal ultimate strengths of more than 200,000 psi, Table XVII. Specimens from these ingots were too strong for the 20,000 psi capacity tensile machine used and they were reloaded to rupture in a larger machine. The increased yield strengths obtained on second loading are the result of having cold strained the metal to 1.0% or more.

The Charp V-notch energy values over the −60° to +200°F temperature range, are listed in Table XIX:

TABLE XIX

| Ingot No. | −60°F Energy (Ft-Lbs) | Lat Exp (In.) | Cleavage (%) | 0°F Energy (Ft-lbs) | Lat Exp (In.) | Cleavage (%) | +80°F Energy (Ft-lbs) | Lat Exp (In.) | Cleavage (%) | +200°F Energy (Ft-lbs) | Lat Exp (In.) | Cleavage (%) |
|---|---|---|---|---|---|---|---|---|---|---|---|---|
| 1003 | 8.0 | .009 | 100 | 7.5 | .004 | 98 | 13.5 | .008 | 90 | 31.5 | .019 | 0 |
| 1000 | 14.0 | .010 | 100 | 16.0 | .013 | 98 | 25.5 | .016 | 80 | 80.5* | .049* | 0* |
| 1007 | 22.0 | .006 | 100 | 16.0 | .009 | 95 | 22.5 | .013 | 90 | 56.5 | .034 | 0 |
| 1009 | 7.0 | .010 | 100 | 7.5 | .003 | 95 | 12.0 | .005 | 90 | 26.0 | .015 | 0 |
| 1008 | 11.0 | .004 | 98 | 11.5 | .006 | 95 | 14.0 | .006 | 90 | 29.5 | .015 | 0 |
| 1005 | 22.0 | .009 | 95 | 33.0 | .016 | 0 | 45.5 | .025 | 0 | 63.0 | .042 | 0 |
| 1012 | 12.0 | .011 | 100 | 11.5 | .004 | 95 | 19.0 | .009 | 90 | 47.5 | .028 | 0 |
| 1013 | — | — | — | 23.0* | .008* | 95* | 46.5 | .028 | 75 | 86.5 | .054 | 0 |

TABLE XIX-continued

| Ingot No. | Energy (Ft-Lbs) | Lat Exp (In.) | Cleavage (%) | Energy (Ft-lbs) | Lat Exp (In.) | Cleavage (%) | Energy (Ft-lbs) | Lat Exp (In.) | Cleavage (%) | Energy (Ft-lbs) | Lat Exp (In.) | Cleavage (%) |
|---|---|---|---|---|---|---|---|---|---|---|---|---|
| | | −60°F | | | 0°F | | | +80°F | | | +200°F | |
| 1006 | 11.5 | .004 | 95 | 13.0 | .005 | 90 | 17.0 | .006 | 90 | 28.5 | .011 | 0 |
| 1015 | 12.0 | .007 | 100 | 14.0 | .005 | 95 | 20.0 | .010 | 90 | 49.0 | .029 | 0 |
| 1011 | 2.5 | .004 | 100 | 2.0 | .004 | 100 | 3.5 | .006 | 100 | 5.5 | .004 | 100 |
| 1014 | 18.5 | .011 | 90 | 30.5 | .019 | 0 | 36.5 | .017 | 0 | 46.0 | .024 | 0 |
| 1016 | 2.5* | .014* | 100* | 23.0* | .013* | —* | 34.5 | .014 | — | 41.5 | .028 | 0 |
| 1017 | 13.5 | .006 | 90 | 16.0 | .005 | 95 | 19.5 | .005 | 90 | 26.0* | .014* | 0* |
| 1010 | 23.0 | .015 | 90 | 23.5 | .011 | — | 35.0 | .015 | — | 51.0 | .025 | 0 |
| 984 | 3.5 | .006 | 100 | 5.0 | .005 | 100 | 17.0 | .019 | 95 | 114.5 | .086 | 20 |
| 981 | 3.0 | .004 | 100 | 10.5 | .009 | 98 | 26.0 | .026 | 95 | 117.0 | .078 | 30 |

*Inclusion or void

The impact magnitude of Table XIX are not as high as those which are encountered for welds because the casting metal is coarse grained as compared to weld metal.

All specimens were prepared in quadruplicate from the lower portion of a 2.5 × 2.5 in. cast 25-lb. vacuum melted high-purity steel ingot. The specimens were maintained under a constant load at the stress levels of 60,000, 30,000, 20,000, 15,000 and 10,000 psi as appropriate to the strength of the several castings. The data for 60,000; 30,000; 20,000; and 15,000 psi is presented in the following Tables XX, XXI, XXII, XXIII.

TABLE XX

STRESS-RUPTURE & CREEP DATA AT 1050°F & 60,000 psi

| Ingot No. | Hrs. To Rupture | Rupture Strain (%) | Elongation (%) | Area Reduction (%) | Min Creep Rate %/Hr | Time To 0.5% Strain (Hrs) | Hardness Change (DPH) |
|---|---|---|---|---|---|---|---|
| 1003 | 50.0 | 0.6 | 1.3 | 2.2 | 0.0034 | 50.0 | +71 |
| 1000 | 30.5 | 0.4 | 1.3 | 6.6 | 0.0053 | — | +37 |
| 1007 | 25.5 | 0.7 | 0.3 | 2.3 | 0.017 | 25.5 | +39 |
| 1009 | 18.0 | 0.5 | 0.7 | 1.0 | 0.017 | 18.0 | +39 |
| 1008 | 0.4 | 0.0 | 0.7 | 0.0 | — | — | +62 |
| 1005 | 4.3 | 0.36 | 1.3 | 3.2 | 0.030 | — | −24 |
| 1012 | 10.5 | 0.7 | 1.7 | 4.4 | 0.046 | 8.0 | −45 |
| 1013 | 55.0 | 1.7 | 2.7 | 6.0 | 0.018 | 19.0 | −27 |
| 1006 | 0.067 | 0.0 | 1.3 | 1.6 | — | — | +50 |
| 1015 | 6.5 | 0.5 | 2.0 | 5.5 | 0.026 | 6.5 | −5 |
| 1011 | 7.5 | 0.5 | 2.0 | 6.0 | 0.037 | 7.5 | −53 |
| 1014 | 1.1 | 0.5 | 1.3 | 3.2 | — | 1.1 | +13 |
| 1016 | 0.6 | 0.2 | 1.0 | 2.2 | — | — | −16 |
| 1017 | 1.4 | 0.2 | 0.3 | 0.0 | — | — | −15 |
| 1010 | 0.8 | 0.25 | 0.0 | 2.2 | — | — | −9 |
| 984 | Too Weak For Testing Under Listed Conditions | | | | | | |
| 981 | Too Weak For Testing Under Listed Conditions | | | | | | |

TABLE XXI

STRESS-RUPTURE AND CREEP DATA AT 1050°F & 30,000 psi

| Ingot No. | Hrs To Rupture | Rupture Strain (%) | Elongation (%) | Area Reduction (%) | Min Creep Rate (%/Hr) | Time To 0.5% Strain (Hrs) | Hardness Change (DPH) |
|---|---|---|---|---|---|---|---|
| 1003 | 8426 | 4.1 | 3.7 | 13.0 | 0.00020 | 430.0 | −101 |
| 1000 | 4752 | 2.3 | 2.7 | 5.0 | 0.00024 | 160.0 | −134 |
| 1007 | 3119 | 5.3 | 5.7 | 7.0 | 0.00067 | 80.0 | −158 |
| 1009 | 2953 | 1.6 | 2.7 | 1.8 | 0.00028 | 140.0 | −124 |
| 1008 | 1301 | 2.0 | 2.3 | 1.0 | 0.0011 | 100.0 | −143 |
| 1005 | 1510 | 3.1 | 3.0 | — | 0.0010 | 40.0 | −154 |
| 1012 | 826 | 4.26 | 4.3 | 3.7 | 0.0025 | 30.0 | −164 |
| 1013 | 1189 | 3.4 | 4.0 | 6.2 | 0.0011 | 35.0 | −123 |
| 1006 | 2180 | 2.5 | 3.3 | 3.3 | 0.00070 | 120.0 | −186 |
| 1015 | 648 | 2.9 | 2.7 | 1.0 | 0.0037 | 30 | −131 |
| 1011 | 350 | 0.57 | 0.7 | 3.2 | 0.0006 | 200.0 | −99 |
| 1014 | 478 | 3.5 | 4.0 | 2.2 | 0.0042 | 10.0 | −161 |
| 1016 | 212 | 1.5 | 2.0 | 1.7 | 0.0033 | 15.0 | −116 |
| 1017 | 38 | 1.2 | 1.3 | 1.8 | 0.018 | 10.0 | −87 |
| 1010 | 287 | 6.9 | 6.7 | 7.7 | 0.012 | 12.0 | −216 |
| 984* | 2.4 | 2.4 | 3.0 | 6.8 | 0.71 | 0.5 | −8 |
| 981* | 2.7 | 1.4 | 2.3 | 7.2 | 0.20 | 0.0 | −1 |

*Tested at 25,000 psi

TABLE XXII

STRESS-RUPTURE AND CREEP DATA AT 1050°F & 20,000 psi

| Ingot No. | Hrs To Rupture | Rupture Strain (%) | Elongation (%) | Area Reduction (%) | Min Creep Rate (%/Hr) | Time To 0.5% Strain (Hrs) | Hardness Change (DPH) |
|---|---|---|---|---|---|---|---|
| 1003 | 33,207* | 2.0 | 0.7 | 1.5 | 0.00001 | 400 | −205 |
| 1000 | 32,974* | 2.75 | 1.3 | 2.8 | 0.00030 | 100 | −155 |
| 1007 | 14,467 | 9.2 | 9.7 | 13.4 | 0.00021 | 150 | −180 |
| 1009 | 18,453 | 10.1 | 6.7 | 19.7 | 0.00003 | 800 | −133 |
| 1008 | 8125 | 2.7 | 2.7 | 3.3 | 0.00023 | 950.0 | −216 |
| 1005 | 4672 | 2.1 | 4.0 | 2.8 | 0.00074 | 60.0 | +16 |
| 1012 | 2612 | 4.2 | 4.0 | 2.8 | 0.00074 | 50.0 | −188 |
| 1013 | | | | | | | |
| 1006 | 6788 | 3.4 | 4.0 | 2.5 | 0.00032 | 850.0 | −151 |
| 1015 | 2537 | 2.9 | 3.3 | 1.7 | 0.00058 | 80.0 | −173 |
| 1011 | 1438 | 0.94 | 2.0 | 4.0 | 0.00018 | 250.0 | −116 |
| 1014 | 1033 | 2.6 | 2.0 | 1.4 | 0.0014 | 20.0 | −172 |
| 1016 | 325 | 1.25 | 1.3 | 5.0 | 0.0015 | 54.0 | −127 |
| 1017 | 279 | 1.25 | 1.3 | 1.0 | 0.0021 | 30.0 | −150 |
| 1010 | 0.033 | 1.1 | 1.3 | 1.8 | — | — | +142 |
| 984 | | | | | | | |
| 981 | | | | | | | |

* Note:
Tests stopped at times shown.
All listed values are for those times and thus are not comparable to rupture values listed for other specimens

TABLE XXIII

STRESS-RUPTURE AND CREEP DATA AT 1050°F & 15,000 psi

| Ingot No. | Hrs To Rupture | Rupture Strain (%) | Elongation (%) | Area Reduction (%) | Min Creep Rate (%/Hr) | Time To 0.5% Strain (Hrs) | Hardness Change (DPH) |
|---|---|---|---|---|---|---|---|
| 1003 | | | | | | | |
| 1000 | | | | | | | |
| 1007 | | | | | | | |
| 1009 | | | | | | | |
| 1008 | 21101* | 1.6 | 1.3 | 5.0 | 0.00006 | 2000 | −207 |
| 1005 | 14690 | 2.7 | 2.7 | 5.5 | 0.00010 | 200 | −198 |
| 1012 | | | | | | | |
| 1013 | | | | | | | |
| 1006 | 20637* | 1.6 | 1.0 | 0.5 | 0.00006 | 2300 | −235 |
| 1015 | | | | | | | |
| 1011 | | | | | | | |
| 1014 | | | | | | | |
| 1016 | | | | | | | |
| 1017 | | | | | | | |
| 1010 | | | | | | | |
| 984 | 111 | 1.7 | 1.3 | 2.6 | 0.011 | 35.0 | −24 |
| 981 | 91 | 2.1 | 1.7 | 1.0 | 0.010 | 26.0 | −24 |

Note:
Tests stopped at times shown.
All listed values are for those times and thus are not comparable to rupture values listed for other specimens Heat Nos. 1003 and 1006 are the same as the basic composition except that 1006 contained 1.5% Mn, whereas 1003 contained essentially no manganese, (Table XVI). The specimens from heat 1003 required more time to rupture and had a lower minimum creep rate than those from heat 1006, (Tables XX, XXI, XXII). The same conclusion can be reached by comparing the results from heats 1000 (0.01 Mn) and 1005 (1.5 Mn); heats 1007 and 1010, and heats 1009 and 1008. This is shown graphically in FIGS. 15(*a*) and (*b*) and in FIGS. 16(*a*) and (*b*). In FIGS. 15(*a*) and (*b*) stress is plotted vertically and time of rupture horizontally. In FIGS. 16(*a*) and (*b*) stress is plotted vertically and creep rate horizontally.

These data and graphs show that the absence of manganese is beneficial and the presence of manganese is harmful to reducing creep. The same conclusions were reached for weld metals, (FIGS. 6, 7, 8 and 10).

Heats 1003 and 1000 contained no silicon, (Table XVI). Heats 1007 and 1009 contained 0.50% Si. Specimens from heats 1003 and 1000 required more time to rupture, FIGS. 15(*a*) and (*b*), and had lower creep rates FIGS. 16(*a*) and (*b*), then specimens from heats 1009 and 1007. The absence or low quantities of silicon is beneficial to reducing creep. This, too, is similar to the conclusion reached for weld metals.

Heat 1000 is the same as 1003, except that 1000 contains no vanadium, Table XVI. Specimens from heat 1003, which contained 0.5 V, required more time to rupture than those from heat 1000, FIG. 15(*a*), and the creep rate was lower, FIG. 16(*a*). Therefore, the presence of vanadium was beneficial in reducing creep. In a similar manner, heat 1009 contained 0.5% V, while heat 1007 contained no vanadium. Specimens from heat 1009 were superior to those from heat 1007 as to reduced creep. Again, therefore, the presence of vanadium was beneficial. This, too, is the same as results from weld metals.

Of the four heats 1003, 1000, 1007, 1009, in which the V and Si were varied, and when tested at 20,000 psi at 1050°F, 1007, 0.05 Si and 0.00 V failed after 14,1467 hr. and 1009, 0.50 Si and 0.50 V failed after 18,453 hr.; the tests of 1000, 0.00 Si and 0.00 V, was stopped after 32,974 hr. and the tests 1003, 0.00 Si and 0.50 V was stopped after 33,207 hr., both without rupture.

It is concluded that in the absence of Mn the absence of silicon is also preferred, but if 0.5 Si is present, it is desirable to have V present also. The beneficial effect to reducing creep of 0.5 V more than offsets the detrimental effect of 0.5 Si, (Tables XVI and XX).

The weld metal studies described explored the influence of copper up to 1.81%, Table II. For this portion of the casting study, a broader range, up to 5.0%, was used, Table XVI. Directly comparable results were thus obtained for the effect of copper additions up to 5.0% in the presence of 0.18 C, 1.50 Mn, 2.50 Ni, 1.50 Cr, 2.00 Mo, 0.00 V, 0.00 W, and 0.00 Co. At the 1050°F temperature under 30,000 and 20,000 psi stress levels, this provided the data presented in the following Table XXIV:

TABLE XXIV

| Heat | Cu | Si | Rupture Time (Hr) 30 Kpsi | Rupture Time (Hr) 20 Kpsi | Min Creep Rate (%/Hr) 30 Kpsi | Min Creep Rate (%/Hr) 20 Kpsi |
|---|---|---|---|---|---|---|
| 1015 | 0.00 | 0.15 | 648 | 2537 | 0.0037 | 0.00058 |
| 1012 | 0.50 | 0.15 | 826 | 2612 | 0.0025 | 0.00074 |
| 1013 | 1.00 | 0.15 | 1189 | — | 0.0011 | — |
| 1005 | 2.00 | 0.00 | 1510 | 4672 | 0.0010 | 0.00074 |
| 1016 | 3.00 | 0.15 | 212 | 325 | 0.0033 | 0.00150 |
| 1017 | 5.00 | 0.15 | 38 | 279 | 0.0180 | 0.00210 |

The data for the 30,000 psi stress level are plotted in FIG. 17 in which time of rupture and minimum creep are plotted vertically and copper content in weight percent horizontally. There is a distinct maximum in the time-to-rupture curve at about 1.7% Cu and a distinct minimum in the creep-rate curve at the same copper level. The casting data thus verify the weld metal conclusions; namely, additions of copper up to about 1.7 or 1.8% or even 2.00% are beneficial to reducing creep. Further additions are definitely harmful (FIG. 17). From these data, it is concluded that any amount of copper up to 2.25% is better than having no copper present, but that the optimum copper content is 1.7% ± 0.3% = 1.4 to 2.0%. These conclusions with reference to copper ranges were established in the presence of 1.5% Mn, and do not conflict with the excellent results obtained from the nil manganese content heats (Nos. 1003, 1000, 1007, and 1009), all of which contained 2.0% Cu, Tables XVI and XX.

One heat (1011) had 0.05% C, but it was also low in Ni, Cr, and Mo and was only one containing W and Co, (Table XVI). This heat was on the weaker side as to creep. Two other heats, 984 and 981, contained 0.09% C, with 3.0 and 2.0% Cu, but no V, Ni, Cr, Mo, W, or Co. These were the two weakest castings as to creep in the entire series, [Tables XVII–XXIII and FIGS. 15(*a*) and (*b*)]. Those low properties suggest that, to be effective, carbon must be accompanied by strong carbide-forming elements, other than iron and manganese. Also, since heats 984 and 981 contained 3.0 and 2.0% Cu, respectively, these data suggest that copper is beneficial only in the presence of carbides of Cr, Mo, V, etc.

Figure 15A:
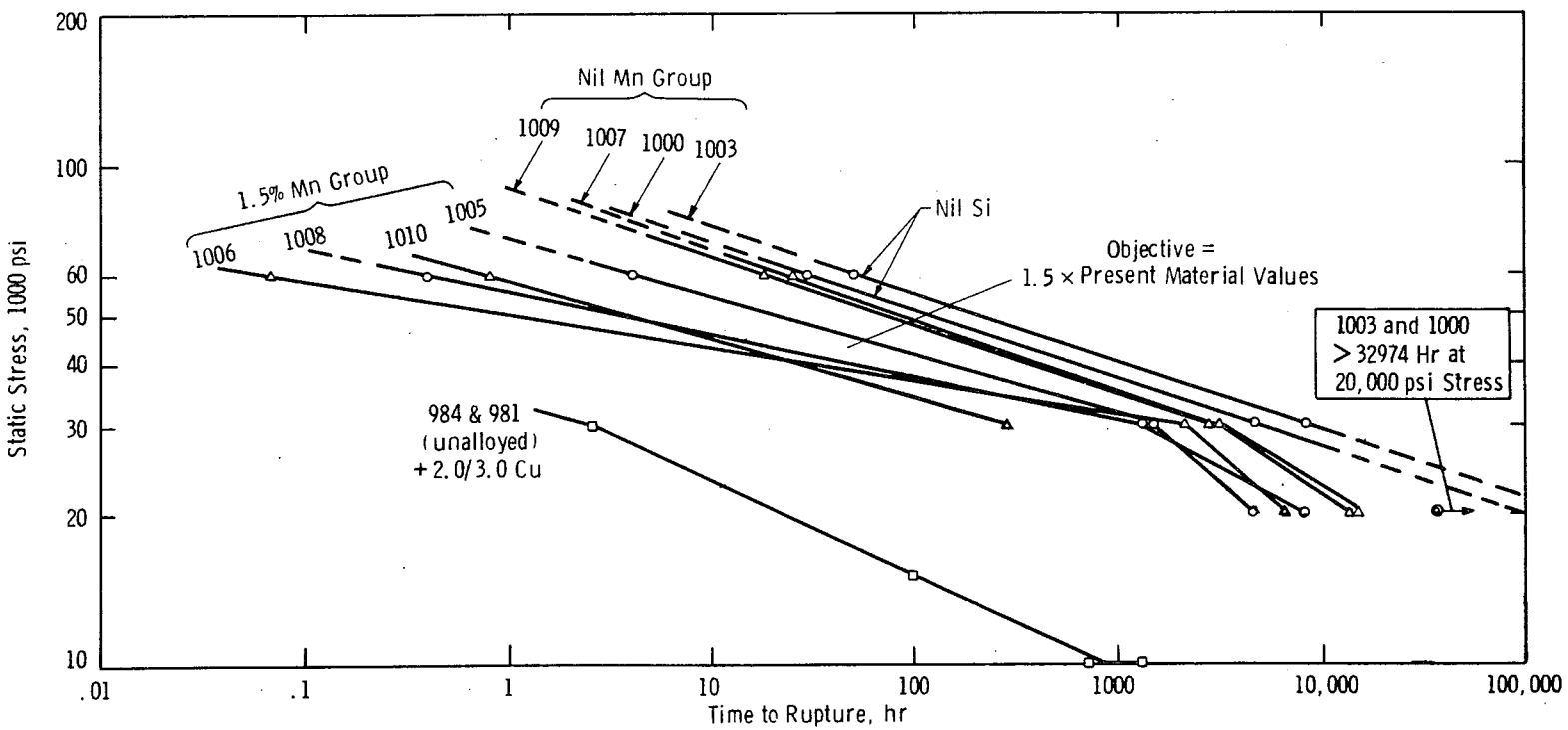
Figure 15B:
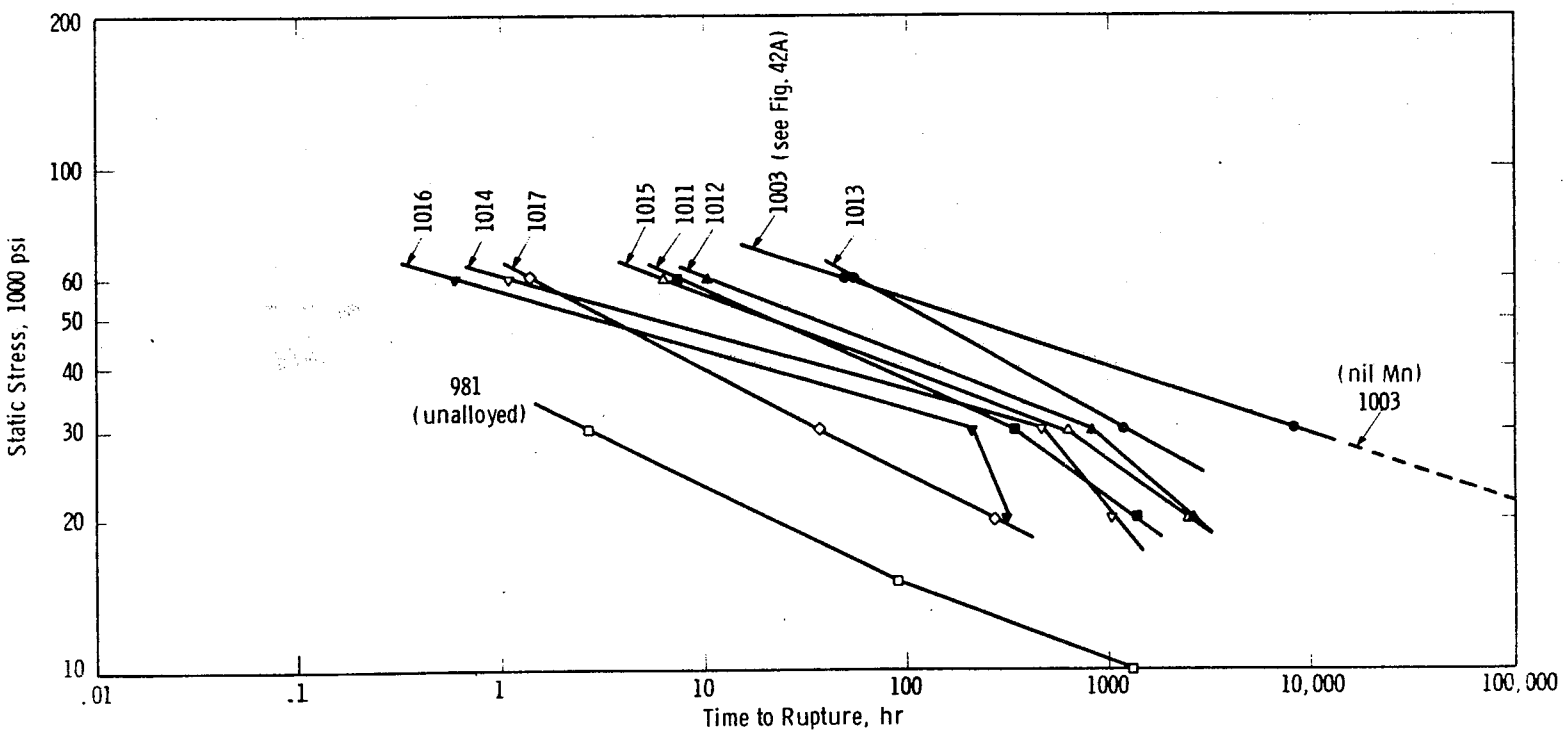

In FIG. 15*a*, curves are shown as linear protections for the yet unbroken specimens 1003 and 1000.

On the basis of Table XVI and of FIGS. 15*a* and *b*, 16*a* and *b*, 17, 18 and 19, it is concluded that an optimum casting composition as to creep at 1050°F has the following nominal composition:

| | |
|---|---|
| Carbon | 0.14 – 0.20% |
| Manganese | <0.05 |
| Silicon | <0.50 |

-continued

| | |
|---|---|
| Phosphorus | <0.015 |
| Sulfur | <0.015 |
| Copper | 1.4 – 2.0 |
| Nickel | 0.00 – 2.5 |
| Chromium | 1.0 – 2.5 |
| Molybdenum | 1.0 – 2.0 |
| Vanadium | 0.0 – 0.8 |
| Tungsten | 0.05 – 0.40 |
| Cobalt | 0.5 – 1.01+ |

On the basis of Tables XX through XXIII and FIGS. 15*a*, 15*b*, 16*a*, 16*b*, 18 and 19 it is concluded that ingot compositions 1003, 1000, 1007 and 1009 serve to define a composition of high creep resistance as this expression is used in the claims. This definition is based on the overall performance of these alloys at loadings of 60,000 psi, 30,000 psi, 20,000 psi and 15,000 psi. At 60,000 psi (Table XX) the rupture time of the selected ingots ranges between 18 hours (for 1009) and 50 hours for 1003 and the creep-rate in percent per hour between 0.0034 and 0.017. Ingot 1013 has a rupture time of 55 hours and a creep rate of 0.018 percent but the performance of this ingot at lower loadings suggests that the performance at 60,000 psi was based on other characteristics than its composition, for example a localized grain-structure of the specimen. At 30,000 psi (Table XXI) the time-of-rupture for the selected ingots ranges between 2953 hours and 8426 hours and the minimum creep rate between 0.00020 and 0.00067 percent per hour. Ingot 1013 has a time of rupture of only 1189 hours and a creep rate of 0.0011, but ingot 1006, which at 60,000 psi had a time of rupture of only 0.067 hours, has a time of rupture of 2180 hours and a creep rate of 0.00070. At 20,000 psi (Table XXII) the range of time of rupture for the selected ingots is between 14,467 hours for 1007 and higher than 33,207 hours, where the tests stopped, for 1003 and the creep rate between 0.00001 and 0.00030 as compared to 6788 and 0.00032 for 1006. At 15,000 psi (Table XXIII) extrapolation show that the time of rupture of 1003 and 1000 exceeds 100,000 hours (FIGS. 15*a*, 15*b*) and the creep rate for (FIGS. 16*a*, 16*b*) 1003 is about 0.00001% per hour and for 1007 and 1009 is less than 0.00001. The time of rupture curve (FIG. 15*a*) and the creep-rate curve for 1006 (FIG. 16*a*) have a sharp bend indicating far lower times of rupture and far higher creep rate for the ingot.

On the basis of heats 1003, 1000, 1007, and 1009, which are the optimum heats as to creep, FIGS. 15*a* and *b*, 16(*a*) and (*b*), 18, 19, the following is the optimum nominal composition for a casting in weight percent:

| | |
|---|---|
| Carbon | 0.18 |
| Manganese | <0.01 |
| Silicon | <0.5 |
| Copper | 2.00 |
| Nickel | 2.50 |
| Chromium | 1.50 |
| Molybdenum | 2.00 |

-continued

| | |
|---|---|
| Vanadium | 0 - 0.50 |
| Tungsten | 2.00 |
| Cobalt | 0.00 |

In summary the conclusion of the study is that the presence of C, V, Mo, and Cu is beneficial to reducing creep, at least up to some optimum level. Also, the presence of Mn, Si, and Ni is detrimental. The best casting results were obtained by the near-elimination of Mn and Si. N, O, S, and P should be held to very low levels, while the C, Cu, and Mo were held at 0.18, 2.0, and 2.0%, respectively. The Cr content of the castings was 1.5 and the Ni was 2.5%. The V content was varied from 0.0 to 0.5 and, in the presence of 0.5 Si, better results were obtained when the higher values of V were present. Four castings (heats) having outstanding properties were studied, i.e., the rupture stresses were significantly more than 1.5 times those now used, for all time periods up to more than 32,974 hr, for which data are available, (FIG. 18). Also, the minimum creep rates for these castings were much less than the values now being accepted for design purposes, (FIG. 19).

While preferred embodiments of this invention have been disclosed herein many modifications thereof are feasible. This invention then is not to be restricted except insofar as is necessitated by the spirit of the prior art.

I claim:

1. In an apparatus operating under conditions requiring resistance to high creep such that it must be capable of resisting rupture for a time interval substantially greater than 8125 hours at 1050°F under constant stress of about 20,000 pounds per square inch, said apparatus having castings or fluid conductors, the improvement wherein said casings or fluid conductors are in the form of a casting of ferrous material consisting essentially of the following composition in weight percent:

Mn — 0–0.01
Si — 0–0.50
Cu — 2.00
V — 0–0.50
C — 0.18
Ni — 2.50
Cr — 1.50
Mo — 2.00
W — 2.00
Fe — Remainder.

2. The apparatus of claim 1 wherein the composition of the casting includes in addition to iron strong carbide-forming elements other than manganese.

3. The apparatus of claim 1 wherein the composition of the casting includes carbides of chromium, molybdenum and vanadium.

4. The apparatus of claim 1 wherein the content of silicon and vanadium in the composition of the casting are both about 0.50%.

5. The apparatus of claim 1 wherein the composition of the casting contains between 1.4% and 2% copper.

6. In an apparatus operating under conditions requiring resistance to high creep exceeding load resistance of 1150 ton-hours, said apparatus having casings or fluid conductors, the improvement wherein said casings or fluid conductors contain welds of a ferrous alloy having the composition consisting essentially of the following in weight percent:

C — 0.078 to 0.201
Mn — 0.032 to 0.091
Si — 0.04 to 0.53
Cu — 0.68 to 1.81
Ni — 0.56 to 3.67
Cr — 0.20 to 1.06
Mo — 1.66 to 1.92
V — 0.41 to 0.85
W — 0 to 0.20
Co — 0.008 to 1.01
Fe — Remainder.

7. In an apparatus operating under conditions requiring resistance to high creep such that it must be capable of resisting rupture for a time interval substantially greater than 8125 hours at 1050°F under constant stress about 20,000 pounds per square inch, said apparatus having casings or fluid conductors, the improvement wherein said casings or fluid conductors are in the form of a casting of ferrous material consisting essentially of the following composition in weight percent:

C — 0.14 to 0.20
Mn — <0.05
Si — <0.05
P — <0.015
S — <0.015
Cu — 1.4 — 2.0
Ni — 0.00 — 2.5
Cr — 1.0 — 2.5
Mo — 1.0 — 2.0
V — 0.0 — 0.8
W — 0.05 — 0.40
Co — 0.5 — 1.01
Fe — Remainder.

8. In an apparatus operating under conditions requiring resistance to high creep exceeding load resistance of 1150 ton-hours, said apparatus having casings or fluid conductors, the improvement wherein said casings or fluid conductors having welds of a ferrous alloy containing the composition consisting essentially of the following in weight percent:

C — 0.14 - 0.20
Mn — <0.088
P — <0.0045
S — <0.005
Si — <0.9
Cu — 1.4 - 2.0
Ni — 0.0 - 3.67
Cr — 0.0 - 1.51
Mo — 1.0 - 2.0
V — 0.0 - 0.85
W — 0.0 - 0.40
Co — 0.0 - 1.01
N — <0.0041
O — <0.0023
Fe — Remainder, the content of Ni depending on the toughness demanded of the alloy.

9. The apparatus of claim 7 wherein the content of nickel in the alloy is less than 0.56%.

* * * * *